US007191120B2

(12) United States Patent
Oshikiri et al.

(10) Patent No.: US 7,191,120 B2
(45) Date of Patent: Mar. 13, 2007

(54) SPEECH ENCODING METHOD, APPARATUS AND PROGRAM

(75) Inventors: Masahiro Oshikiri, Kobe (JP); Kimio Miseki, Kobe (JP); Masami Akamine, Kobe (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 289 days.

(21) Appl. No.: 10/675,947

(22) Filed: Oct. 2, 2003

(65) Prior Publication Data

US 2004/0102970 A1 May 27, 2004

Related U.S. Application Data

(62) Division of application No. 09/726,562, filed on Dec. 1, 2000, now Pat. No. 6,704,702, which is a division of application No. 09/012,762, filed on Jan. 23, 1998, now Pat. No. 6,021,764.

(30) Foreign Application Priority Data

Jan. 23, 1997 (JP) ..... 9-010326
Jun. 12, 1997 (JP) ..... 9-155552

(51) Int. Cl.
*G10L 19/00* (2006.01)
*G10L 11/04* (2006.01)

(52) U.S. Cl. ..... 704/219

(58) Field of Classification Search ..... None
See application file for complete search history.

(56) References Cited

U.S. PATENT DOCUMENTS 5,745,871 A 4/1998 Chen
5,832,437 A * 11/1998 Nishiguchi et al. ..... 704/268

(Continued)

FOREIGN PATENT DOCUMENTS

JP 59-170894 9/1984

(Continued)

OTHER PUBLICATIONS

Mei Yong, et al., "Efficient Encoding of the Long-Term Predictor in Vector Excitation Coders", Advances in Speech Coding, Kluwer Academic Publishers, (1991), pp. 329-338.

(Continued)

*Primary Examiner*—Susan McFadden
(74) *Attorney, Agent, or Firm*—Oblon, Spivak, McClelland, Maier & Neustadt, P.C.

(57) ABSTRACT

A speech encoding method, apparatus and program wherein an input speech signal is divided into a plurality of frames each having a predetermined length, each of the frames is subdivided into a plurality of subframes, a predictive pitch period of a subframe in a to-be-encoded current frame is obtained by using pitch periods of at least two frames of the current frame and past and future frames with respect to the current frame; a pitch period of a subframe in the current frame is obtained by using the predictive pitch period, a relative pitch pattern codebook storing a plurality of relative pitch patterns representing fluctuations in pitch periods of a plurality of subframes is prepared, and a change in pitch period of plural subframes is expressed with one relative pitch pattern selected from the relative pitch pattern codebook.

10 Claims, 40 Drawing Sheets

U.S. PATENT DOCUMENTS

| | | | | |
|---|---|---|---|---|
| 5,884,257 | A | 3/1999 | Maekawa et al. | |
| 5,907,826 | A | 5/1999 | Takagi | |
| 6,067,511 | A | 5/2000 | Grabb et al. | |
| 6,078,880 | A | 6/2000 | Zinser, Jr. et al. | |
| 6,081,776 | A | 6/2000 | Grabb et al. | |
| 6,094,629 | A | 7/2000 | Grabb et al. | |
| 6,098,036 | A | 8/2000 | Zinser, Jr. et al. | |
| 6,119,082 | A | 9/2000 | Zinser, Jr. et al. | |
| 6,138,092 | A | 10/2000 | Zinser, Jr. et al. | |
| 6,202,046 | B1 | 3/2001 | Oshikiri et al. | |
| 6,330,533 | B2 | 12/2001 | Su et al. | |
| 6,427,135 | B1 * | 7/2002 | Miseki et al. | 704/258 |
| 6,470,310 | B1 * | 10/2002 | Oshikiri et al. | 704/207 |
| 6,704,702 | B2 * | 3/2004 | Oshikiri et al. | 704/207 |

FOREIGN PATENT DOCUMENTS

| | | |
|---|---|---|
| JP | 61-25200 | 2/1986 |
| JP | 62-238599 | 10/1987 |
| JP | 1-502779 | 9/1989 |
| JP | 6-27996 | 2/1994 |
| JP | 6-161494 | 6/1994 |
| JP | 7-181991 | 7/1995 |
| JP | 8-202398 | 8/1996 |
| JP | 8-305398 | 11/1996 |
| JP | 8-328588 | 12/1996 |
| JP | 9-6397 | 1/1997 |
| JP | 9-34499 | 2/1997 |
| JP | 9-504124 | 4/1997 |

OTHER PUBLICATIONS

D.K. Freeman, et al., "The Voice Activity Detector for the Pan-European Digital Cellular Mobile Telephone Service"; IEEE, Proc. ICASSP89, (1989), pp. 369-372.

* cited by examiner

SPEECH ENCODING METHOD, APPARATUS AND PROGRAM

This application is a DIV of Ser. No. 09/726,562 Dec. 1, 2000 U.S. Pat. No. 6,704,702, which is DIV of Ser. No. 09/012,762 Jan. 23, 1998 U.S. Pat. No. 6,021,764.

BACKGROUND OF THE INVENTION

The present invention relates to a background noise/speech classification method of deciding whether an input signal belongs to a background noise period o: a speech period, in encoding/decoding the speech signa a voiced/unvoiced classification method of deciding whether an input signal belongs to a voiced period or an unvoiced period, a background noise decoding method of obtaining comfort background noise by decoding.

The present invention relates to a speech encoding method of compression-encoding a speech signal and a speech encoding apparatus, particularly including processing of obtaining a pitch period in encoding the speech signal.

High-efficiency, low-bit-rate encoding for speech signals is an important technique for an increase in channel capacity and a reduction in communication cost in mobile telephone communications and local communications. A speech signal can be divided into a background noise period in which no speech is present and a speech period in which speech is present. A speech period is a significant period for speech communication, but the bit rate in a background noise period can be decreased as long as the comfort of the speech communication is maintained. By decreasing the bit rate in each background noise period, the overall bit rate can be decreased to attain a further increase in channel capacity and a further reduction in communication cost.

In this case, if background noise/speech classification fails, for example, a speech period is classified as a background noise period, the speech period is encoded at a low bit rate, resulting in a serious deterioration in speech quality. In contrast to this, if a background noise period is classified as a speech period, the overall bit rate increases, resulting in a decrease in encoding efficiency. For this reason, an accurate background noise/speech classification technique must be established.

According to a conventional background noise/speech classification method, a change in power information of a signal is monitored to perform background noise period/speech period classification. For example, according to J. F. Lynch Jr et al., "Speech/Silence Segmentation for Real-time Coding via Rule Based Adaptive Endpoint Detection", Proc. ICASSP, '87, pp. 31.7.1–31.7.4 (reference 1), background noise/speech classification is performed by using a speech metrics and a background noise metrics which are calculated from the frame power of an input signal.

In the method of performing background noise/speech classification by using only the power information of a signal, no problem is posed in a state in which background noise is scarcely heard. This is because, in such a case, the signal power in a speech period is sufficiently larger than the signal power in a background noise period, and hence the speech period can be easily identified. In reality, however, large background noise is present in some case. In such a state, accurate background noise/speech classification cannot be realized. In addition, background noise is not always white noise. For example, background noise whose spectrum is not flat, e.g., sounds produced when cars or a train passes by or other people talk, may be present. According to the conventional background noise/speech classification method, proper classification is very difficult to perform in the presence of such background noise.

A speech signal can be divided into a voiced period having high periodicity and corresponding to a vowel and an unvoiced period having low periodicity and corresponding to a consonant. The signal characteristics in a voiced period clearly differ from those in an unvoiced period. If, therefore, encoding methods and bit rates suited for these periods are set, a further improvement in speech quality and a further decrease in bit rate can be attained.

In this case, if voiced/unvoiced classification fails, and a voiced period is classified as an unvoiced period, or an unvoiced period is classified as a voiced period, the speech quality seriously deteriorates or the bit rate undesirably increases. For this reason, it is important to establish an accurate voiced/unvoiced classification method.

For example, a conventional voiced/unvoiced classification method is disclosed in J. P. Campbell et al., "Voiced/Unvoiced Classification of Speech with Applications to the U.S. Government LPC-10E Algorithm", Proc. ICASSP, '86, vol. 1, pp. 473–476 (reference 2). According to reference 2, a plurality of types of acoustical parameters for speech are calculated, and the weighted average value of these acoustical parameters is obtained. This value is then compared with a predetermined threshold to perform voiced/unvoiced classification.

It is, however, clear that the voiced/unvoiced classification performance is greatly influenced by the balance between a weighting value used for each acoustical parameter for weighted average calculation and a threshold. It is difficult to determine optimal weighting values and an optimal threshold.

A conventional background noise decoding method will be described next. In a background noise period, encoding is performed at a very low bit rate to decrease the overall bit rate, as described above. For example, according to E. Paksoy et al., "Variable Rate Speech Coding with Phonetic Segmentation", Proc. ICASSP, '93, pp. II-155–158 (reference 3), background noise is encoded at a bit rate as low as 1.0 kbps. On the decoding side, the background noise information is decoded by using the decoded parameter expressed at such a low bit rate.

In such a speech decoding method for a background noise period, since a decoded parameter is expressed at a very low bit rate, the update cycle of each parameter is prolonged. If, for example, the update cycle of a decoded parameter for a gain is prolonged, a change in gain in a background noise period cannot properly follow. As a result, a change in gain becomes discontinuous. If background noise information is decoded by using such a gain, a discontinuous change in gain becomes offensive to the ear, resulting in a great deterioration in subjective quality.

As described above, according to the conventional background noise/speech classification method using only the power information of a signal, accurate background noise/speech classification cannot be realized in the presence of large background noise. In addition, it is very difficult to perform proper classification in the presence of background noise whose spectrum is not that of white noise, e.g., sounds produced when cars or a train passes by or other people talk.

In the conventional voiced/unvoiced classification method using the technique of comparing the weighted average value of acoustical parameters with a threshold, classification becomes unstable and inaccurate depending on the balance between a weighting value used for each acoustical parameter and a threshold.

In the conventional speech decoding method for a background noise period, since a decoded parameter for background noise is expressed at a very low bit rate, the update cycle of each parameter is prolonged. If, therefore, the update cycle of a decoded parameter for a gain is long, in particular, a change in gain in a background noise period cannot properly follow, and a change in gain becomes discontinuous. As a result, a great deterioration in subjective quality occurs.

BRIEF SUMMARY OF THE INVENTION

It is the principal object of the present invention to provide a background noise/speech classification method capable of properly performing background noise period/speech period classification regardless of the magnitude and characteristics of background noise.

It is another object of the present invention to a voiced/unvoiced classification method capable of performing stable, accurate voiced period/unvoiced period classification.

It is still another object of the present invention to provide a background noise decoding method capable of obtaining background noise with excellent subjective quality by decoding even if a decoded parameter of the background noise is expressed at a very low bit rate.

It is still another object of the present invention to provide a speech encoding method and apparatus which can properly obtain a frame period of a speech signal with a small calculation amount, and express a pitch period with a small information amount.

According to the present invention, there is provided a background noise/speech classification method including calculating power and spectral information of an input signal as feature amounts, and comparing the calculated feature amounts with estimated feature amounts constituted by pieces of estimated power and estimated spectral information in a background noise period, thereby deciding whether the input signal belongs to speech or background noise.

More specifically, calculated feature amounts are compared with estimated feature amounts to analyze power and spectral fluctuation amounts. If both the analysis results on the power and spectral fluctuation amounts indicate that the input signal is background noise, it is decided that the input signal is background noise. Otherwise, it is decided that the input signal is speech. For example, the spectral information is updated by an LSP coefficient.

When background noise/speech classification is performed by using spectral information as well as power information, even a speech period with small power can be accurately decided because the spectrum in a background noise period clearly differs from that in a speech period.

In this background noise/speech classification method, estimated feature amounts are preferably updated by different methods depending on whether it is decided that an input signal belongs to background noise or speech. In addition, the update amount to be set when it is decided that an input signal belongs to background noise is preferably set to be smaller than that to be set when it is decided that the input signal belongs to speech. With this setting, even if an input signal has a long speech period and undergoes a change to "background noise" after the long speech period, since the estimated feature amounts are hardly influenced by the feature amounts in the speech period, background noise can be easily identified.

A spectral fluctuation amount can be accurately analyzed by comparing a predetermined threshold with the spectral distortion between a spectral envelope obtained from the spectral information of an input signal and a spectral envelope obtained from estimated spectral information in a background noise period. With this operation, more accurate background noise/speech classification can be realized.

In this case, if the threshold is changed in accordance with estimated power information, e.g., the threshold is increased when the estimated power is small and vice versa, decision errors caused by changes in spectral fluctuation due to changes in estimated power can be reduced. More accurate background noise/speech classification can therefore be realized.

In the present invention, when a decision result indicating that an input signal belongs to speech or background noise changes from "speech" to "background noise", the decision result may be forcibly changed to "speech" only for a specific period (to be referred to as a hangover period). In this case, the hangover period is changed in accordance with pieces of estimated power and estimated spectral information in a background noise period. For example, when estimated frame power or the formant spectral power of a spectral envelope obtained from estimated spectral information is large, the hangover period is prolonged to prevent omission of the end of a sentence which occurs when the background noise power is large or the background noise spectrum is not that of white noise.

In a voiced/unvoiced classification method according to the present invention, a voiced appearance probability table and an unvoiced appearance probability table in which voiced and unvoiced appearance probabilities are respectively written in correspondence with speech feature amounts are prepared, and voiced and unvoiced probabilities are obtained by referring to the voiced appearance probability table and the unvoiced appearance probability table by using a feature amount calculated from input speech as a key, thereby deciding on the basis of the voiced and unvoiced probabilities whether the input speech belongs to speech or background noise.

In this case, for example, voiced/unvoiced decision is manually performed on actual speech data to prepare a voiced appearance probability table and an unvoiced appearance probability table on the basis of the decision results. Since most likelihood speech quality can be determined by using these tables, the classification performance is not influenced by an empirically determined weighting value or threshold, unlike the conventional method. Stable, accurate voiced/unvoiced classification can therefore be realized.

In a background noise decoding method of the present invention, an excitation signal for driving a synthesis filter for synthesizing background noise, a gain by which the excitation signal is to be multiplied, and information of the synthesis filter are decoded to smooth the gain to be used when background noise information is decoded. When background noise information is decoded in this manner, since the gain changes smoothly, the subjective quality of background noise obtained by decoding is improved.

In smoothing a gain in this manner, the gain is gradually increased when the gain increases, whereas the gain is quickly decreased when the gain decreases. With this operation, an unnecessary increase in gain due to smoothing of the gain can be prevented, and the subjective quality is improved more effectively.

The present invention provides a speech encoding processing method including dividing an input speech signal into frames each having a predetermined length, obtaining the pitch period of the input speech signal, obtaining the pitch period of a future frame with respect to the current frame to be encoded, and encoding the pitch period.

The present invention provides a speech encoding method including dividing an input speech signal into frames each having a predetermined length, dividing a speech signal of each frame into subframes, and obtaining the pitch period of the speech signal, the predictive pitch period of a subframe in the current frame being obtained by using the pitch periods of at least two frames of the current frame to be encoded and past and future frames with respect to the current frame, and the pitch period of the subframe in the current frame being obtained by using the predictive pitch period.

As described above, according to the present invention, the pitch period of a future frame with respect to the current frame is obtained. The predictive pitch period of a subframe in the current frame is obtained by interpolation using the pitch periods of both the current and previous frames, and the pitch period of the subframe in the current frame is obtained by using this predictive pitch period. Even if the pitch period varies within a frame, therefore, the pitch period of a subframe can be accurately obtained with a small calculation amount and can be expressed with a small information amount.

In addition, since a predicted subframe pitch period approximates to the actual pitch period with a considerable accuracy, no problem is posed even if the search range for the pitch period of a subframe is limited to, e.g., eight candidates. Assume that the search range for a subframe pitch period is set to eight candidates. In this case, since the pitch period of each frame is expressed by seven bits, and the pitch period of each subframe is expressed by three bits, if four subframes constitute one frame, the pitch periods of the subframes in each frame can be expressed with an information amount of 7 bits+3 bits*4=19 bits, unlike the prior art in which 28 bits are required per frame. In addition, since the search range for subframe pitch periods is as small as eight candidates, the calculation amount can be greatly reduced.

In the present invention, the pitch period of a subframe in the current frame, which is obtained in the above manner, may be encoded. When a pitch filter is to be used to emphasize the pitch period component of an input speech signal, a transfer function for the pitch filter may be determined by using the pitch period of a subframe in the current frame, which is obtained in the above manner. The pitch filter is known as a constituent element of a perceptual weighting filter or a post filter.

The present invention provides a speech encoding method including preparing an adaptive codebook storing a plurality of adaptive vectors generated by repeating a past excitation signal series at a period included in a predetermined range, and searching a predetermined search range for an adaptive vector with a period that minimizes the error between a target vector and a signal obtained by filtering the adaptive vector extracted from the adaptive codebook through a predetermined filter, an input speech signal is divided into frames each having a predetermined length. A speech signal of each frame is further divided into subframes, the predictive pitch period of a subframe in the current frame is obtained by using the pitch periods of at least two frames of the current frame to be encoded and past and future frames with respect to the current frame, and the search range for subframes in the current frame is determined by using the predictive pitch period.

In the present invention, when the pitch periods of frames are to be obtained, the pitch period analysis position may be adaptively determined in units of frames. More specifically, the pitch period analysis position is decided on the basis of the magnitude of the power of a speech signal, a prediction error signal, or the short-term power of a prediction error signal obtained through a low-pass filter. With this operation, a pitch period can be obtained more accurately, and hence an improvement in the quality of decoded speech can be attained.

A method of obtaining the pitch period of a subframe in the current frame may be selected in accordance with the continuance of pitch periods. If, for example, it is decided that a change in pitch period is continuous, a predicted subframe pitch period is obtained, and a range near this value is searched to obtain a subframe pitch period. In contrast to this, if it is decided that a change in pitch period is discontinuous, a subframe pitch period is obtained by searching all subframes. With this adaptive processing, an optimal subframe pitch period search method is selected in accordance with the continuance of pitch periods, the quality of decoded speech is improved.

Furthermore, a relative pitch pattern codebook storing a plurality of relative pitch patterns representing fluctuations in the pitch periods of a plurality of subframes may be prepared, and a change in pitch period of a subframe may be expressed with one relative pitch pattern selected from the relative pitch pattern codebook on the basis of a predetermined index, thereby further decreasing the number of bits of information expressing a subframe pitch period.

More specifically, the relative pitch pattern codebook stores, for example, relative pitch patterns with high appearance frequencies as vectors. These vectors are matched with the pitch periods of a plurality of subframes as vectors to express the pitch periods of a plurality of subframes by optimal relative pitch patterns. If, for example, three bits are required to express the pitch period of each subframe, 12 bits are required for four subframes. If, however, this four-dimensional vector is expressed by one relative pitch pattern having a size corresponding to seven bits in the relative pitch pattern, five bits can be reduced per frame.

According to the present invention, there is provided a computer-readable recording medium on which a program for performing speech encoding processing including processing of dividing an input speech signal into frames each having a predetermined length, and obtaining the pitch period of the input speech signal is recorded. A program for executing processing of obtaining the pitch period of a future frame with respect to the current frame to be encoded, and processing of encoding the pitch period is recorded on the recording medium.

According to the present invention, there is provided a computer-readable recording medium on which a program for performing speech encoding processing including processing of dividing an input speech signal into frames each having a predetermined length, further dividing the speech signal of each frame into subframes, and obtaining the pitch period of the input speech signal is recorded. A program for executing processing of obtaining the predictive pitch period of a subframe in the current frame by using the pitch periods of at least two frames of the current frame to be encoded and past and future frames with respect to the current frame, and obtaining the pitch period of a subframe in the current frame by using the predictive pitch period is recorded on the recording medium.

According to the present invention, there is provided a computer-readable recording medium which has an adaptive codebook storing a plurality of adaptive vectors generated by repeating a past excitation signal string at a period included in a predetermined range, and on which a program for performing speech encoding processing including processing of searching a predetermined range for an adaptive vector with a period that minimizes the error between a target vector and a signal obtained by filtering an adaptive vector extracted from the adaptive codebook through a predetermined filter is recorded. A program for executing processing of dividing an input speech signal into frames each having a predetermined length, further dividing the speech signal of each frame into subframes obtaining the predictive pitch period of a subframe in the current frame by using the pitch periods of at least two frames of the current frame to be encoded and past and future frames with respect to the current frame, and determining the search range for subframes in the current frame by using the predictive pitch period is recorded on the recording medium.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described below with reference to the accompanying drawing.

Figure 1:
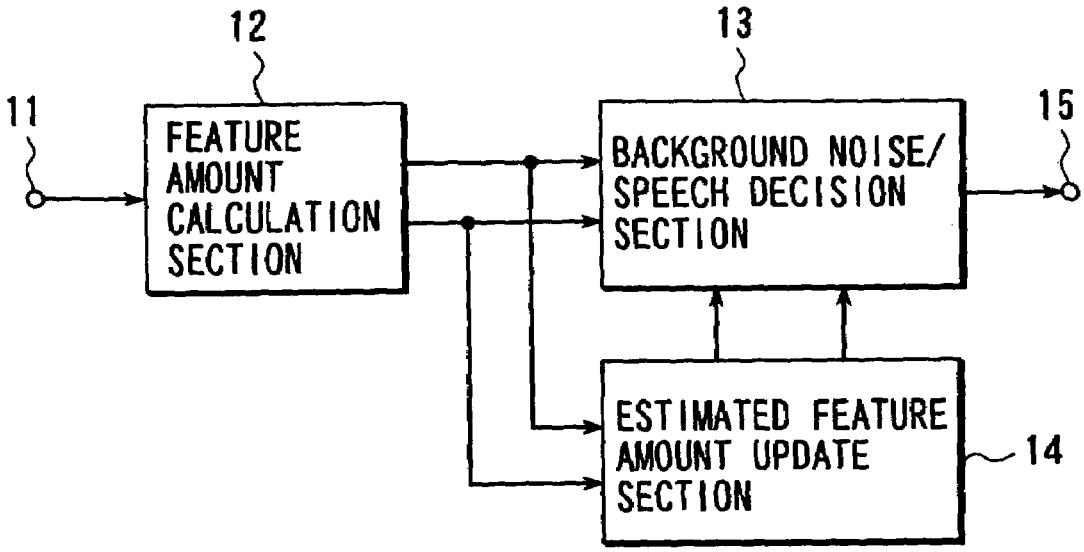
FIG. 1 is a block diagram showing the arrangement of an apparatus to which a background noise/speech classification method according to an embodiment of the present invention is applied.

FIG. 1 shows a background noise/speech classification apparatus according to an embodiment of the present invention. Referring to FIG. 1, for example, a speech signal obtained by picking up speech through a microphone and digitalizing it is input as an input signal to an input terminal 11 in units of frames each consisting of a plurality of samples. In this embodiment, one frame consists of 240 samples.

This input signal is supplied to a feature amount calculation section 12, which calculates various types of feature amounts characterizing the input signal. In this embodiment, frame power ps as power information and an LSP coefficient {ωs(i), i=1, . . . , NP} as spectral information are used as feature amounts to be calculated.

Figure 2:
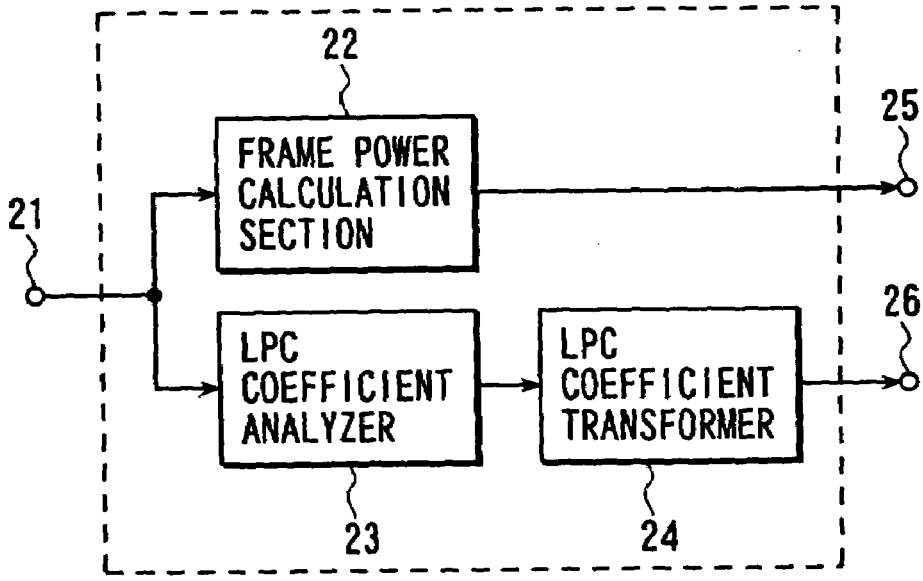
FIG. 2 is a block diagram showing the arrangement of a feature amount calculation section in the embodiment.

FIG. 2 shows the arrangement of the feature amount calculation section 12. The frame power ps of an input signal s(n) from an input terminal 21 is calculated by a frame power calculation section 22 and output from an output terminal 25. This calculated frame power ps is defined by the following equation:

$$p_s = \frac{1}{N}\sum_{n=0}^{N-1} s^2(n) \tag{1}$$

where N is the frame length.

The input signal s(n) is also supplied to an LPC coefficient analyzer 23. The LPC coefficient analyzer 23 obtains an LPC coefficient by using an existing technique such as the correlation method. The LPC coefficient obtained in this manner is supplied to an LPC coefficient transformer 24 to be converted into an LSP coefficient {ωs(i), i=1, . . . , NP}. The coefficient is then output from an output terminal 26.

The frame power ps and the LSP coefficient {ωs(i), i=1, . . . , NP} obtained by the feature amount calculation section 12 are supplied to a background noise/speech decision section 13. At the same time, coefficient {ωe(i), i=1, . . . , NP} obtained by an estimated feature amount update section 14 are supplied to the background noise/speech decision section 13. The background noise/speech decision section 13 decides on the basis of these pieces of information whether the input signal s(n) is background noise or speech, and outputs the decision result to an output terminal 15.

After the background noise/speech decision section 13 performs background noise/speech decision on a given frame in this manner, the estimated feature amount update section 14 updates the estimated frame power pe and the estimated LSP coefficient {ωe(i), i=1, . . . , NP} by using the calculated frame power ps and the calculated LSP coefficient {ωs(i), i=1, . . . , NP} to prepare for the next frame.

The background noise/speech decision section 13 and the estimated feature amount update section 14 will be described further in detail below.

The function of the background noise/speech decision section 13 is expressed as a function that receives the calculated frame power ps, the calculated LSP coefficient {ωs(i), i=1, . . . , NP}, the estimated frame power pe, and the estimated LSP coefficient {ωe(i), i=1, . . . , NP}, and outputs either a background noise decision signal "0" or a speech decision signal "1" as a decision result.

$$c=F(ps,\ \omega s(i),\ pe,\ \omega e(i)) \tag{2}$$

where F is the function that outputs "0" upon deciding that the input signal is background noise; and "1" upon deciding that the input signal is speech.

The function F will be described in detail. The function F is realized in accordance with the following procedure. First of all, the fluctuation amount of the frame power is analyzed, and the fluctuation amount between the LSP coefficients is analyzed. Finally, only when both the analysis results on the fluctuation amount of the frame power and the fluctuation amount between the LSP coefficients indicate background noise, it is decided that the input sound is background noise, and "0" is output. Otherwise, it is determined that the input sound is speech, and "1" is output.

Figure 3:
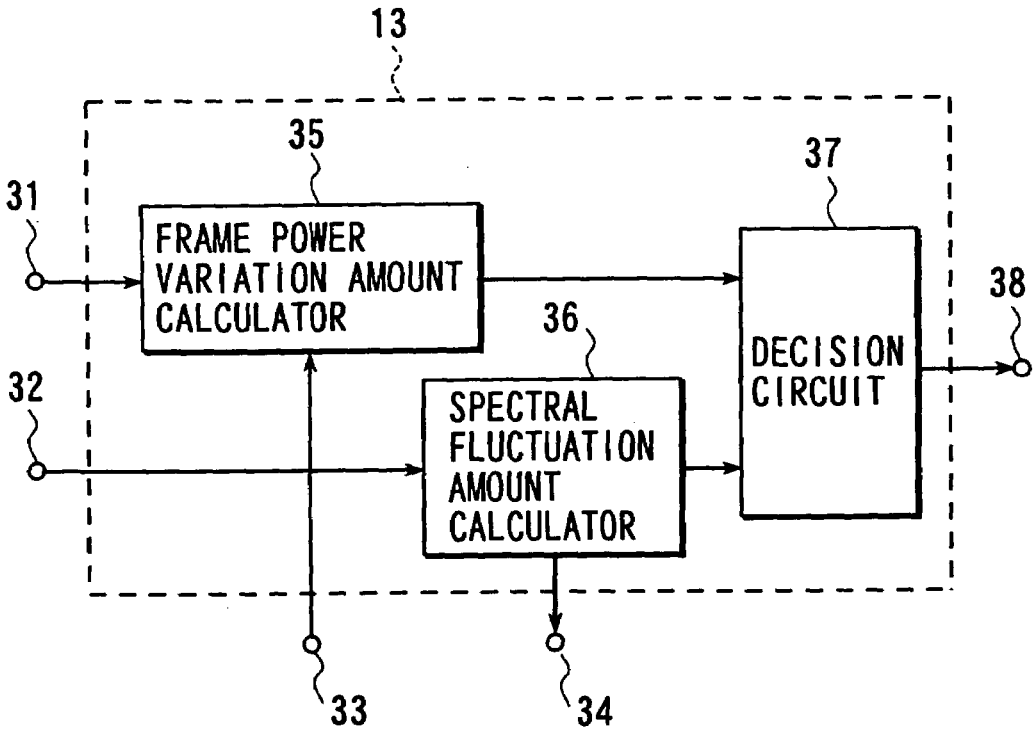
FIG. 3 is a block diagram showing the arrangement of a background noise/speech decision section in the embodiment.

FIG. 3 shows the arrangement of the background noise/speech decision section 13. The calculated frame power ps, the calculated LSP coefficient {ωs(i), i=1, . . . , NP}, the estimated frame power pe, and the estimated LSP coefficient {ωe(i), i=1, . . . , NP} are respectively input through an input terminal 31, an input terminal 32, an input terminal 33, and an input terminal 34. A frame power fluctuation amount calculator 35 performs background noise/speech decision based on a frame power fluctuation amount by using the calculated frame power ps and the estimated frame power pe.

A spectral fluctuation amount calculator 36 performs background noise/speech decision based on a spectral fluctuation amount by using the input calculated LSP coefficient {ωs(i), i=1, . . . , NP} and the estimated LSP coefficient {ωe(i), i=1, . . . , NP}. A decision circuit 37 performs comprehensive decision based on the decision result obtained by the frame power fluctuation amount calculator 35 and the decision result obtained by the spectral fluctuation amount calculator 36. More specifically, if both the decision results indicate background noise, the decision circuit 37 outputs a decision result indicating background noise as a final decision result from an output terminal 38. Otherwise, the decision circuit 37 outputs a decision result indicating speech as a final decision result from the output terminal 38.

Analysis of a frame power fluctuation amount will be described next. A frame power fluctuation amount is analyzed according to the following equation. When the equation is satisfied, it is decided from the power information that the frame is background noise. In contrast to this, if the equation is not satisfied, it is determined that the frame is speech.

$$ps - x \cdot pe < 0 \tag{3}$$

where x is a predetermined positive constant. When a value obtained by multiplying the estimated frame power pe by x is compared with the calculated frame power ps of the current frame, it can be decided that a frame that has power larger than the estimated frame power by at least x times is speech. This prevents a frame as background noise from being erroneously decided as speech, and hence can realize stable decision.

In addition, when the value x is adaptively changed depending on the magnitude of the calculated frame power ps, satisfactory decision can be performed even if the power of background noise is too large to perform proper decision. More specifically, decision errors can be decreased by decreasing the value x as the calculated frame power ps increases, and vice versa. It therefore suffices if the value x is adaptively changed in this manner.

The fluctuation amount between LSP coefficients is defined as the Euclidean distance between the LSP coefficients, and is obtained according to the following equation. When the equation is satisfied, it is decided from the spectral information that the frame is background noise. In contrast to this, if the equation is not satisfied, it is decided that the frame is speech.

$$\sum_{i=1}^{NP} |\omega_s(i) - \omega_e(i)|^2 < T_f \tag{4}$$

where Tf is a predetermined threshold.

When the fluctuation amount of the frame power and the fluctuation amount between the LSP coefficients are evaluated in this manner, and it is decided from both noise, the background noise/speech decision section 13 outputs the decision signal "0" indicating background noise as a background noise/speech decision result. Otherwise, i.e., when either the fluctuation amount of the frame power or the fluctuation amount between the LSP coefficients indicates speech, the background noise/speech decision section 13 outputs the decision signal "1" indicating speech as a background noise/speech decision result.

The estimated feature amount update section 14 updates the estimated feature amounts to prepare for the input of the next frame. Of the estimated feature amounts, the estimated frame power pe is updated according to the following equation:

$$pe^{new} = (1-\beta) \cdot ps + \beta \cdot pe \ (0 \leqq \beta \leqq 1) \tag{5}$$

where $pe^{new}$ is the estimated frame power used for the next frame, and β is a predetermined constant.

Similarly, the estimated LSP coefficient {ωe(i), i=1, . . . , NP} is updated according to the following equation:

$$\omega e^{new}(i) = (1-\gamma) \cdot \omega s(i) + \gamma \cdot \omega e(i) \ (0 \leqq \gamma \leqq 1) \tag{6}$$

where $\omega e^{new}(i)$ is the estimated LSP coefficient used for the next frame, and γ is a predetermined constant.

Figure 4:
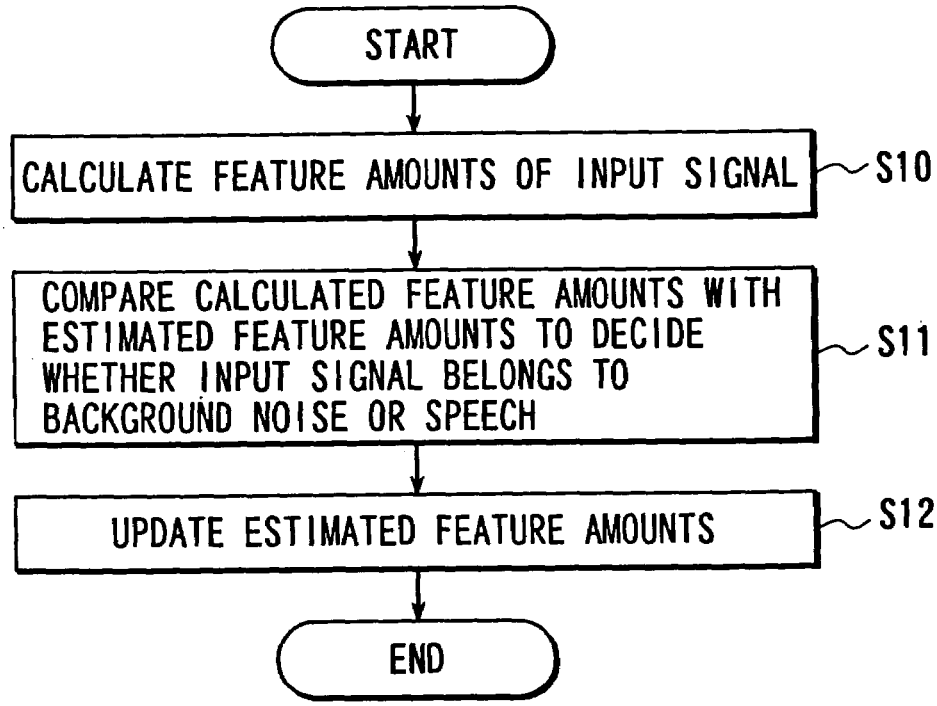
FIG. 4 is a flow chart showing a schematic procedure for processing in the embodiment.

The flow of processing in this embodiment will be described next with reference to the flow chart of FIG. 4. analyzed to calculate feature amounts (step S10). The calculated feature amounts of the current frame are then compared with the estimated feature amounts obtained in the process of processing the previous frame to decide whether the input signal belongs to background noise or speech (step S11). Finally, the estimated feature amounts are updated by using the calculated feature amounts obtained from the current frame to prepare for the input of the next frame (step S12). This method differs from the conventional methods in that both power information such as frame power and spectral information such as LSP coefficients are used as calculated and estimated feature amounts, as described above.

The effect of this embodiment will be described below with reference to FIG. 5.

Figure 5:
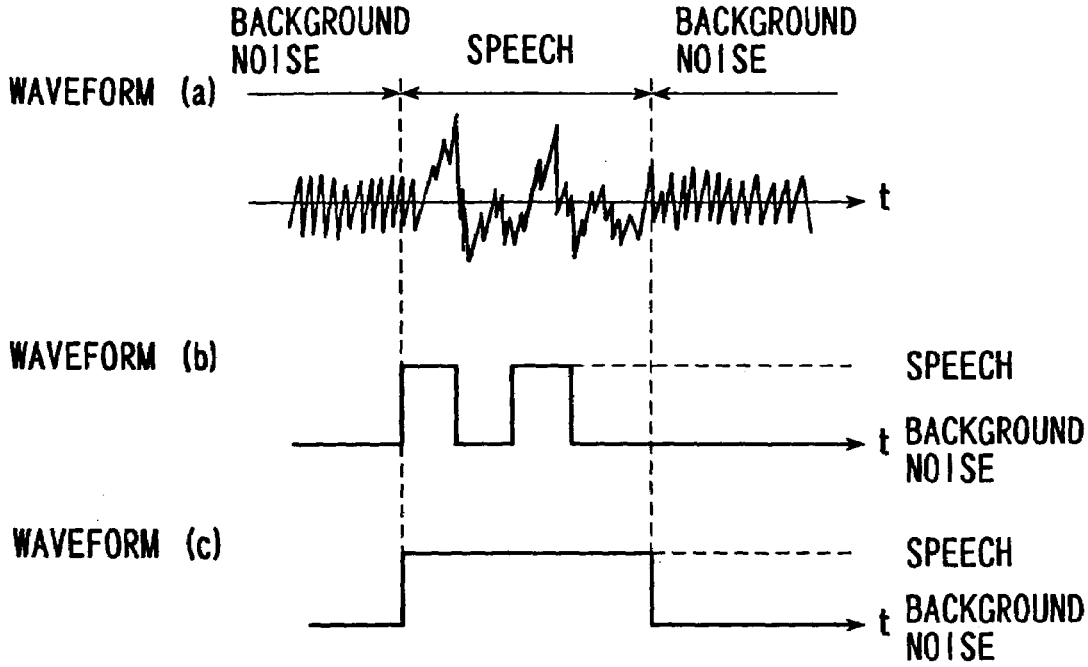
FIG. 5 is a timing chart for explaining the effect of a background noise/speech classification apparatus according to the embodiment.

Assume that background noise/speech decision is performed for an input signal like a signal having a waveform a in FIG. 5 by using only power information. In this case, if the signal has large background noise power, portions having small power in a speech period are decided as background noise, as indicated by a waveform b in FIG. 5.

In contrast to this, when spectral information is used as well as power information as in this embodiment, since the spectrum in a background noise period clearly differs from the spectrum in a speech period, even a speech period in which the power is small can be accurately decided, as indicated by a waveform c in FIG. 5.

Figure 6:
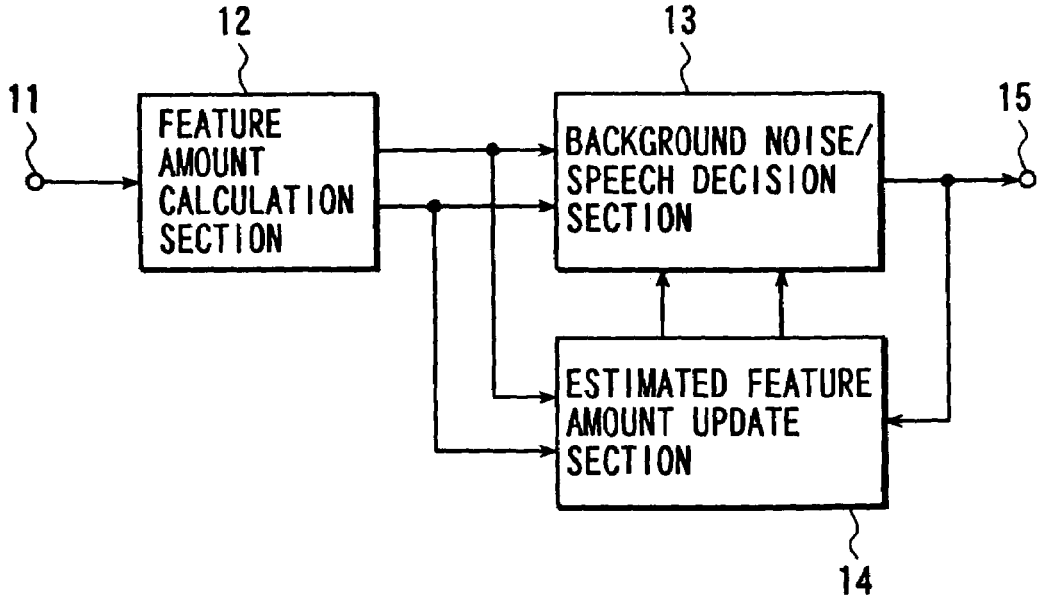
FIG. 6 is a block diagram showing an apparatus to which a background noise/speech classification method according to another embodiment of the present invention is applied.

FIG. 6 shows the arrangement of a background noise/speech classification apparatus according to another embodiment of the present invention. The same reference numerals in FIG. 6 denote the same parts as in FIG. 1, and a detailed description thereof will be omitted. This embodiment differs from the previous embodiment in the method of realizing an estimated feature amount update section 14.

In this embodiment, the update methods in the estimated feature amount update section 14 are switched in accordance with the decision result obtained by a background noise/speech decision section 13. In this case, estimated frame power pe is updated according to the following equations:

$$pe^{new}=(1-\beta 0)\cdot ps+\beta 0\cdot pe \quad (7)$$

$$pe^{new}=(1-\beta 1)\cdot ps+\beta 1\cdot pe \quad (8)$$

Equation (7) represents update processing to be performed when an input signal is decided as background noise by the background noise/speech decision section 13. Equation (8) represents update processing to be performed when an input signal is decided as speech by the background noise/speech decision section 13. Note that $\beta 0$ and $\beta 1$ are set to satisfy $0 \leqq \beta 0 < \beta 1 \leqq 1$.

Similarly, an estimated LSP coefficient $\{\omega e(i), i=1, \ldots, NP\}$ is updated according to the following two equations:

$$\omega e^{new}(i)=(1-\gamma 0)\cdot \omega s(i)+\gamma 0\cdot \omega e(i) \quad (9)$$

$$\omega e^{new}(i)=(1-\gamma 1)\cdot \omega s(i)+\gamma 1\cdot \omega e(i) \quad (10)$$

Equation (9) represents update processing to be performed when an input signal is decided as background noise by the background noise/speech decision section 13. Equation (10) represents update processing to be performed when an input signal is decided as speech by the background noise/speech decision section 13. Note that $\gamma 0$ and $\gamma 1$ are set to satisfy $0 \leqq \gamma 0 < \gamma 1 \leqq 1$.

Figure 7:
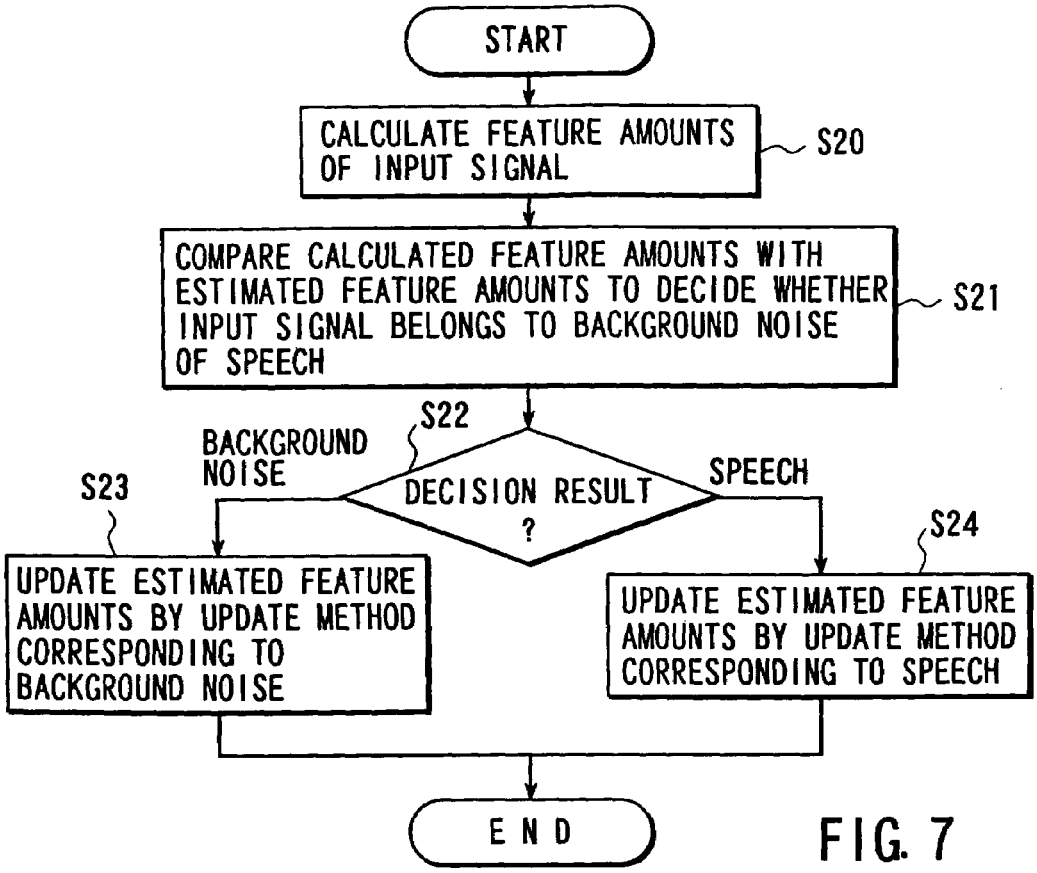
FIG. 7 is a flow chart showing a procedure for processing in the embodiment.

The flow chart of FIG. 7 summarizes the above processing. Since steps S20 and S21 in FIG. 7 are the same as steps S10 and S11 in FIG. 4, a description thereof will be omitted. In step S22, the decision result obtained in step S21 is received. If it is decided in step S21 that the input signal is background noise, the flow advances to step S23. If it is determined that the input signal is speech, the flow advances to step S24. In step S23, the estimated feature amounts are updated by the update method to be used when an input signal is decided as background noise, thereby preparing for the next input frame. In step S24, the estimated feature amounts are updated by the update method to be used when an input signal is decided as speech.

The advantage of this embodiment will be described below with reference to FIG. 8.

Assume that the same update method is always used regardless of the result obtained by the background noise/speech decision section 13. In this case, if an input signal having a long speech period, e.g., a signal having a waveform a in FIG. 8, is received, an estimated feature amount is greatly influenced by a feature amount in the speech period. For this reason, even when the input signal having the waveform a shifts from the speech period to the background noise period, as shown in a waveform b, since the estimated feature amount has already become similar to the feature amount in the speech period, i.e., the frame has spectral information different from that of background noise, the background noise is difficult to identify.

Figure 8:
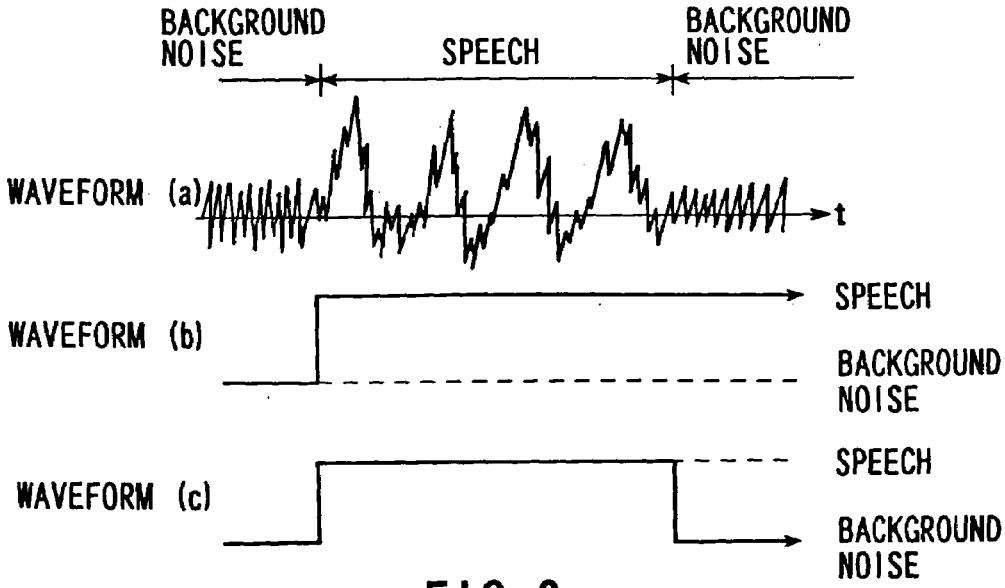
FIG. 8 is a timing chart for explaining the effect of a background noise/speech classification apparatus according to the embodiment.

In contrast to this, in this embodiment, as indicated by a waveform c in FIG. 8, estimated feature amounts in a background noise period and a speech period are updated by the different update methods. In addition, since the update amount in the speech period is set to be small, the estimated feature amount is hardly influenced by the feature amount in the speech period. Even if, therefore, an input signal which changes to background noise after a long speech period is received, the background noise can be identified, thereby realizing more accurate background noise/speech decision.

A background noise/speech classification apparatus according to still another embodiment of the present invention will be described with reference to FIG. 9. This embodiment is characterized in the method of realizing a background noise/speech decision section 13. This method can be applied to both the arrangements shown in FIGS. 1 and 6.

Figure 9:
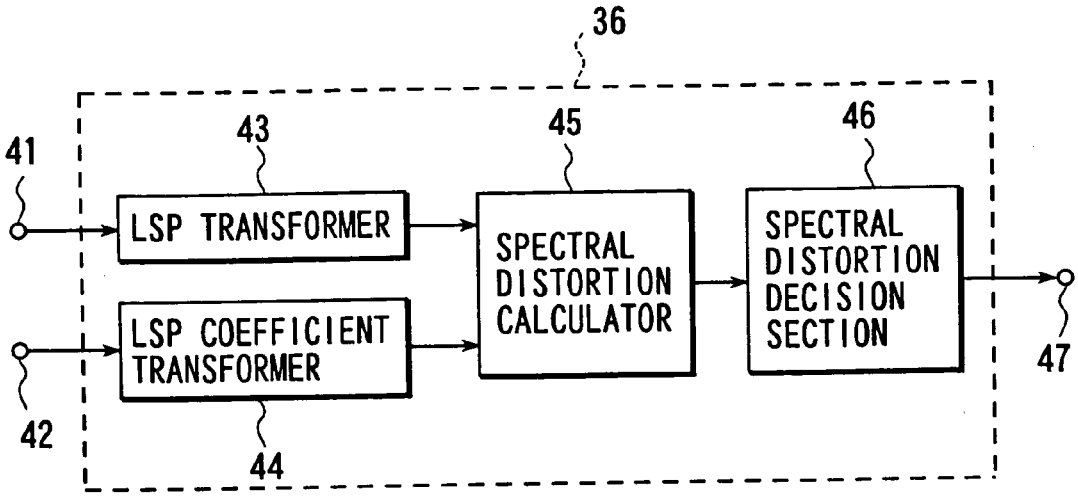
FIG. 9 is a block diagram showing a spectral fluctuation amount calculation section in the embodiment.

FIG. 9 is a block diagram showing an arrangement for obtaining the fluctuation amount between a calculated LSP coefficient $\{\omega s(i), i=1, \ldots, NP\}$ and estimated LSP coefficient $\{\omega e(i), i=1, \ldots, NP\}$ in the spectral fluctuation amount calculator 36 in the background noise/speech decision section 13 shown in FIG. 3. In the previous embodiment, the fluctuation amount between LSP coefficients is obtained as the Euclidean distance between the LSP coefficients, as defined by equation (4). In contrast to this, in this embodiment, LSP coefficients are transformed into spectral envelopes, and the spectral distortion between the spectral envelopes is obtained. This spectral distortion is compared with a predetermined threshold to perform background noise/speech decision.

The Euclidean distance between the LSP coefficients, which is defined by equation (4), may not correspond to the spectral fluctuation amount between the calculated LSP coefficient $\{\omega s(i), i=1, \ldots, NP\}$ and the estimated LSP coefficient $\{\omega e(i), i=1, \ldots, NP\}$. This is because, the definition of the Euclidean distance between LSP coefficients does not uniquely correspond to the spectral fluctuation amount owing to the characteristics of LSP coefficients, although each LSP coefficient corresponds to the peak frequency of the spectral envelope. This interferes with accurate background noise/speech decision.

To solve this problem, in this embodiment, the spectral envelopes of the calculated LSP coefficient $\{\omega s(i), i=1, \ldots, NP\}$ and the estimated LSP coefficient $\{\omega e(i), i=1, \ldots, NP\}$ are obtained, and background noise/speech decision is performed on the basis of the spectral distortion. With this operation, an accurate spectral fluctuation amount can be obtained, and hence background noise/speech decision can be performed more accurately.

This method will be described in detail with reference to FIG. 9. The calculated LSP coefficient $\{\omega s(i), i=1, \ldots, NP\}$ is input through an input terminal 41 and supplied to an LSP transformer 43. The LSP transformer 43 converts the calculated LSP coefficient into an LPC coefficient $\{\alpha s(i), i=1, \ldots, NP\}$ by using an existing technique. Similarly, the estimated LSP coefficient $\{\omega e(i), i=1, \ldots, NP\}$ is input through an input terminal 42 and supplied to an LSP coefficient transformer 44. The LSP coefficient transformer 44 converts the estimated LSP coefficient into an estimated LPC coefficient $\{\alpha e(i), i=1, \ldots, NP\}$. A spectral distortion calculator 45 calculates a spectral distortion SD defined as a square error in the logarithmic region between the spectral envelope of a synthesis filter constituted by the calculated LPC coefficient and the spectral envelope of a synthesis filter constituted by the estimated LPC coefficient according to the following equation:

$$SD = 10\sqrt{\frac{1}{M}\sum_{m=0}^{M-1}\left(\log_{10}\frac{\left|1-\sum_{i=1}^{NP}\alpha_e(i)\exp(j2\pi mi/M)\right|^2}{\left|1-\sum_{i=1}^{NP}\alpha_s(i)\exp(j2\pi mi/M)\right|^2}\right)} \quad (11)$$

where M is the resolution on the frequency axis in each spectral envelope. As this value M increases, a more accurate spectral distortion can be obtained. According to equation (11), the spectral distortions are defined in equal steps on the frequency axis. However, different step widths may be set. If, for example, a spectral fluctuation amount in a low-frequency region is important, small step widths may be set in the low-frequency region, while large step widths may be set in the high-frequency region. With this setting, an increase in calculation amount can be prevented, and an accurate spectral fluctuation amount The spectral distortion SD obtained according to equation (11) is supplied to a spectral distortion decision section 46. The spectral distortion decision section 46 compares the spectral distortion SD with a predetermined threshold Tsd. If the following equation is satisfied, the spectral distortion decision section 46 outputs a decision result indicating background noise to an output terminal 47. Otherwise, the spectral distortion decision section 46 outputs a decision result indicating speech to the output terminal 47.

$$SD<Tsd \quad (12)$$

Figure 10:
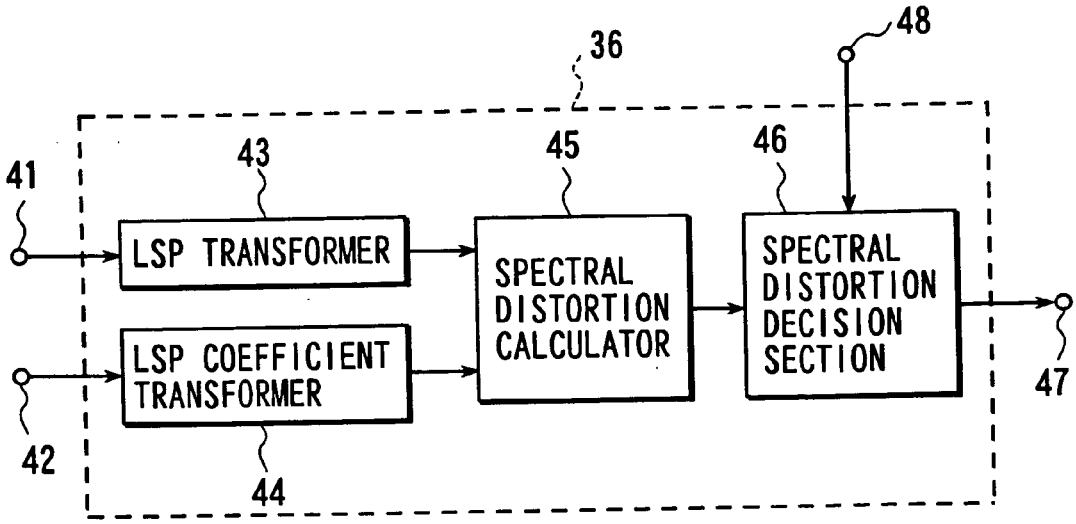
FIG. 10 is a block diagram showing another spectral fluctuation amount calculation section in the embodiment.

A background noise/speech classification apparatus according to still another embodiment of the present invention will be described below with reference to FIG. 10. This embodiment is characterized in another method of realizing a background noise/speech decision section 13. The same reference numerals in FIG. 10 denote the same parts as in FIG. 9, and a description thereof will be omitted. This embodiment differs from the embodiment in FIG. 9 in that a threshold Tsd is adaptively selected depending on estimated frame power pe.

The estimated frame power pe is input through an input terminal 48 and supplied to a spectral distortion decision section 46. The spectral distortion decision section 46 selects one of a plurality of predetermined thresholds in accordance with the estimated frame power pe, and compares it with a spectral distortion SD as indicated by the following equation:

$$SD<Tsd(j)\ (j=1 \text{ to } NT,\ j \text{ is determined by } pe) \quad (13)$$

where NT is the number of predetermined thresholds. When the estimated frame power pe is small, a large threshold is set, and vice versa. With this setting, this arrangement operates effectively.

When a fixed threshold is to be used regardless of the magnitude of estimated frame power, the following problem is posed. Assume that a spectral distortion threshold is set in accordance with small estimated frame power, i.e., a large spectral distortion threshold is set. In this case, if a signal having large estimated frame power is input, since the spectral fluctuation amount between a speech period and a background noise period is small, even a signal component in the speech period is decided as background noise. In contrast to this, assume that a spectral distortion threshold is set in accordance with large, i.e., a small spectral distortion threshold is set. In this case, when a signal having small estimated frame power is input, since the spectral fluctuation amount between a speech period and a background noise period is large, even a single component in the background noise period is decided as speech.

In contrast to this, in this embodiment, as described above, since a threshold is adaptively selected in accordance with estimated frame power, such a problem can be prevented, and accurate background noise/speech classification can be realized.

A background noise/speech classification apparatus according to still another embodiment of the present invention will be described next with reference to FIG. 11. The same reference numerals in FIG. 11 denote the same parts as in FIG. 6, and a description thereof will be omitted. This embodiment differs from the embodiment in FIG. 6 in that a hangover processing section 16 is added to the arrangement in FIG. 6. The hangover processing section 16 monitors the decision result obtained by a background noise/speech decision section 13. When the decision result changes from "speech period" to "background noise period", the hangover processing section 16 changes the decision result to forcibly regard background noise as a signal component in a speech period for an interval corresponding a predetermined number of frames (this period is referred to as a hangover period).

In general, in performing background noise/speech classification, a speech period tends to be mistaken for a background noise period at the last part of a sentence (the end of a sentence). This is because, the speech power at the end of a sentence tends to decrease, and the fluctuation amount between the speech power and the background noise power decreases. To solve this problem, in this embodiment, the hangover processing section 16 is used to output a decision result upon regarding several frames from a frame at which the decision result changes from "speech" to "background noise" as a speech period. In addition, the embodiment is characterized in that the hangover period adaptively changes in accordance with estimated frame power information and estimated spectral information.

The hangover processing section 16 will be described in more detail with reference to FIG. 12.

Figure 12:
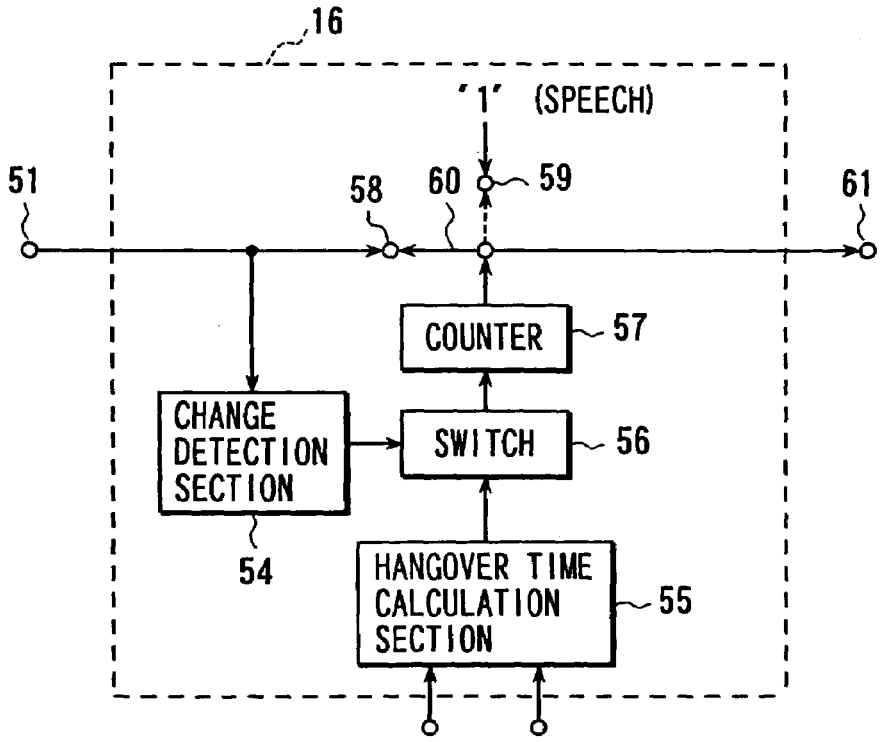
FIG. 12 is a block diagram showing a hangover processing section in the embodiment.

Referring to FIG. 12, the decision result obtained by the background noise/speech decision section 13 is input through a terminal 51. Assume that a decision signal "0" is output as this decision result to indicate background noise, and a decision signal "1" is output to indicate speech, as described above. When the counter value of a counter 57 is "0", a switch 60 is connected to a terminal 58. As a result, the decision result is output from an output terminal 61. The value of the counter 57 is normally set to "0".

A change detection section 54 monitors a decision result input through the terminal 51. When the decision result changes from "speech" to "background noise" (i.e., "1"→"0"), the change detection section 54 turns on a switch 56. Otherwise, the switch 56 is kept off. When the switch 56 is turned on, the currently estimated frame power pe is input through an input terminal 52, and the estimated LSP coefficient {ωe(i), i=1, . . . , NP} is input through an input terminal 53.

A hangover time calculation section 55 calculates a hangover time by using the estimated frame power pe and the estimated LSP coefficient {ωe(i), i=1, . . . , NP}, and supplies the calculated value as a counter value to the counter 57 through the switch 56. When the counter value is larger than "0", the counter 57 connects the switch 60 to a terminal 59 to output "1" as a decision result indicating speech from the output terminal 61. The counter 57 is decremented one by one every time a decision result is input through the terminal 51. Note that a negative counter value is replaced with "0" to prevent the counter value from becoming less than "0".

The hangover time calculation section 55 calculates a hangover time HO according to one of equations (14) and (15):

$$HO=HO_p+HO_{LSP} \tag{14}$$

$$HO=\mathrm{Max}(HO_p, HO_{LSP}) \tag{15}$$

where $HO_p$ is the hangover time calculated from the estimated frame power pe, $HO_{LSP}$ is the hangover time calculated from the estimated LSP coefficient, and Max( ) is the function using a maximum value as an argument.

$HO_p$ can be determined by selecting one of a plurality of predetermined hangover times in accordance with the magnitude of the estimated frame power pe. $HO_{LSP}$ is determined by selecting one of a plurality of predetermined hangover times in accordance with the magnitude of the peak of a spectral envelope represented by the estimated LSP coefficient {ωe(i), i=1, . . . , NP}. An index fd representing the magnitude of the peak of the spectral envelope is defined by the following equation:

$$fd=\sum_{i=1}^{NP-1}\frac{1}{\omega(i+1)-\omega(i)} \tag{16}$$

According to equation (16), when adjacent estimated LSP coefficients are close to each other, i.e., the peak value of the spectral envelope is large, the index fd takes a large value, and a long hangover time $HO_{LSP}$ is selected accordingly. When the index fd takes a small value, a short hangover time $HO_{LSP}$ is selected.

The following advantage is provided by the method of adaptively changing the hangover time in accordance with estimated frame power and an estimated LSP coefficient.

As described above, the power of the end portion of a sentence tends to decrease. If, therefore, the power of background noise (i.e., estimated frame power) occur, and such an omission continues for a long period of time. In addition, while other people are talking, or sounds are produced when, for example, a car or train passes by, a peak is produced in the spectral envelope of background noise. If the resultant envelope becomes similar to the spectral envelope of speech from a talker, the speech may be mistaken for background noise.

In such a case, i.e., when estimated frame power is large, or the peak value of a spectral envelope represented by an estimated LSP coefficient is large, a desired effect can be obtained by setting a long hangover time.

Figure 13:
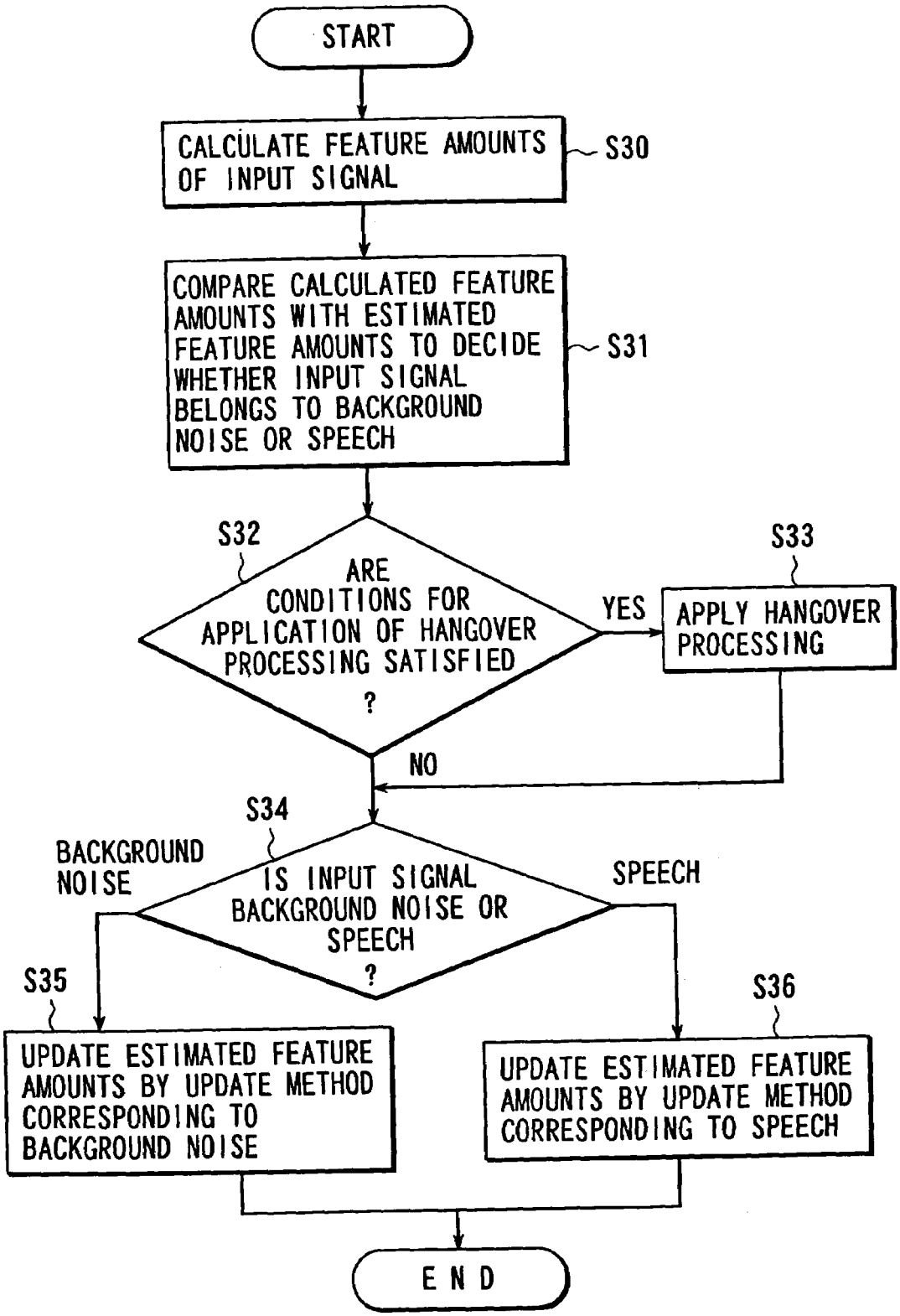
FIG. 13 is a flow chart showing a procedure for processing in the embodiment.

The flow of processing in this embodiment will be described below with reference to the flow chart of FIG. 13. Since steps S30, S31, S34, S35, and S36 in FIG. 13 are the same as steps S20, S21, S22, S23, and S24 in FIG. 7, a description thereof will be omitted.

After it is checked in step S31 whether the input signal belongs to background noise or speech, it is checked in step S32 whether the conditions for the application of hangover processing are satisfied. If YES in step S32, hangover processing is applied in step S33, and the flow advances to step S34. If NO in step S32, the flow directly advances to step S34.

Figure 14:
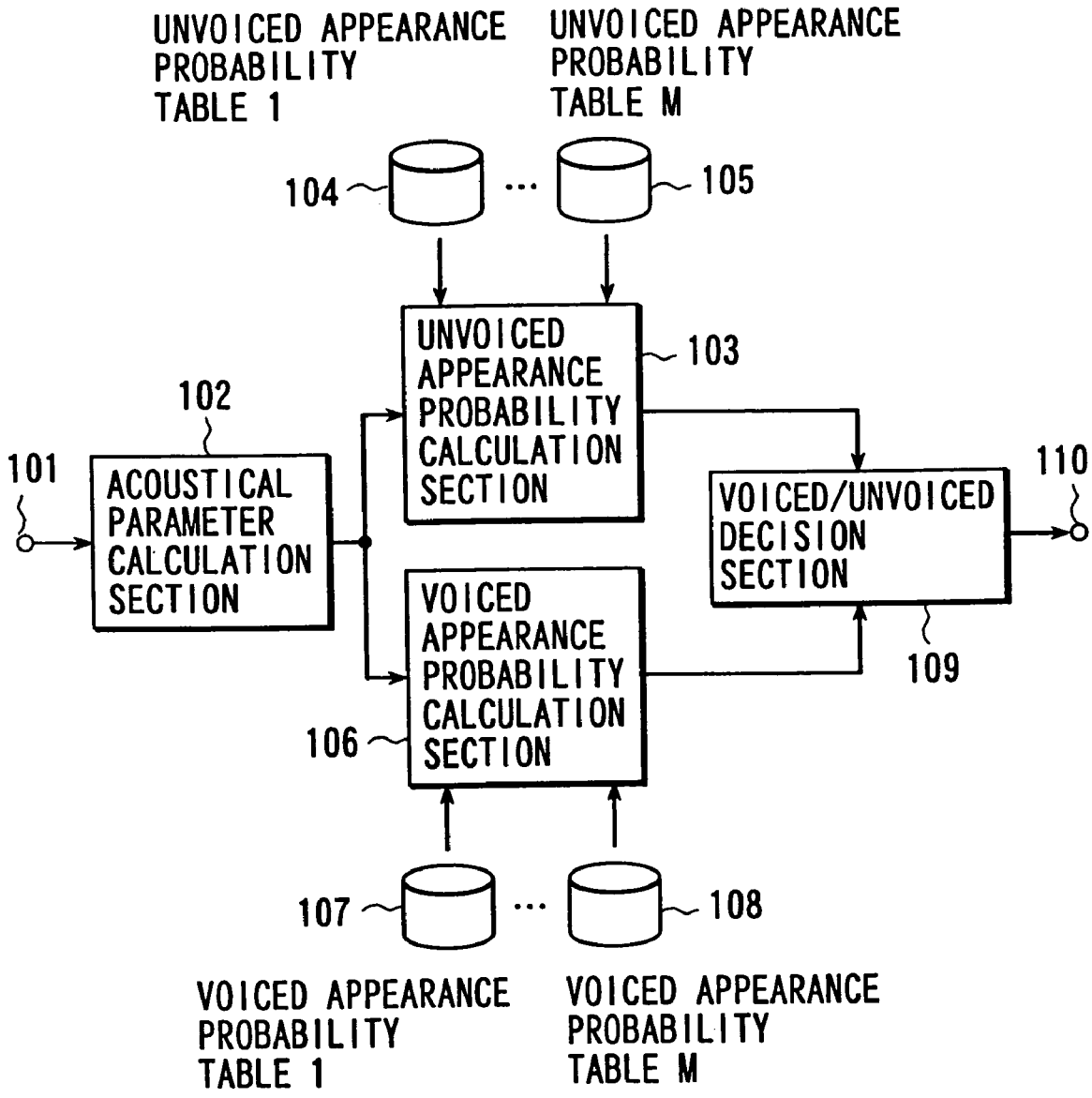
FIG. 14 is a block diagram showing an apparatus to which a voiced/unvoiced classification method according to still another embodiment of the present invention is applied.

A voiced/unvoiced classification apparatus according to still another embodiment of the present invention will be described next with reference to FIG. 14.

A signal is input through an input terminal 101 and supplied to an acoustical parameter calculation section 102. The acoustical parameter calculation section 102 calculates M (M≧1) types of acoustical parameters as speech feature amounts. The calculated acoustical parameters include signal power, signal power after division to a subband, a PARCOR coefficient of the first degree, a LPC prediction gain, a pitch prediction gain, and the like.

The acoustical parameters obtained by the acoustical parameter calculation section 102 are supplied to an unvoiced appearance probability calculation section 103 and a voiced appearance probability calculation section 106. In voiced appearance probability tables 107 and 108 and unvoiced appearance probability tables 104 and 105, voiced and unvoiced appearance probabilities are written in correspondence with speech feature amounts. More specifically, voiced/unvoiced decision on actual speech data is manually performed in advance, and the above tables are generated by using the decision results.

The unvoiced appearance probability calculation section 103 has M unvoiced appearance probability tables 104 and 105 corresponding to the number of types of acoustical parameters, and obtains unvoiced probabilities {ϕU(m), m=1, . . . , M} of the respective supplied acoustical parameters by referring to the corresponding unvoiced appearance probability tables using the acoustical parameters as keys.

Similarly, the voiced appearance probability calculation section 106 has M voiced appearance probability tables 107 and 108 corresponding to the number of types of acoustical parameters, and obtains voiced probabilities {ϕV(m), m=1, . . . , M} of the respective supplied acoustical parameters by referring to the corresponding voiced appearance probability tables using the acoustical parameters as keys.

A voiced/unvoiced decision section 109 uses the unvoiced probability {ϕU(m), m=1, . . . , M} of each acoustical parameter obtained by the unvoiced appearance probability calculation section 103 and the voiced probability {ϕV(m), m=1, . . . , M} of each acoustical parameter obtained by the voiced appearance probability calculation section 106 to decide whether the input signal belongs to a voiced or an unvoiced, and outputs the decision result from an output terminal 110. The voiced/unvoiced decision section 109 decides that the input signal is unvoiced, when the following equation is satisfied. Otherwise, the voiced/unvoiced decision section 109 decides that the input signal is a voiced signal.

$$\prod^{M}\phi_U(m)>\prod^{M}\phi_V(m) \tag{17}$$

In addition, voiced/unvoiced decision may be performed by using the following equation:

$$\phi U(m)>\phi V(m)\ \text{(for all } m) \tag{18}$$

When this equation is satisfied, the input signal is decided as an unvoiced signal. Otherwise, the input signal is decided as a voiced signal. With the use of this equation, decision of "voiced" is facilitated. In this manner, a decision condition suited for a field to which this apparatus is applied is preferably used.

According to this embodiment, since the most likelihood voiced quality is determined by using appearance probability tables generated by manually performing voiced/unvoiced decision on actual speech data, the problem that the classification performance is influenced by empirically determined weighting values and thresholds as in the conventional methods can be solved, and stable, accurate voiced/unvoiced decision can be realized.

Still another embodiment of the present invention will be described next with reference to FIG. 15. In this embodiment, the background noise/speech classification apparatus described with reference to FIG. 11 is applied to speech encoding.

Figure 11:
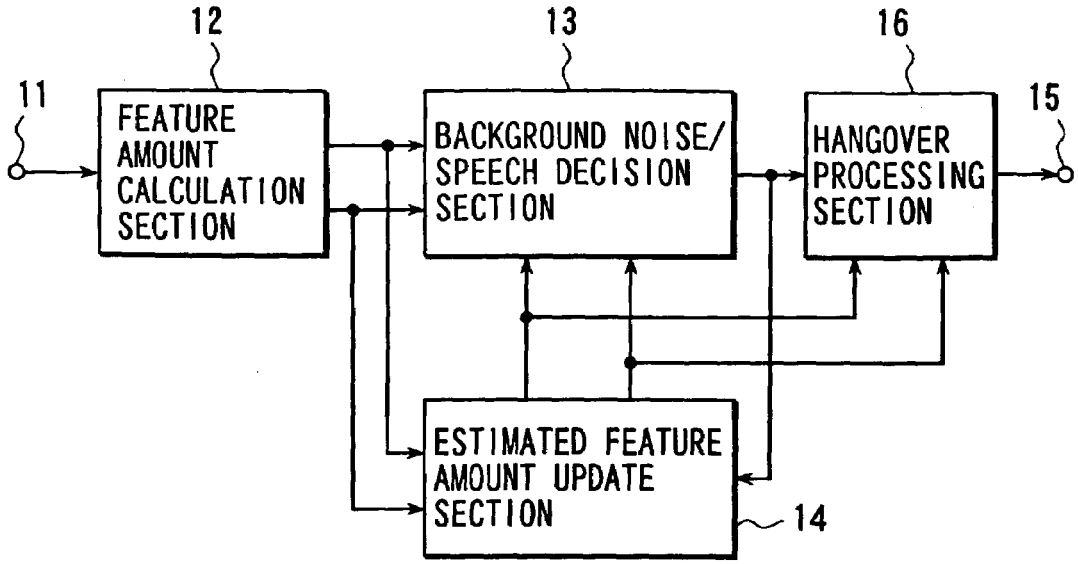
FIG. 11 is a block diagram showing the arrangement of an apparatus to which a background noise/speech classification method according to still another embodiment of the present invention is applied.
Figure 15:
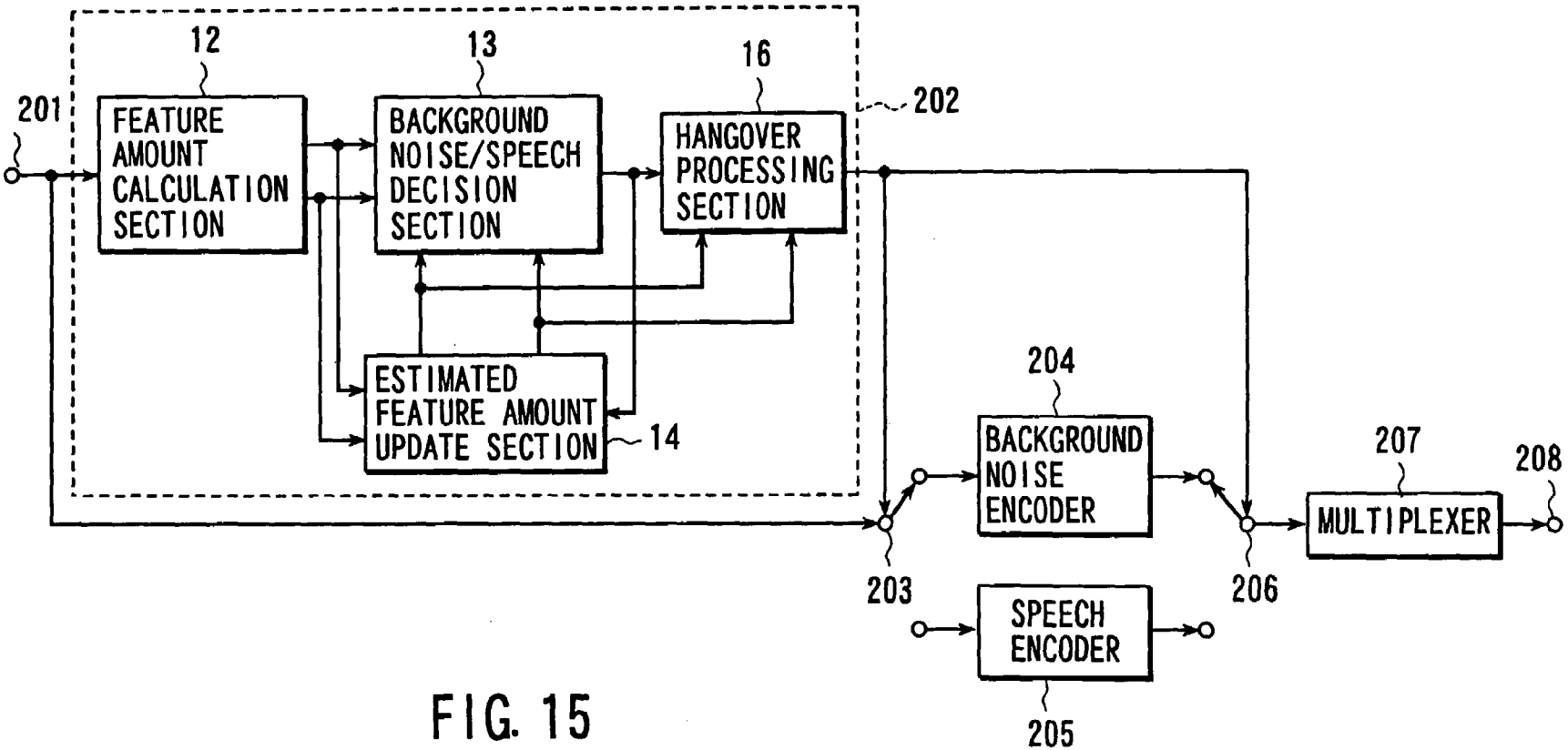
FIG. 15 is a block diagram showing a speech encoding apparatus to which a background noise/speech classification method according to still another embodiment of the present invention is applied.

The same reference numerals in FIG. 15 denote the same parts as in FIG. 11, and a description thereof will be omitted. Referring to FIG. 15, for example, a signal obtained by picking up speech through a microphone and digitalizing it is input as an input signal to an input terminal 201 in units of frames each consisting of a plurality of samples.

In this embodiment, one frame consists of 240 samples.

The input signal from the input terminal 201 is then input to a background noise/speech classification apparatus 202 in FIG. 15. A switching unit 203 is controlled on the basis of the decision result obtained by a background noise/speech decision section 13 in the background noise/speech classification apparatus 202, thereby switching input signal encoding methods.

More specifically, if the decision result indicates background noise, the input signal is supplied to a background noise encoder 204. If the decision result indicates speech, the input signal is supplied to a speech encoder 205. The background noise encoder 204 encodes the signal by a method suited for background noise. Similarly, the speech encoder 205 encodes the signal by a method suited for speech. With this operation, information can be efficiently compressed. The encoded parameters obtained by encoding the input signal in this manner are output from an output terminal 208 through a multiplexer 207.

Figure 16:
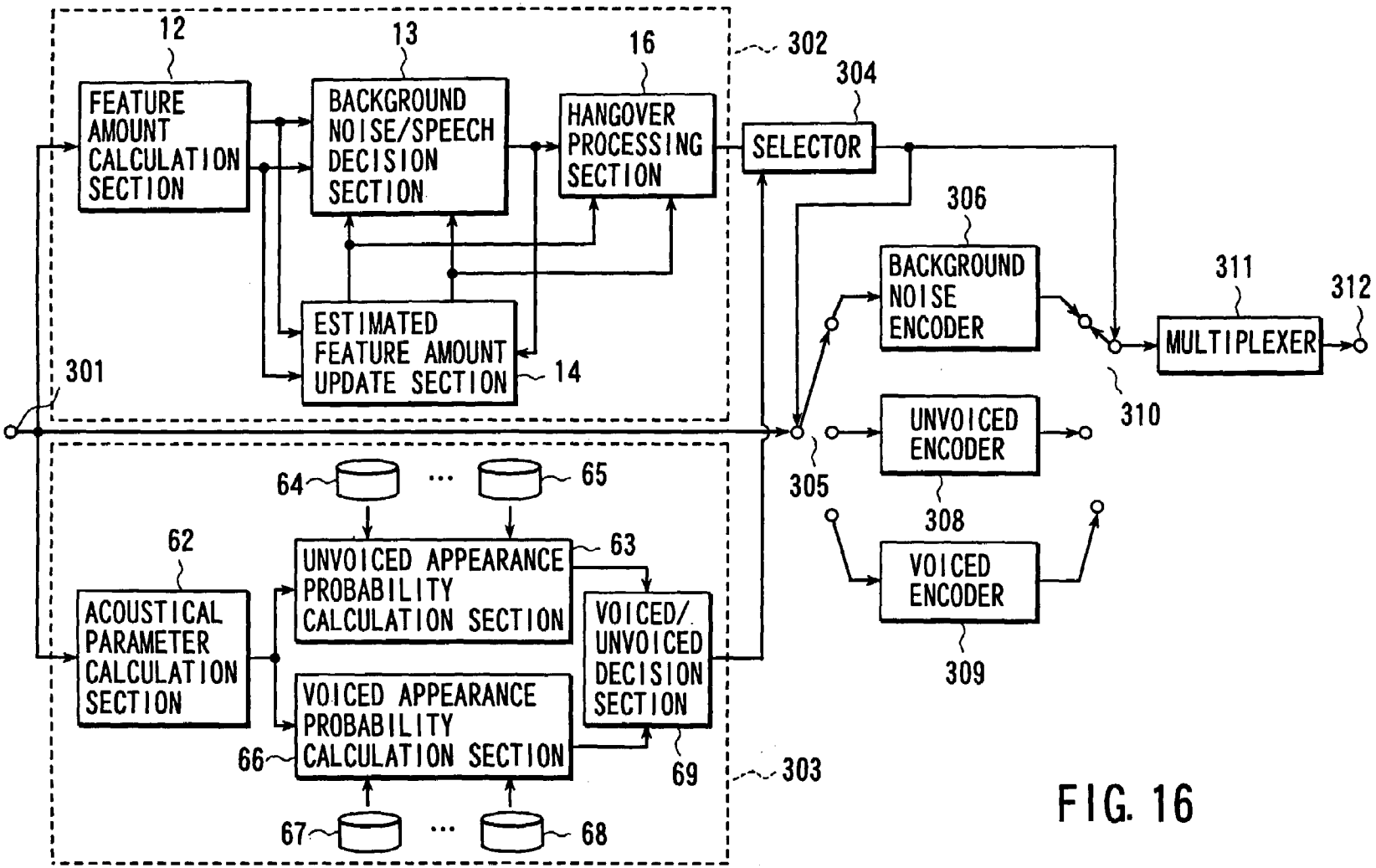
FIG. 16 is a block diagram showing a speech encoding apparatus to which a background noise/speech classification method and a voiced/unvoiced classification method according to still another embodiment of the present invention are applied.

Still another embodiment of the present invention will be described next with reference to FIG. 16. In this embodiment, the background noise/speech classification apparatus described with reference to FIG. 9 and the voiced/unvoiced classification apparatus described with reference to FIG. 14 are applied to speech encoding. The same reference numerals in FIG. 16 denote the same parts as in FIG. 15, and a description thereof will be omitted.

A signal input through an input terminal 301 is supplied to a background noise/speech classification apparatus 302 first. As described above, the background noise/speech classification apparatus 302 decides whether the input signal is background noise or speech. The decision result is then sent to a selector 304. When it is decided that the input signal is background noise, the input signal is supplied to a background noise encoder 306 to be encoded without being processed by a voiced/unvoiced classification apparatus 303. If it is decided that the input signal is speech, the input signal is supplied to the voiced/unvoiced classification apparatus 303 to be subjected to voiced/unvoiced decision according to the above procedure.

The result obtained by the voiced/unvoiced classification apparatus 303 is supplied to the selector 304. If it is decided that the input signal is unvoiced, the signal is supplied to an unvoiced encoder 308 to be encoded. In contrast to this, if it is decided that the input signal is voiced, the signal is supplied to a voiced encoder 309 to be encoded.

In this case, since the background noise encoder 306, the unvoiced encoder 308, and the voiced encoder 309 are respectively constituted by encoders suited for background noise, an unvoiced speech, and a voiced speech, efficient encoding can be realized. The encoded parameters obtained in this manner are output from an output terminal 312 through a multiplexer 311.

Still another embodiment of the present invention will be described next with reference to FIG. 17. This embodiment is associated with the implementation of a background noise decoding apparatus. Encoded data input through an input terminal 401 is decoded by a demultiplexer 402 to obtain decoded parameters. In this embodiment, the decoded parameters include three types, i.e., a decoded excitation signal parameter, a decoded gain parameter, and a decoded synthesis filter parameter. A background noise/speech decision signal is output from the demultiplexer 402 independently of these parameters.

The decoded parameters are input to a background noise decoder 404 in a background noise period by a switching unit 403 which is switched in accordance with the background noise/speech decision signal. These parameters are input to a speech decoder 405 in a speech period. Since the speech decoder 405 is irrelevant to the gist of the present invention, only the background noise decoder 404 will be described below.

In the background noise decoder 404, the decoded excitation signal parameter from the demultiplexer 402 is supplied to an excitation signal decoder 406 to obtain an excitation signal c(n).

Similarly, the decoded gain parameter is supplied to a gain decoder 407 to decode a gain g.

The gain g is supplied to a gain smoothing section 408 to modify (soothing) that makes the gain change smoothly.

The decoded synthesis filter parameter is supplied to a synthesis filter decoder 410 to determine the characteristics of a synthesis filter 411.

The excitation signal c(n) and the smoothed gain are multiplied by a multiplier 409. The resultant data is supplied to the synthesis filter 411. The synthesis filter 411 generates a synthesized signal e(n) by filtering. This synthesized signal e(n) is output from an output terminal 413 through a switch 412 which is switched in accordance with the background noise/speech decision signal. In a speech period, the synthesized signal obtained by the speech decoder 405 in the same manner as described above is output from the output terminal 413 through the switch 412.

The gain smoothing section 408 will be described next.

Gain smoothing in the gain smoothing section 408 is realized according to the following equation:

$$gs(n)=(1-\xi)\cdot g+\xi\cdot gs(n-1)\ (0\leqq\xi\leqq1) \tag{19}$$

where g is the decoded gain, gs(n) is the gain after smoothing, n is the sampling position, and ξ is the constant that controls the degree of smoothing.

When gain smoothing is performed in this manner, since the gain changes smoothly, the subjective quality of background noise is improved.

A background noise decoding apparatus according to still another embodiment of the present invention will be described next. This embodiment has the same arrangement as that shown in FIG. 17, and hence will be described with reference to FIG. 17. This embodiment is characterized in the processing performed in a gain smoothing section 408.

Figure 17:
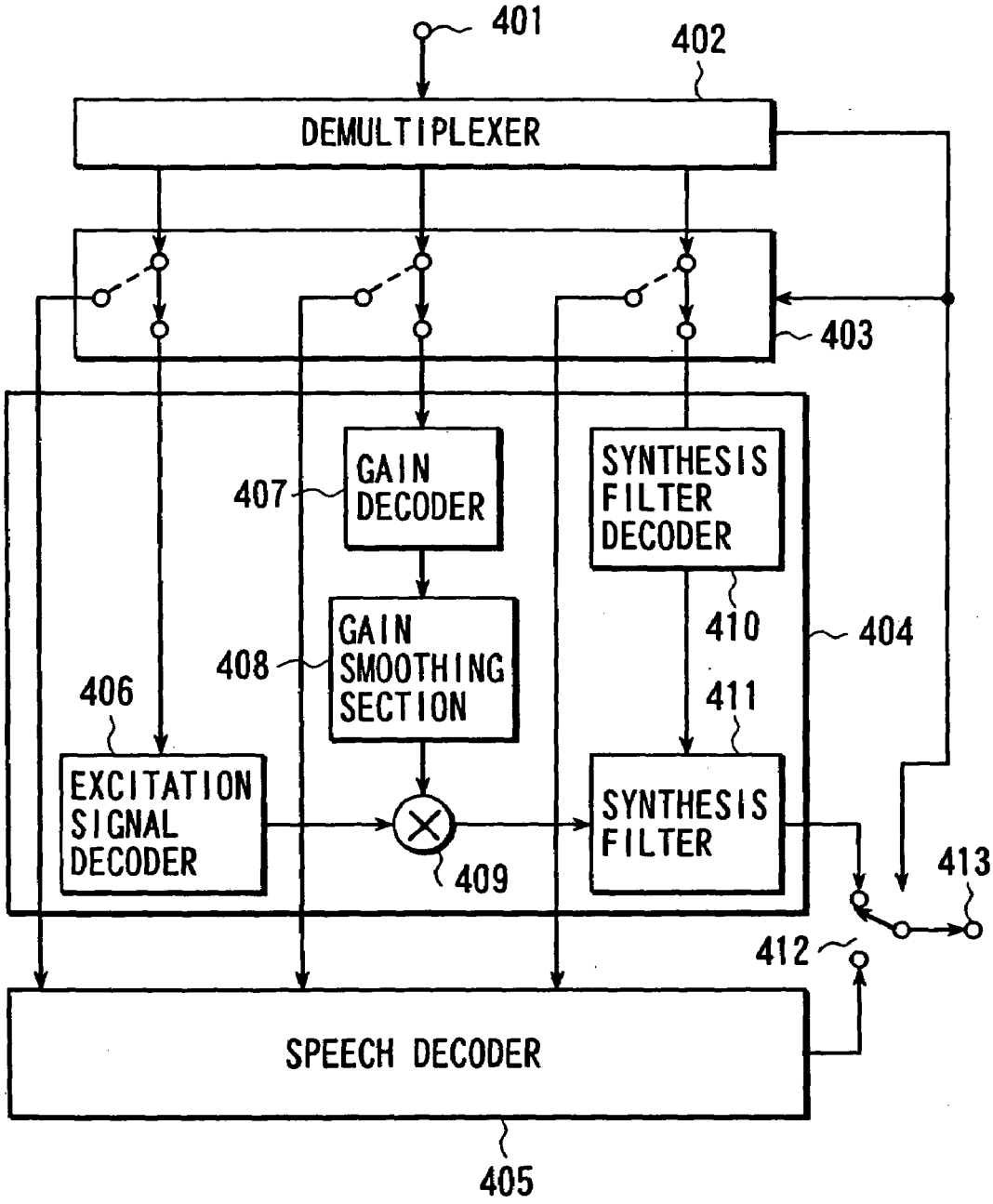
FIG. 17 is a block diagram showing a speech decoding apparatus to explain a background noise decoding method according to still another embodiment of the present invention.
Figure 18:
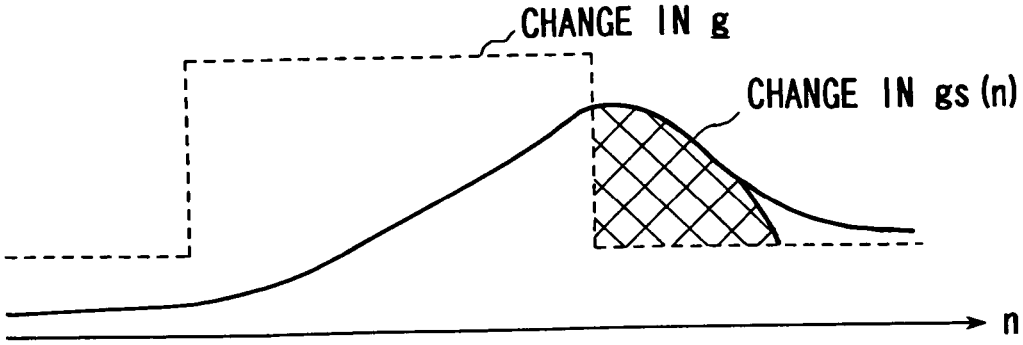
FIG. 18 is a graph for explaining the effect of the speech decoding apparatus according to the embodiment.

In the embodiment shown in FIG. 17, gain smoothing is always performed by using the fixed constant ξ. Referring to FIG. 18, the dashed line represents changes in the decoded gain g, and the solid line represents changes in gain gs(n) after smoothing. As is obvious from FIG. 18, the gain gs(n) after smoothing changes smoothly as compared with the decoded gain g. Even if, however, the decoded gain g decreases, it takes time for the gain gs(n) after smoothing to decrease. For this reason, the gain unnecessarily increases in some period (hatched portion), resulting in a deterioration in subjective quality.

In contrast to this, in this embodiment, a method of smoothing a gain is realized by the following procedure. When the decoded gain g increases, smoothing is performed to make the gain increase gradually. When the decoded gain g decreases, smoothing is performed to make the gain decrease quickly. This operation can be expressed by the following equations:

$$gs(n) = (1 - \xi\,\mathrm{UP}) \cdot g + \xi\,\mathrm{UP} \cdot gs(n-1)(g > gs(n-1) \tag{20}$$

$$gs(n) = (1 - \xi\,\mathrm{DOWN}) \cdot g + \xi\,\mathrm{DOWN} \cdot gs(n-1)(g \leqq gs(n-1)(0 \leqq \xi\,\mathrm{DOWN} \leqq \xi\,\mathrm{UP} \leqq 1) \tag{21}$$

Figure 19:
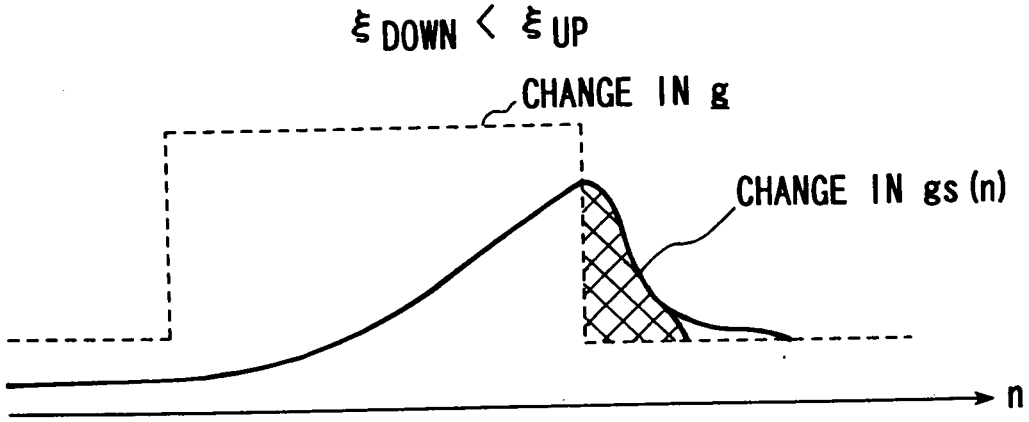
FIG. 19 is a graph for explaining the effect of smoothing in the embodiment.

The effect of smoothing in this embodiment will be described below with reference to FIG. 19.

In this embodiment, the decoded gain g and the gain gs(n−1) after smoothing are compared with each other, and the gain gs(n) after smoothing is determined so as to be influenced more by the smaller gain. As is obvious from FIG. 19, therefore, this embodiment can eliminate the phenomenon shown in FIG. 18, in which when the decoded gain g decreases, the gain gs(n) after smoothing is kept large (that is, the area of the hatched portion becomes smaller). By using this embodiment, the gain changes smoothly, and an unnecessary increase in gain can be prevented, thereby further improving the subjective quality. noise/speech classification method of the present invention, pieces of power and spectral information of an input signal are calculated as feature amounts. The calculated feature amounts are then compared with estimated feature amounts based on pieces of estimated power and estimated spectral information in a background noise period, thereby deciding whether the input signal belongs to speech or background noise. With this operation, a speech period can be accurately decided even if the power of background noise is large, and the power in the speech period is relatively small, because the spectrum in the background noise period clearly differs from that in the speech period.

In this case, an estimated feature amount may be updated by different methods depending on whether it is decided that an input signal belongs to background noise or speech. More specifically, the update amount to be set when it is decided that the input signal belongs to background noise is set to be smaller than that to be set when it is decided that the input signal belongs to speech. With this setting, even if the input signal has a long speech period, the estimated feature amount is hardly influenced by the feature amount in the speech period. Even if, therefore, an input signal which changes from a long speech period to a background noise period is input, background noise can be accurately decided.

In addition, since a spectral fluctuation amount is analyzed by comparing a threshold with the spectral distortion between a spectral envelope obtained from the spectral information of an input signal and a spectral envelope obtained from the estimated spectral information in a background noise period, accurate analysis can be performed, thereby realizing more accurate background noise/speech classification. A large threshold is set when the estimated power is small, and vice versa, thereby reducing decision errors due to a change in spectral fluctuation amount with a change in estimated power. More accurate background noise/speech classification can therefore be realized.

Furthermore, hangover processing is performed such that when a decision result indicating that an input signal belongs to speech or background noise changes from speech to background noise, the decision result is forcibly changed to "speech". When, for example, the estimated frame power in a background noise period is large, or the formant spectral power of a spectral envelope obtained from estimated spectral information is large, this hangover time is prolonged to prevent, using the pieces of estimated power and spectral information in the background noise period, an omission of the end of a sentence which occurs when the background noise power is large or the background noise spectrum is not that of white noise.

According to the voiced/unvoiced classification method of the present invention, voiced appearance probability tables and unvoiced appearance probability tables in which voiced and unvoiced appearance probabilities are written in correspondence with speech feature amounts are prepared, and voiced and unvoiced probabilities are obtained by referring to these tables using the calculated feature amounts of input speech as keys. These voiced and unvoiced probabilities are then used to decide whether the input speech belongs to a voiced one or unvoiced one. If, therefore, voiced/unvoiced decision on actual speech data is manually performed, and voiced appearance probability tables and unvoiced appearance probability tables are prepared on the basis of the decision results, the most likelihood speech quality can be determined by using these tables. The problem that the classification performance is influenced by empirically determined weighting values and thresholds as in the conventional methods can be solved, and stable, accurate voiced/unvoiced decision can be realized.

Moreover, according to the background noise decoding method of the present invention, an excitation signal for synthesizing background noise, a gain, and synthesis filter information are decoded, and the gain used to decode background noise information is smoothed, thereby improving the subjective quality of background noise produced by decoding. In addition, in smoothing the gain, when the decoded gain increases, the gain is gradually increased, whereas when the decoded gain decreases, the gain is decreased quickly. With this operation, an unnecessary increase in gain due to gain smoothing can be prevented, and the subjective quality can be improved more effectively.

A speech encoding method and apparatus which can be applied to the speech encoding apparatuses shown in FIGS. 15 and 16 will be described next.

Figure 20:
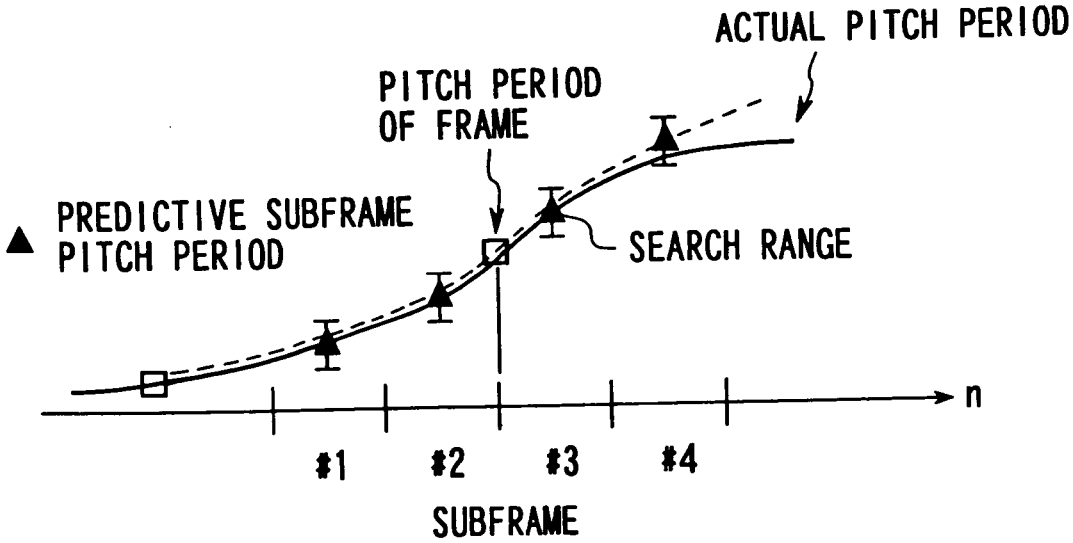
FIG. 20 is a graph for explaining the principle of an encoding method applied to a speech encoding apparatus according to the present invention.

According to this speech encoding method, as shown in FIG. 20, for example, interpolation is performed between the pitch period of the current frame and the pitch period of a previous frame to obtain predicted subframe pitch periods in units of subframes. A search range for subframe pitch periods is then determined near the obtained values. For this reason, actual pitch periods fall within the search range to allow an accurate search for a pitch period.

Figure 21:
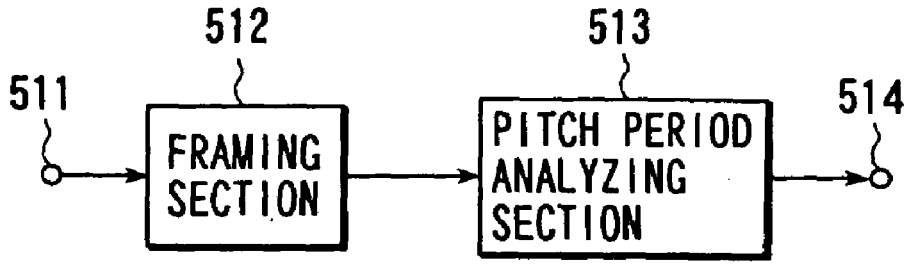
FIG. 21 is a block diagram for explaining the basic operation of pitch period analysis in the speech encoding method according to the present invention.

FIG. 21 is a block diagram for explaining a basic operation for pitch period analysis in this speech encoding method. Referring to FIG. 21, digital speech signals (to be referred to as input speech signals hereinafter) are sequentially input to an input terminal 511. Each input speech signal is divided into frames each having a predetermined length (framing) by a framing section 512. The speech signal framed by the framing section 512 is then subjected to pitch period analysis in a pitch period analyzing section 513. The resultant pitch period information is output from an output terminal 514.

The operation of the framing section 512 will be described next with reference to FIG. 22. For the sake of descriptive convenience, the operation of a subframing section in a framing/subframing section 522 (FIG. 23) in the embodiment to be described later will also be described.

Figure 22:
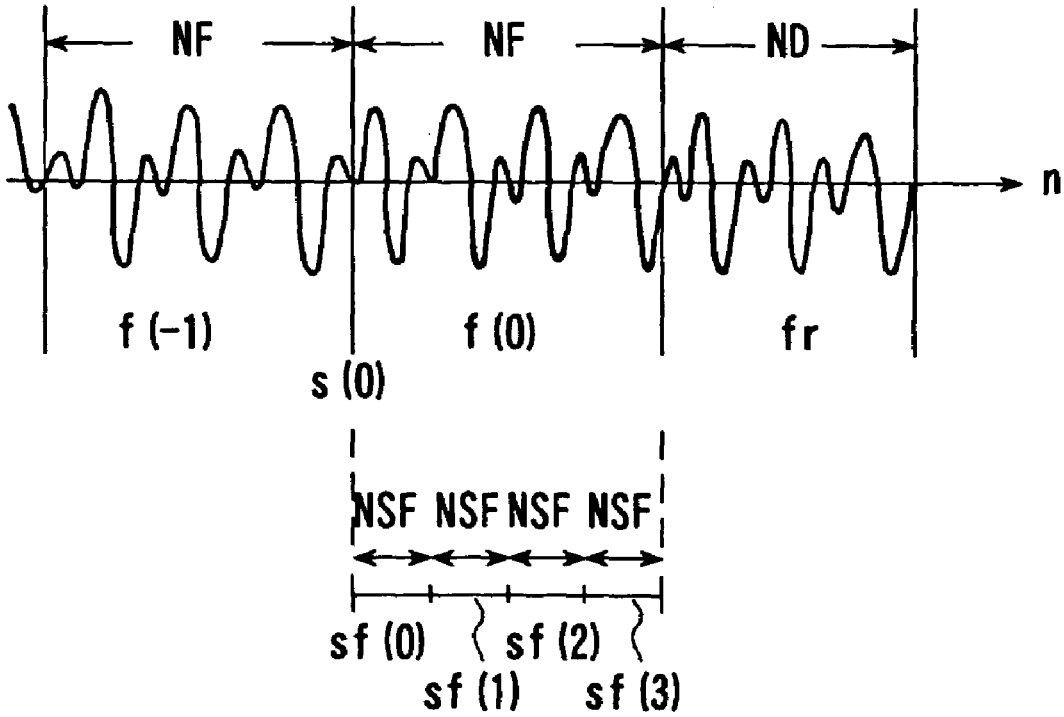
FIG. 22 is a timing chart showing frame and subframe structures.

FIG. 22 shows the frame format and subframe format of an input speech signal in this embodiment. Referring to FIG. 22, reference symbol f(m) is used to specify a frame. In this case, m=0 represents a frame to be encoded (current frame), and m≦−1 represents a previous frame having undergone encoding. In addition, reference symbol fr denotes a future frame (to be referred to as an advance reading portion) with respect to the current frame.

Letting s(n) be an input speech signal, and s(0) be a speech signal at the head of the current frame, the following relationship is established between s(n), f(m), and fr:

$$f(m) = \{s(n); n = m * NF \text{ to } (m+1) * NF - 1\} (m \leqq 0) \tag{22}$$

$$fr = \{s(n); n = NF \text{ to } NF + ND - 1\} \tag{23}$$

where NF is the frame length, and ND is the length of the advance reading portion. In this embodiment, NF=160 and ND=120.

Letting sf(k) be the subframes of the frame f(0), the following relationship is established between s(n) and sf(k):

$$sf(k) = \{s(n); n = k * NSF \text{ to } (k+1) * NSF - 1\} (0 \leqq k \leqq K - 1) \tag{24}$$

where NSF is the subframe length and K is the number of subframes. In this embodiment, NSF=40 and K=4. In addition, n is a variable representing a sample, m is a variable representing a frame, and k is a variable representing a subframe.

After frames and subframes are formed in this manner, pitch period analysis is performed by the pitch period analyzing section 513. The pitch period analyzing section 513 is characterized by performing pitch period analysis while placing the center of analysis on the advance reading portion fr. The center of analysis will be defined later.

An existing technique can be applied to pitch period analysis. For example, several pitch analysis methods are disclosed in "Digital Signal Processing of Speech" published by Corona. This embodiment uses the following pitch period analysis method.

First of all, the input speech signal s(n) is analyzed by an LPC analyzer (not shown) to obtain an LPC coefficient. A predictive filter for a transfer function A(z) represented by the following equation is formed by using this LPC coefficient:

$$A(z) = 1 - \sum_{i=1}^{IP} \alpha(i) Z^{-i} \tag{25}$$

where α(i) is the LPC coefficient and IP is the analysis order. In this embodiment, IP=10. The speech signal s(n) is filtered by the predictive filter for this transfer function A(z) to obtain a prediction error signal e(n) according to the following equation:

$$e(n) = s(n) - \sum_{i=1}^{IP} \alpha(i) * s(n-i) \tag{26}$$

The prediction error signal e(n) is processed by a Hamming window to obtain a window signal u(n). Correlation analysis of this window signal u(n) is performed to extract a pitch period by using a correlation value ρ(t) given by $$\rho(t) = \frac{\sum_{n=NC-NW/2}^{NC+NW/2-t} u(n) * u(n-t)}{\sqrt{\sum_{n=NC-NW/2}^{NC+NW/2} u(n) * u(n)} \sqrt{\sum_{n=NC-NW/2}^{NC+NW/2-t} u(n-t) * u(n-t)}} \tag{27}$$

where NW is the pitch period analysis length, and NC is the pitch period analysis position. In this embodiment, NW=160 and NC=200. In addition, the analysis range for the correlation value ρ(t) is set to {20≦t≦147}.

A value t corresponding to the maximum correlation value ρ(t) is output as information of a pitch period T of the frame from the output terminal 514. For example, this information of the pitch period T is encoded and When a symmetrical window such as a hamming window or a rectangular window is used as a window function, the pitch analysis position can be regarded as the center of the window function. When asymmetrical window whose right and left parts differ in shape is used, the analysis position cannot be regarded as the center of the window, unlike a symmetrical window. In this embodiment, the position where the amplitude value of the window function is maximized is regarded as the center.

As described, in this embodiment, the pitch period of a future frame with respect to the current frame is obtained, and the predicted pitch period of a subframe in the current frame is obtained by interpolation using the pitch period of the future frame, together with the pitch periods of the current and/or previous frames. Since the pitch period of a subframe in the current frame is obtained by using this predicted pitch period, even if the pitch period varies within a frame, the pitch period of a subframe can be accurately obtained in a small calculation amount, and can be expressed with a small information amount.

Figure 23:
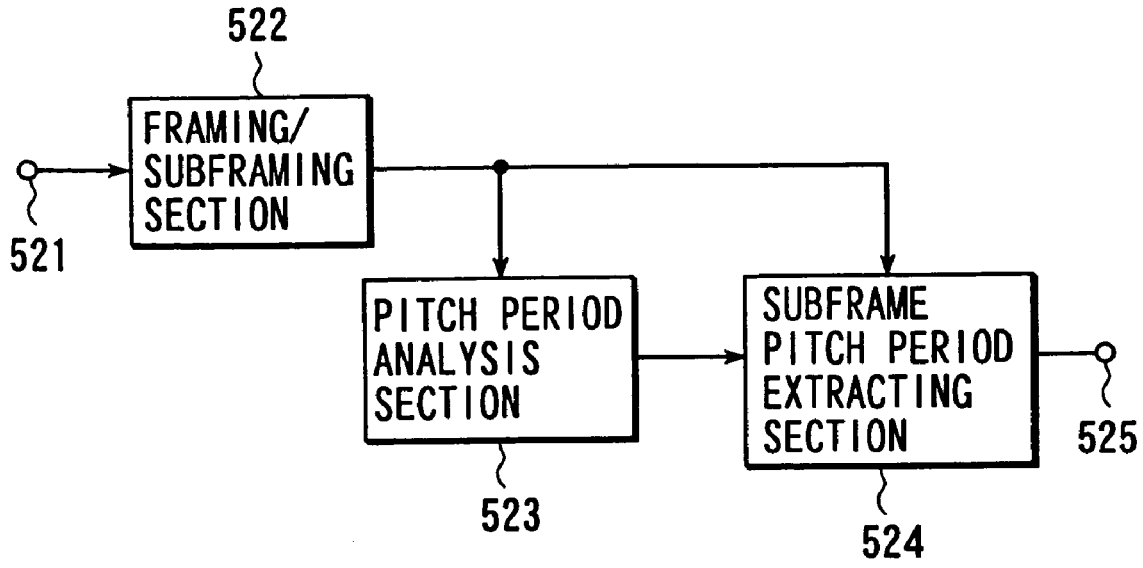
FIG. 23 is a block diagram for explaining a speech encoding method according to still another embodiment of the present invention.

FIG. 23 is a block diagram for explaining a basic operation for subframe pitch extraction in a speech encoding method according to still another embodiment of the present invention. Referring to FIG. 23, a digital input speech signal to an input terminal 521 is divided into frames by a framing/subframing section 522. Each frame is further divided into subframes. The speech signals framed and subframed by the framing/subframing section 522 are input to a pitch period analysis section 523 and a subframe pitch period extracting section 524. The pitch period analysis section 523 analyzes the pitch period T. The resultant information of the pitch period T is input to the subframe pitch period extracting section 524.

The subframe pitch period extracting section 524 obtains a pitch period ST(k) of each subframe on the basis of the pitch period T obtained by the pitch period analysis section 523. The information of this subframe pitch period ST(k) is output from an output terminal 525.

Figure 24:
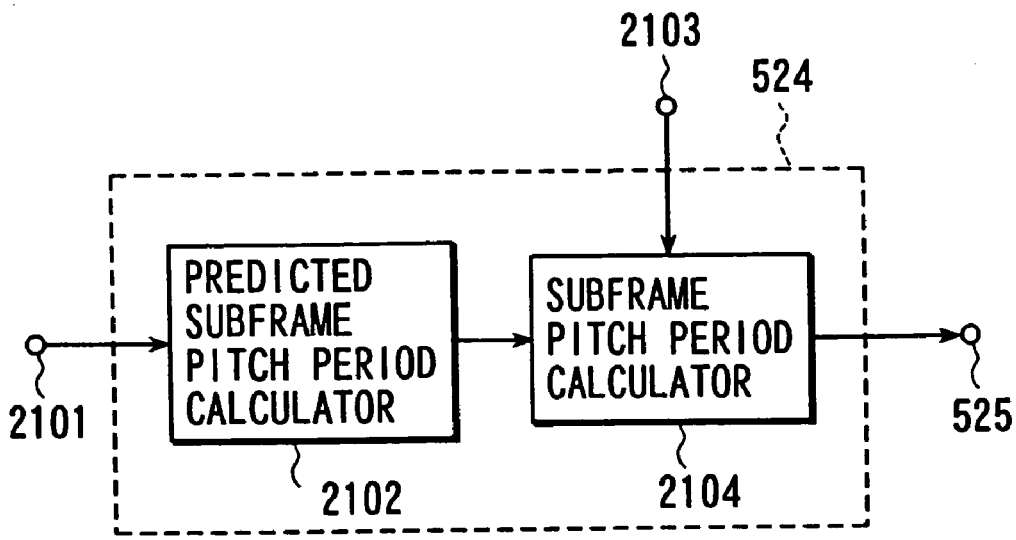
FIG. 24 is a block diagram showing a subframe pitch extraction section in the embodiment shown in FIG. 23.

The subframe pitch period extracting section 524 as a characteristic feature of this embodiment will be described next with reference to FIG. 24. FIG. 24 is a block diagram showing the arrangement of the subframe pitch period extracting section 524. A predicted subframe pitch period calculator 2102 calculates the predicted subframe pitch period of each subframe by using the information of the pitch period T which is input from the pitch period analysis section 523 in FIG. 23 to an input terminal 2101. A subframe pitch period calculator 2104 calculates the subframe pitch period ST(k) of each subframe by using the speech signal input from the framing/subframing section 522 in FIG. 23 to an input terminal 2103 on the basis of the predicted subframe pitch period obtained by the predicted subframe pitch period calculator 2102. The information of this subframe pitch period ST(k) is output to an output terminal 525.

Figure 25:
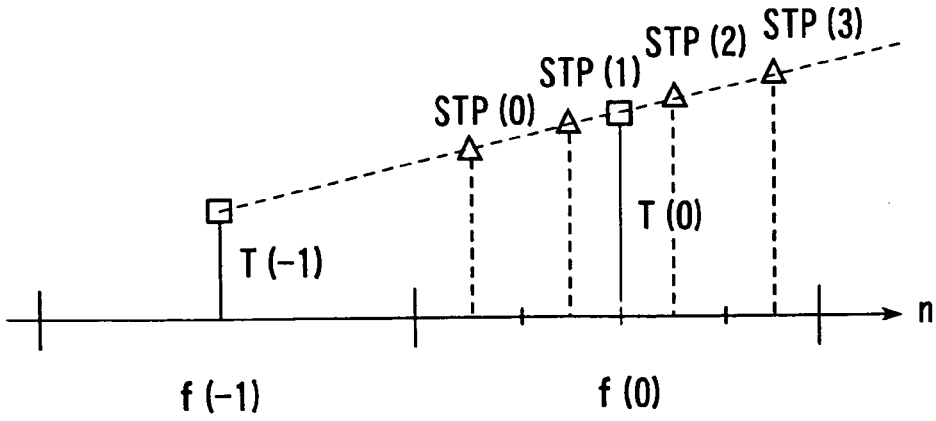
FIG. 25 is a graph for explaining a method of calculating a subframe pitch period in the embodiment shown in FIG. 23.

The method of calculating a subframe pitch period will be described in more detail with reference to FIG. 25. Let T(0) be the pitch period obtained in a current frame f(0) by the pitch period analysis section 523, and T(−1) be the pitch period obtained in a previous frame f(−1). The subframe pitch period extracting section 524 obtains a predicted subframe pitch period STP(k) of each subframe by using these two pitch periods. This embodiment uses a method of obtaining the predicted subframe pitch period STP(k) from T(−1) and T(0) by interpolation. According to the characteristics of a speech signal, it can be presumed that the real subframe pitch period is near the predicted subframe pitch period STP(k). This is because, the pitch period of a speech signal varies little with time.

Figure 26:
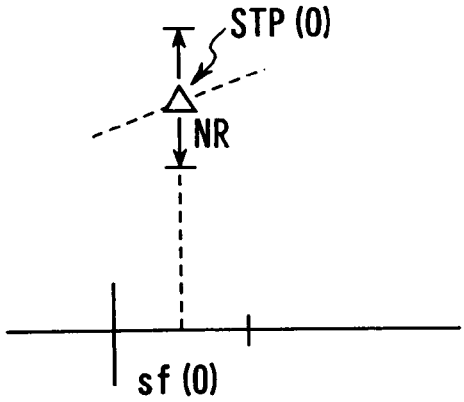
FIG. 26 is a graph for explaining the method of calculating a subframe pitch-period.

A method of obtaining the subframe pitch period ST(k) by using the predicted subframe pitch period STP(k) will be described next. Since it can be presumed that the real subframe pitch period is near the predicted subframe pitch period STP(k), only a range near the predicted subframe pitch period STP(k) can be regarded as a range for pitch period extraction. FIG. 26 shows a correlation value calculation range NR for extracting a subframe pitch period ST(0) and a predicted subframe pitch period STP(0) in the 0th subframe sf(0).

As described above, in this embodiment, the range of ±NR/2 centered on the predicted subframe pitch period STP(0) is regarded as the correlation value calculation range for obtaining the subframe pitch period ST(k). More specifically, the correlation value ρ(t) defined by equation (27) is calculated with respect to only a period included in the range of $STP(0)-NR/2 \leqq t \leqq STP(0)+NR/2-1$. The information of a relative pitch period ΔT(0) corresponding to STP(0) when this correlation value is maximized is output from the output terminal 525. The subframe pitch period ST(0) of the subframe sf(0) can therefore be obtained as a sum STP(0)+ΔT(0) of the predicted subframe pitch period STP(0) and the relative pitch period ΔT(0). Similarly, a relative pitch period ΔT(k) of another subframe sf(k) is obtained, and the resultant information is output from the output terminal 525. In this embodiment, NR=8.

According to this embodiment, the following effects can be obtained.

First of all, since the range NR can be set as the correlation value calculation range for obtaining a subframe pitch period, the calculation amount can be greatly reduced. Assume that subframe pitch periods are to be obtained in unit of subframes by using equation (27). In this case, if calculations are to be performed for all pitch period candidates (128 candidates), multiplication/addition must be performed 40,000 times. In contrast to this, according to this embodiment, when the correlation value calculation range is set to NR=8, it suffices if multiplication/addition is performed only 4,000 times. That is, the calculation amount can be reduced by about 90%. Note, however, that this result is obtained by performed calculations under the condition of pitch period analysis length NW=160.

When calculations are to be performed for the entire range of 128 candidates in units of subframes, the information amount required to represent a subframe pitch period is 7 bits*4=28 bits per frame, provided that one frame is constituted by four subframes. In contrast to this, in this embodiment, since the frame pitch period T(0) can be expressed by seven bits, and the relative pitch period ΔT(k) can be expressed by three bits, the information amount required to express a subframe pitch period is 7 bits+3 bits*4=19 bits. That is, the number of bits required can be reduced by about 35%. Note that since the pitch period T(−1) of the previous frame can be replaced with the pitch period T(0) in processing of the previous frame, this pitch period need not be expressed by bits.

A procedure for calculating a subframe pitch period in this embodiment will be described next with reference to the flow chart of FIG. 27.

First of all, in step S11, framing and subframing of an input speech signal are performed. In step S12, the pitch period T(0) is calculated while the analysis center is placed in the current frame. In step S13, the predicted subframe pitch period STP(k) of each subframe is obtained by using the pitch period T(0) of the current frame and the pitch period T(−1) of the previous frame. In step S14, a counter k is set to 0. In step S15, the relative pitch period ΔT(k) of the subframe sf(k) is calculated. In step S16, the counter k is incremented by one. In step S17, it is checked whether the counter k coincides with K (K is the number of subframes). If the counter k does not coincide with K, the flow returns to step S15 to continue the processing. If the counter k coincide with K, the processing is terminated.

Still another embodiment of the present invention will be described with reference to FIG. 28. This embodiment differs from the above embodiment in that a predicted subframe pitch period STP(k) is obtained by using a pitch period Tr of an advance reading portion fr.

When the center of a subframe is located between the analysis position of a pitch period T(−1) of a frame f(−1) and the analysis position of a pitch period T(0) of a current frame f(0), the predicted subframe pitch period STP(k) of the subframe is obtained by using T(−1) and T(0). Similarly, when the center of a subframe is located between the analysis position of the pitch period T(0) of the current frame f(0) and the analysis position of the pitch period Tr of the advance reading portion Tr, the predicted subframe pitch period STP(k) of the subframe is obtained by using T(0) and Tr In this embodiment, the predicted subframe pitch period STP(k) is calculated by using linear interpolation.

After the predicted subframe pitch period STP(k) is obtained in this manner, relative pitch periods ΔT(0) are obtained in units of subframes in the same manner as in the embodiment shown in FIG. 23.

In this embodiment, since the pitch period T(0) of the current frame can be replaced with the pitch period Tr of the advance reading portion fr obtained in previous frame, only the pitch period Tr of the advance reading portion fr and the relative pitch period ΔT(k) of each subframe are required as information representing the subframe pitch period ST(k).

A procedure for processing in this embodiment will be described next with reference to FIG. 29.

Figure 27:
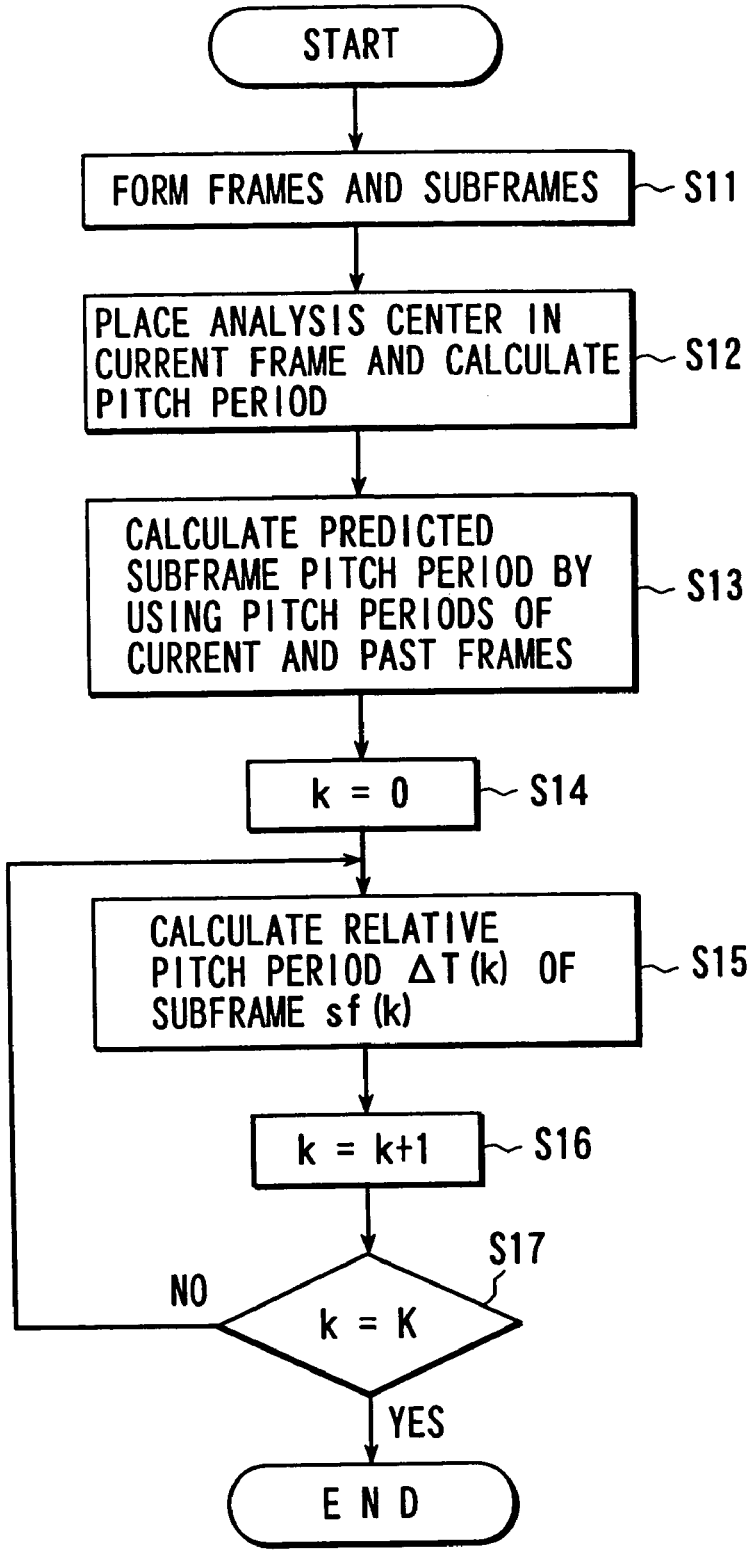
FIG. 27 is a flow chart for explaining a procedure for calculating a subframe pitch period in the embodiment shown in FIG. 23.
Figure 29:
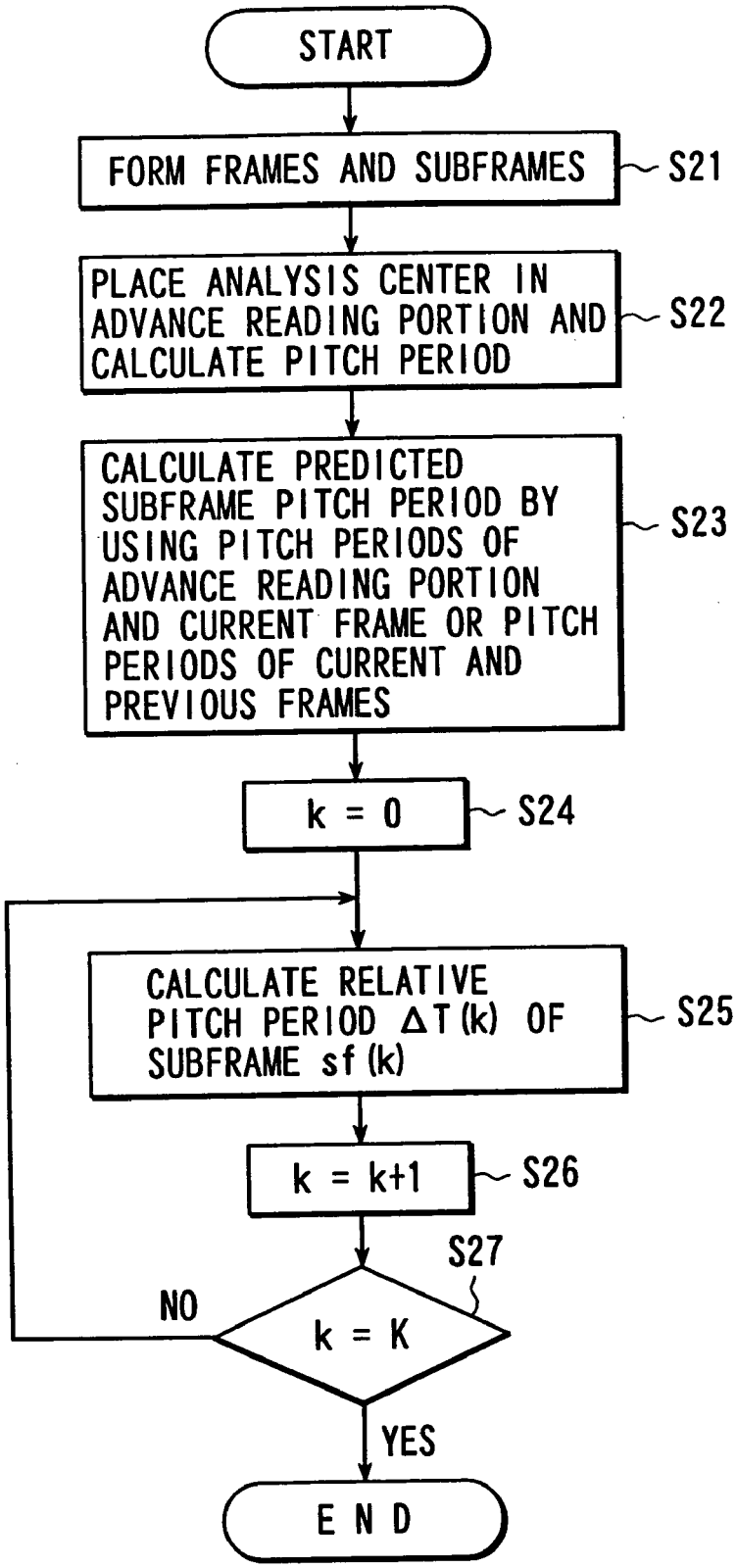
FIG. 29 is a flow chart for explaining a procedure for calculating a subframe pitch period in the embodiment shown in FIG. 28.

Since the processing in steps S21, S24, S25, S26, and S27 in FIG. 29 is the same as that in steps S11, S14, S15, S16, and S17 in FIG. 27, a description thereof will be omitted. The procedure in FIG. 29 is characterized in that the pitch period Tr is calculated while the analysis center is placed at the advance reading portion fr in step S22, and the predicted subframe pitch period STP(k) is obtained by using the pitch period Tr of the advance reading portion fr and the pitch period T(0) of the current frame f(0) or by using the pitch period T(0) of the current frame and the pitch period T(−1) of the previous frame f(−1) in step S23.

In this embodiment, since each predicted subframe pitch period STP(k) is expressed as an interpolated value between the pitch period T(−1) of the previous frame f(−1) and the pitch period T(0) of the current frame f(0) or between the pitch period T(0) and the pitch period Tr of the advance reading portion fr, a more accurate predictive value can be obtained.

Figure 30:
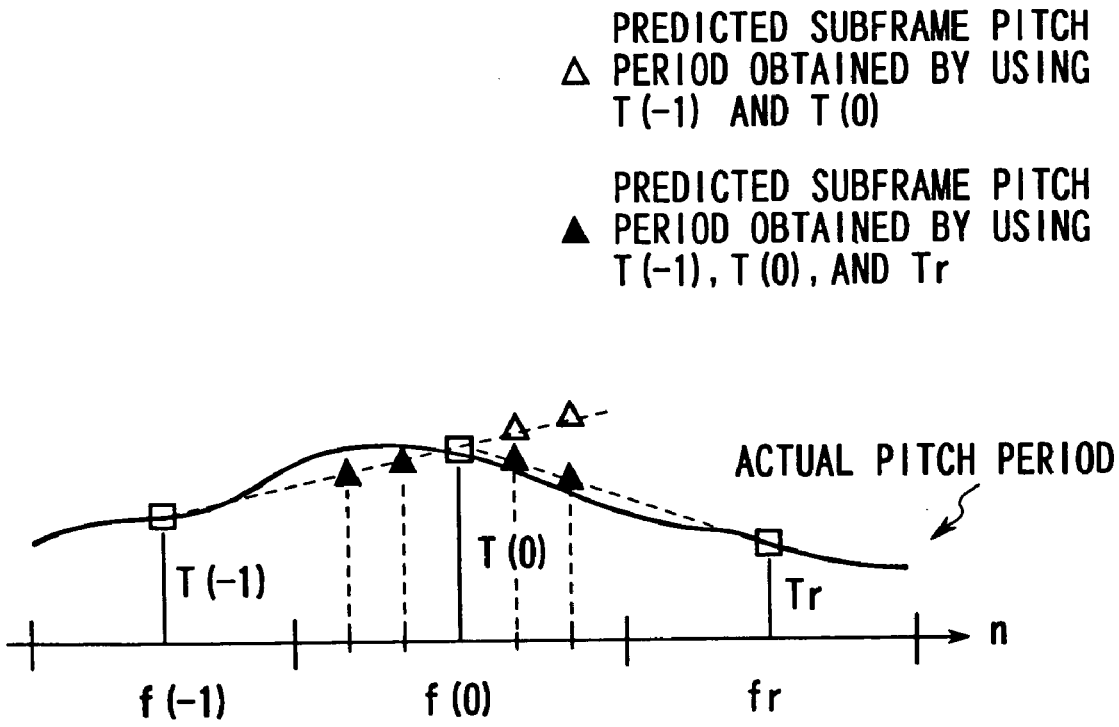
FIG. 30 is a graph for explaining the effect of the embodiment shown in FIG. 28.

Assume that the actual pitch period varies as shown in FIG. 30. In this case, according to the method of obtaining the predicted subframe pitch period STP(k) on the basis of the pitch period T(−1) of the previous frame and the pitch period T(0) of the current frame as in the embodiment shown in FIG. 23, the reliability of the predicted subframe pitch period STP(k) may decrease. In contrast to this, in this embodiment, since the pitch period Tr of the advance reading portion fr accurately represents an actual pitch period, the interpolated value can accurately express an actual pitch period.

Figure 31:
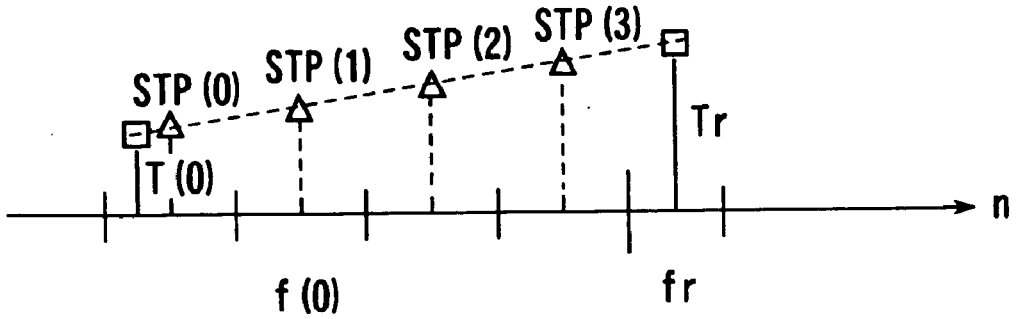
FIG. 31 is a graph for explaining a method of calculating a subframe pitch period according to still another embodiment.

Still another embodiment of the present invention will be described with reference to FIG. 31. This embodiment differs from the embodiment shown in FIG. 28 in that a predicted subframe pitch period STP(k) is obtained by using a pitch period Tr of an advance reading portion fr and a pitch period T(0) of a current frame f(0).

Figure 32:
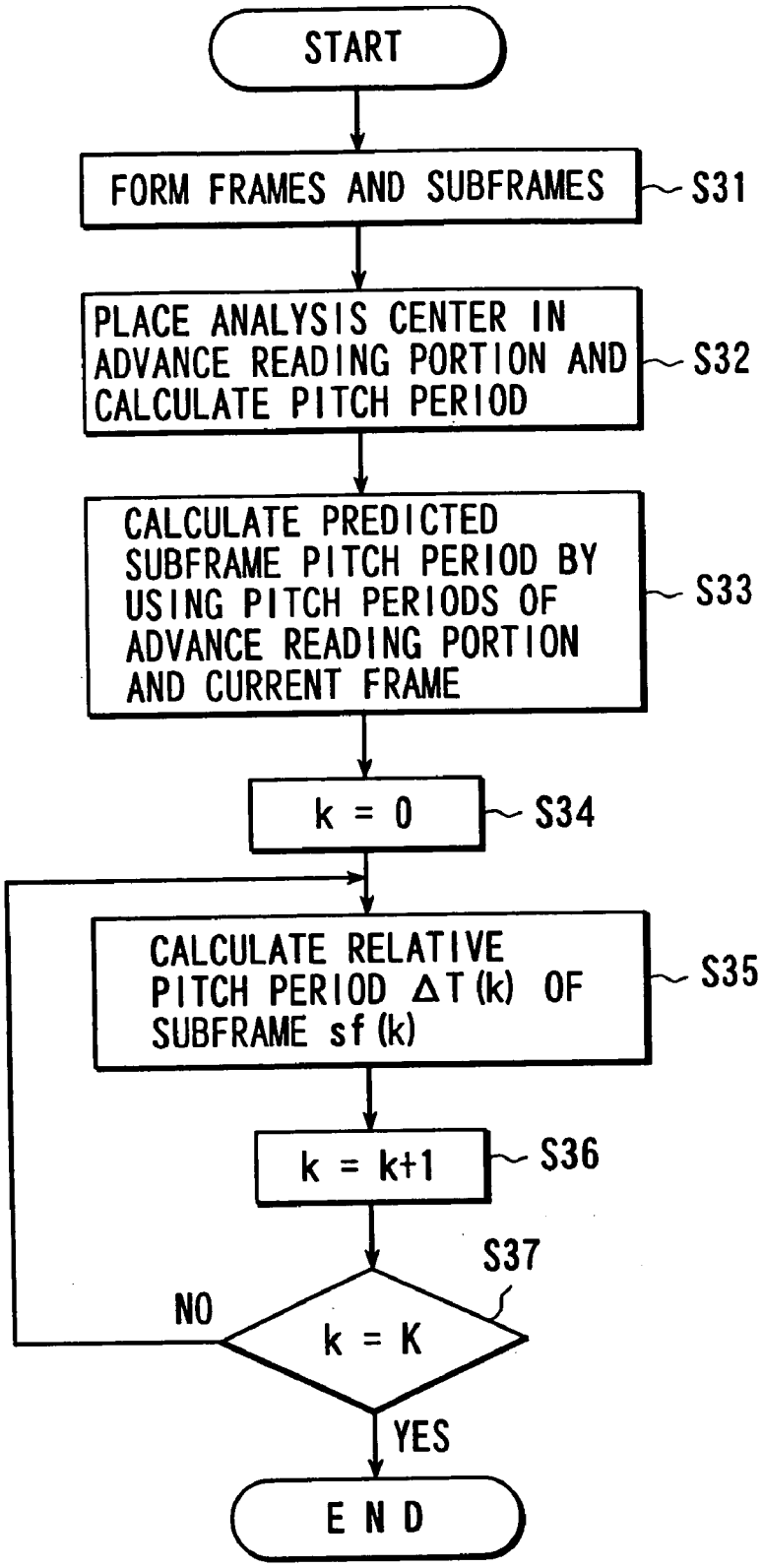
FIG. 32 is a flow chart for explaining a procedure for calculating a subframe pitch period in the embodiment shown in FIG. 31.

A procedure for processing in this embodiment will be described with reference to the flow chart of FIG. 32. Since the processing in steps S31 and S34 to S37 in FIG. 32 is the same as that in steps S11 and S14 to S17 in FIG. 27, a description thereof will be omitted.

In step S32, the pitch period Tr is calculated while the analysis center is placed at the advance reading portion fr. In step S33, the predicted subframe pitch period STP(k) is calculated by using the pitch period Tr of the advance reading portion fr and the pitch period T(0) of the current frame f(0).

Figure 28:
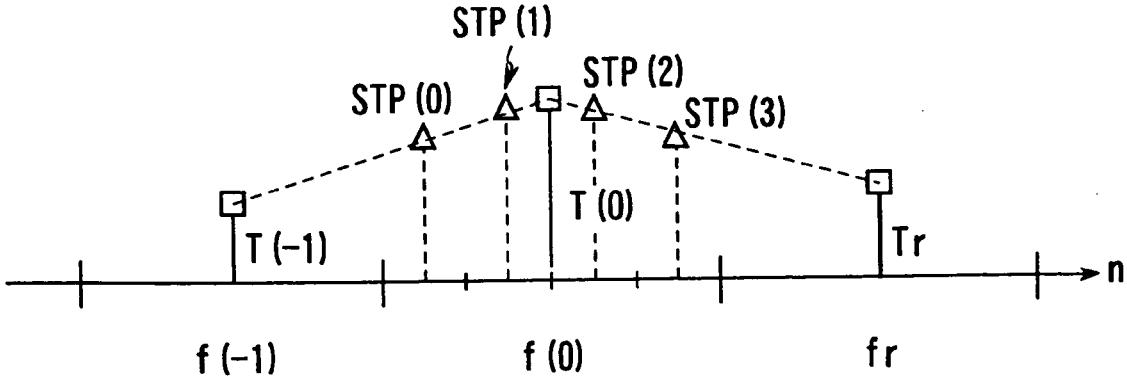
FIG. 28 is a graph for explaining a method of calculating a subframe pitch period in still another embodiment of the present invention.

In this embodiment, since the predicted subframe pitch period STP(k) can be obtained from the pitch period Tr of the advance reading portion fr and the pitch period T(0) of the current frame f(0) by interpolation, the length of the advance reading portion fr can be set be smaller than that in the embodiment shown in FIG. 28, thereby decreasing delays.

Still another embodiment of the present invention will be described with reference to FIG. 33. This embodiment differs from the embodiment shown in FIG. 31 in that a predicted subframe pitch period STP(k) is obtained by using a pitch period Tr of the advance reading portion fr and a pitch period T(−1) of a previous frame f(−1).

The following effect can be obtained in this embodiment.

Accurate analysis of a pitch period is generally difficult, and no established analysis method is currently available. The method based on correlation analysis represented by equation (27) is used in this embodiment. However, a correct pitch period cannot always be obtained by this method. For example, a pitch period one-nth (n is an integer) times or n times the actual pitch period is obtained in some case.

Figure 33:
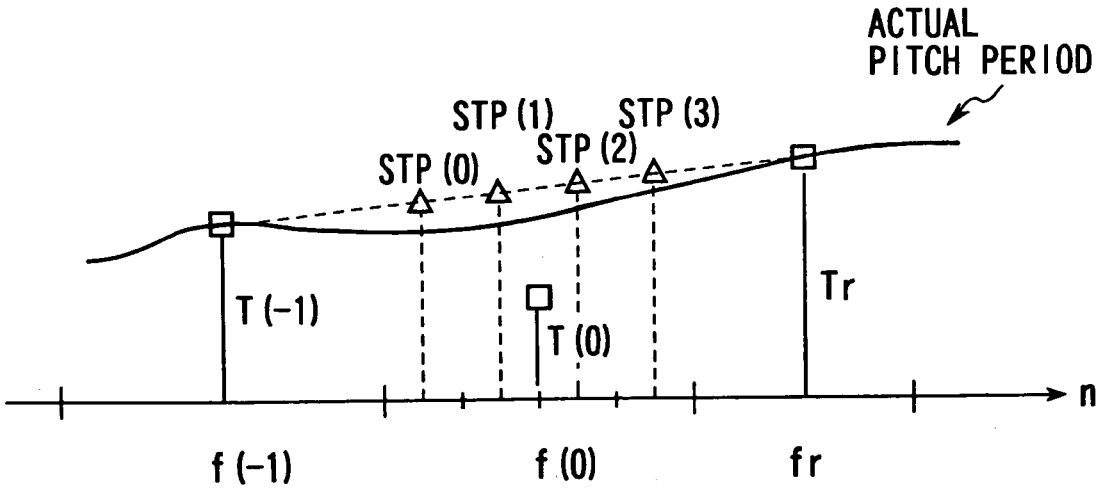
FIG. 33 is a graph for explaining a method of calculating a subframe pitch period in still another embodiment of the present invention.

Assume that analysis of the pitch period T(0) of the current frame f(0) has failed, the obtained pitch period greatly deviates from the actual pitch period, as shown in FIG. 33. In this case, if the predicted subframe pitch period STP(k) is obtained by performing interpolation between the pitch period Tr of the advance reading portion fr and the pitch period T(−1) of the previous frame f(−1), a pitch period can be efficiently expressed as in the case in which the pitch period T(0) of the current frame f(0) is accurately obtained.

Figure 34:
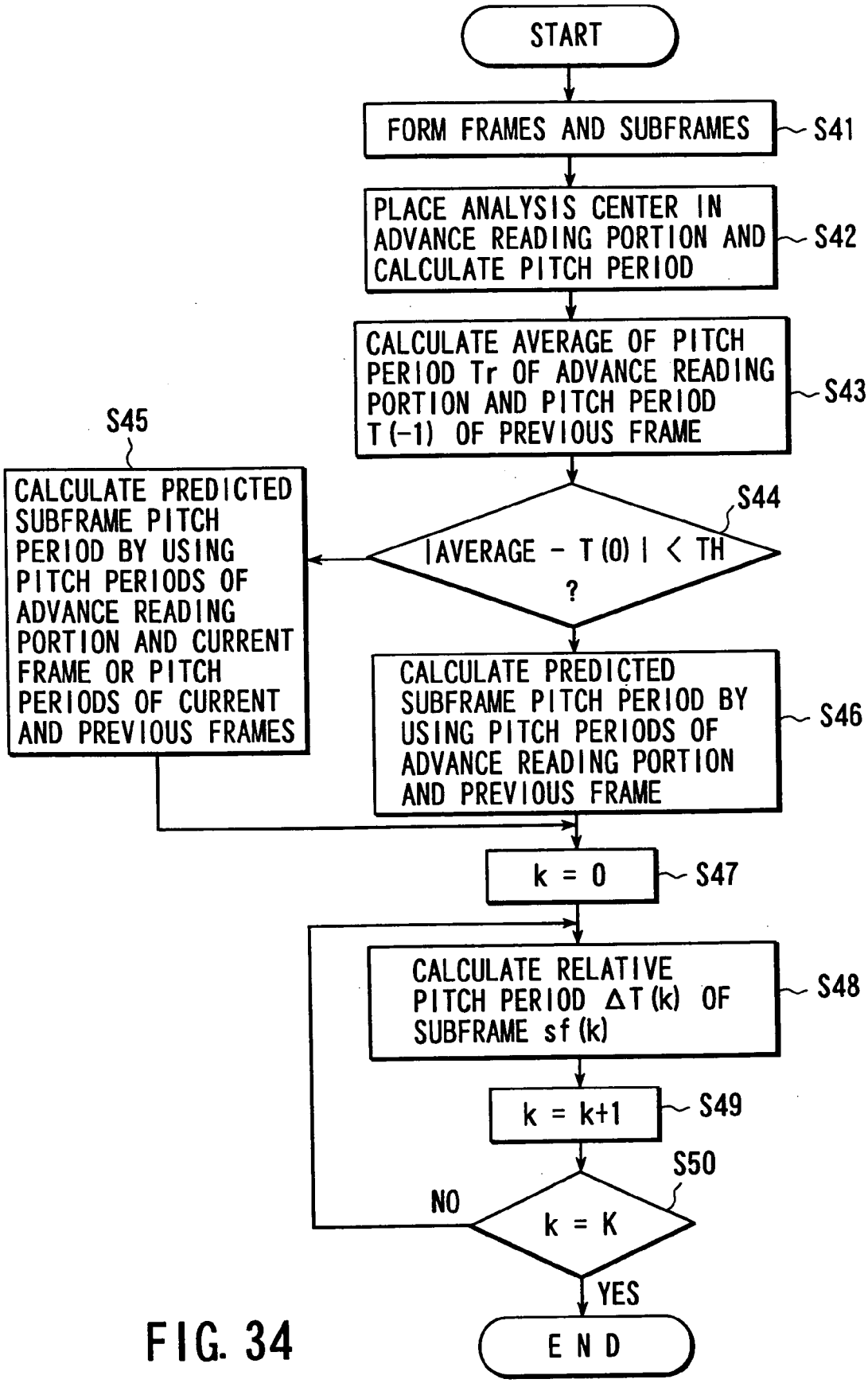
FIG. 34 is a flow chart for explaining a procedure for calculating a subframe pitch period in the embodiment shown in FIG. 33.

A procedure for the processing in this embodiment will be described with reference to the flow chart of FIG. 34. Since the processing in steps S41, S42, S45, S47, S48, S49, and S50 in FIG. 34 is the same as that in steps S21, S22, S23, S24, S25, S26, and S27 in FIG. 29, a description thereof will be omitted. The processing in steps S43, S44, and S46 is a characteristic feature of this embodiment, and hence will be described below.

In step S43, the average of the pitch period Tr obtained in the advance reading portion and the pitch period T(−1) of the previous frame is calculated. In step S44, the average is compared with the pitch period T(0) of the current frame according to the following equation:

$$\left|\frac{T_r + T(-1)}{2} - T(0)\right| < TH \tag{28}$$

If equation (28) is satisfied, the pitch period T(0) of the current frame f(0) is regarded as a reliable value, and is used to calculate the predicted subframe pitch period STP(k) in step S45. In contrast predicted subframe pitch period STP(k) is calculated by using only the pitch period Tr of the advance reading portion fr and the pitch period T(−1) of the previous frame f(−1) in step S46.

Figure 35:
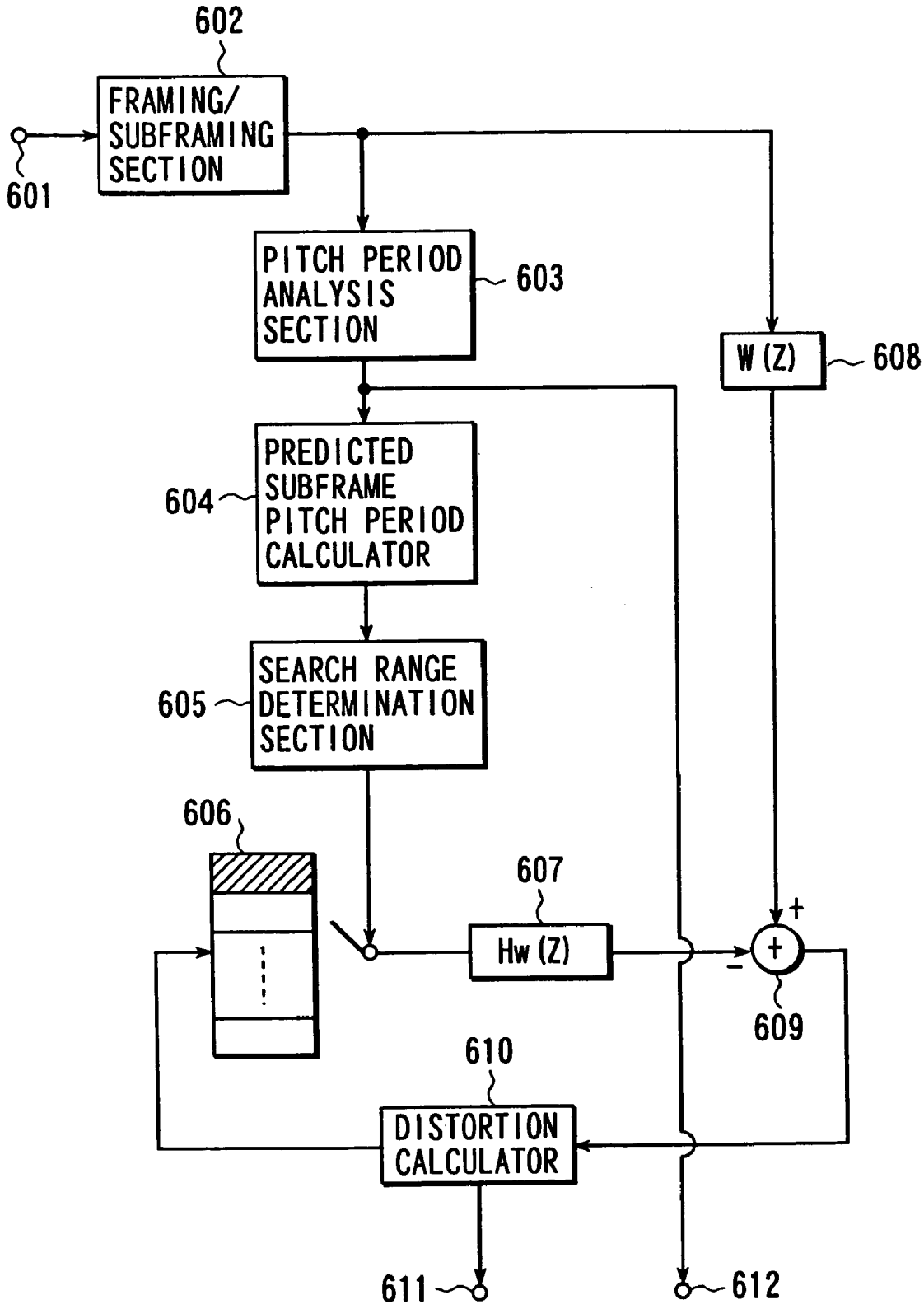
FIG. 35 is block diagram for explaining a speech encoding method according to still another embodiment of the present invention.

Still another embodiment of the present invention will be described below with reference to FIG. 35. Since an input terminal.601, a framing/subframing section 602, and a pitch period analysis section 603 in FIG. 35 are identical to the elements denoted by reference numerals 511 to 513 in FIG. 21, a description thereof will be omitted.

This embodiment is characterized in that the present invention is applied to a speech encoding method using an adaptive codebook. The adaptive codebook is a codebook in which a plurality of adaptive vectors generated by repeating a past excitation signal series at a period included in a predetermined range are stored.

A predicted subframe pitch period calculator 604 calculates the predicted subframe pitch period STP(k) of each subframe on the basis of the pitch period obtained by the pitch period analysis section 603. As a method of calculating the predicted subframe pitch period STP(k), any one of the methods described with reference to FIGS. 25, 28, 31, and 32 can be used. In this case, the same effect as described above is obtained. According to the method described with reference to FIG. 25, the center of pitch period analysis in the pitch period analysis section 603 is located on the current frame f(0). According to the methods described with reference to FIGS. 28, 31, and 32, however, the center of the pitch period analysis is located on the advance reading portion fr. This embodiment is based on the method described with reference to FIG. 25.

The predicted subframe pitch period calculator 604 obtains the predicted subframe pitch period STP(k) from a pitch period T(0) obtained by the pitch period analysis section 603 and a pitch period T(−1) of a frame f(−1) by interpolation.

A search range determination section 605 determines a search range for obtaining a subframe pitch period ST(0), i.e., an adaptive vector search range corresponding to an adaptive codebook 606. More specifically, a range of ±NR/2 centered on a predicted subframe pitch period STP(0) is set as a search range. That is, a search is performed for only periods included in the range defined by STP(0)−NR/2≦t≦STP(0)+NR/2−1. A search is performed by the following method.

An adaptive vector q(t,n) corresponding to a pitch period t included in the search range determined by the search range determination section 605 is extracted from the adaptive codebook 606. This vector is filtered by a perceptual weighting synthesis filter 607 to generate a synthesized signal p(t,n). The adaptive vector q(t,n) by which an error between this synthesized signal p(t,n) and a target signal r(n) obtained by filtering an input speech signal through a perceptual weighting filter 608 becomes minimum is searched. This equals to searching for the adaptive vector q(t,n) that the result of the equation (29) becomes maximum.

$$cntb(t) = \frac{\left(\sum_{n=0}^{NSF-1} r(n)p(t,n)\right)^2}{\sum_{n=0}^{NSF-1} p(t,n)^2} \quad (29$$

Of all the candidates of the pitch period t included in the search range, the pitch period t corresponding to the maximum contribution degree cntb(t) is set as a subframe pitch period ST(0), and a value obtained by subtracting a predicted subframe pitch period STP(0) from the subframe pitch period ST(0) is set as a relative pitch period ΔT(0). Processing of obtaining this relative pitch period ΔT(0) is performed for all subframes sf(k) to obtain relative pitch periods ΔT(k) of all the subframes.

Finally, the information of the pitch period T(0) obtained by the pitch period analysis section 603 is output from an output terminal 612. The information of the relative pitch period ΔT(k) corresponding to the maximum contribution degree cntb(t), obtained by the distortion calculator 610, is output from an output terminal 611.

Figure 36:
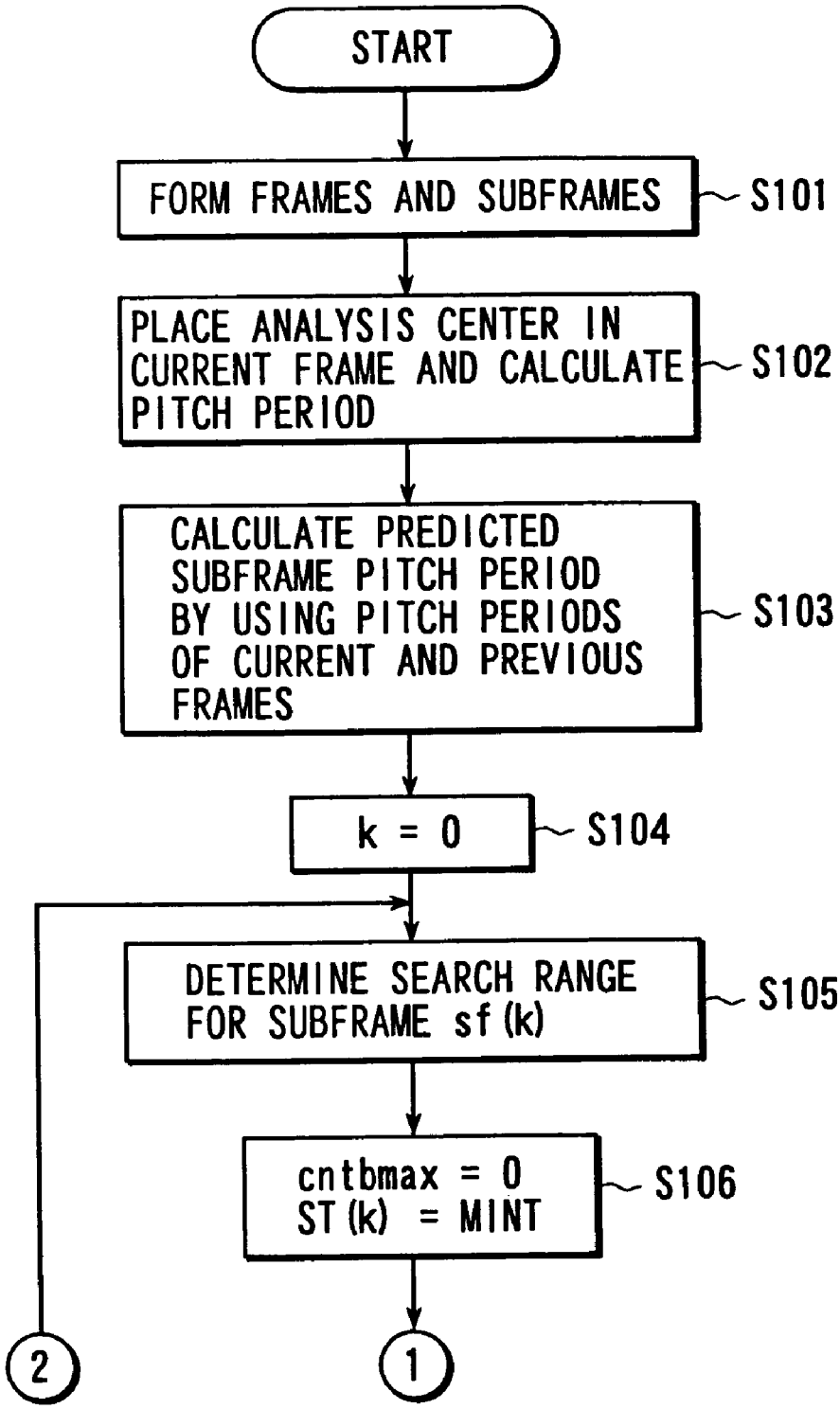
FIG. 36 is a part of a flow chart for explaining a procedure for calculating a subframe pitch period in the embodiment shown in FIG. 35.
Figure 37:
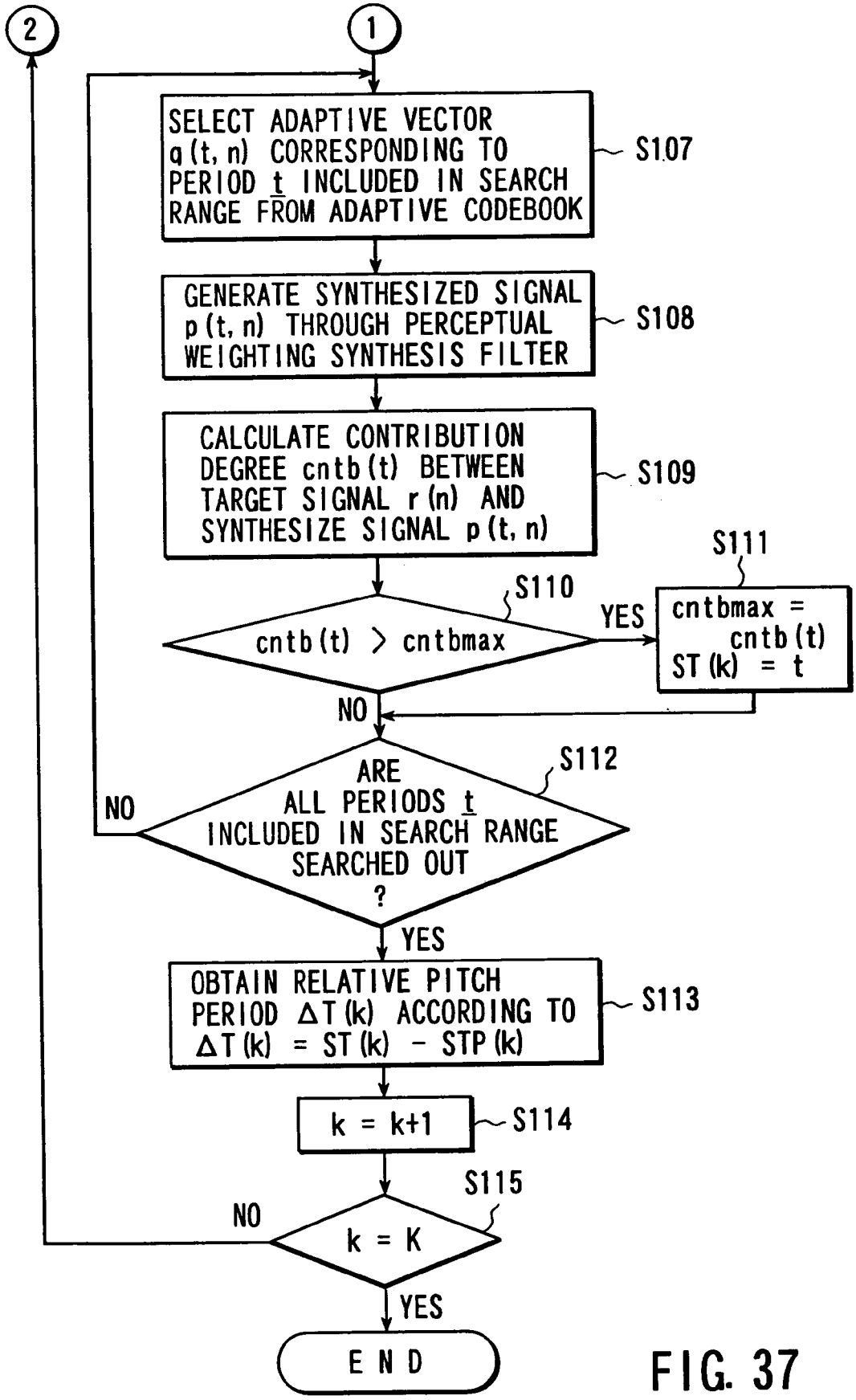
FIG. 37 is the remaining part of the flow chart for explaining the procedure for calculating a subframe pitch period in the embodiment shown in FIG. 35.

A procedure for the processing in this embodiment will be described next with reference to the flow charts of FIGS. 36 and 37. Since the processing in steps S101, S102, S103, S104, S114, and S115 in FIGS. 36 and 37 is the same as that in steps S11, S12, S13, S14, S16, and S17 in FIG. 27, a description thereof will be omitted. Processing unique to this embodiment will be described below.

In step S105, a search range for the subframes sf(k) is determined. As described above, the search range is determined by using the predicted subframe pitch period STP(k). In step S106, a variable cntbmax and the initial value of the subframe pitch period ST(k) are provided. A value 0 (zero) is provided as the variable cntbmax, and a minimum pitch period is provided as the subframe pitch period ST(k). In step S107, the adaptive vector q(t,n) corresponding to the period t included in the search range is selected from the adaptive codebook. In step S108, the adaptive vector q(t,n) is filtered by the perceptual weighting synthesis filter to generate the synthesized signal p(t,n). In step S109, the contribution degree cntb(n) between the target signal r(n) obtained in advance and the synthesized signal p(t,n). In step S110, the contribution degree cntb(t) in the pitch period t is compared with a variable cntbmax.

If cntb(t)>cntbmax, the variable cntbmax is set to the contribution degree cntb(t), and ST(k) is set to t in step S111. The flow then advances to step S112. If cntb(t)>cntbmax is not satisfied, the flow advances to step S112.

In step S112, it is checked whether all the candidates of the pitch period t included in the search range are searched out. If YES in step S112, the flow advances to step S113. If NO in step S112, the flow returns to step S107 to continue the processing by using the pitch period t which is not searched out. In step S113, the relative pitch period ΔT(k) of the subframe sf(k) is calculated by using the subframe pitch period ST(k) and the predicted subframe pitch period STP(k). The flow then advances to step S114.

Figure 38:
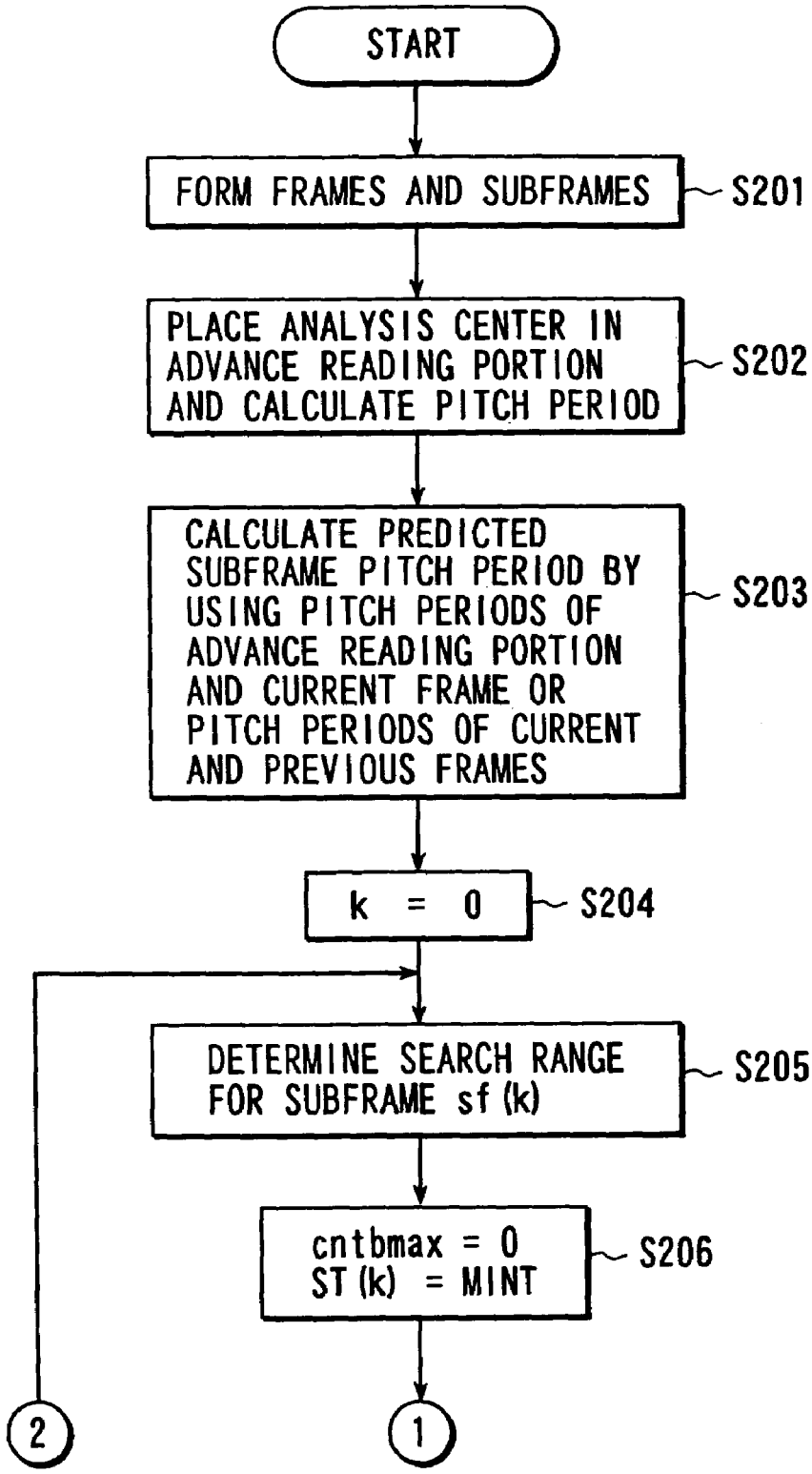
FIG. 38 is a part of a flow chart for explaining a procedure for calculating a subframe pitch period in still another embodiment of the present invention.
Figure 39:
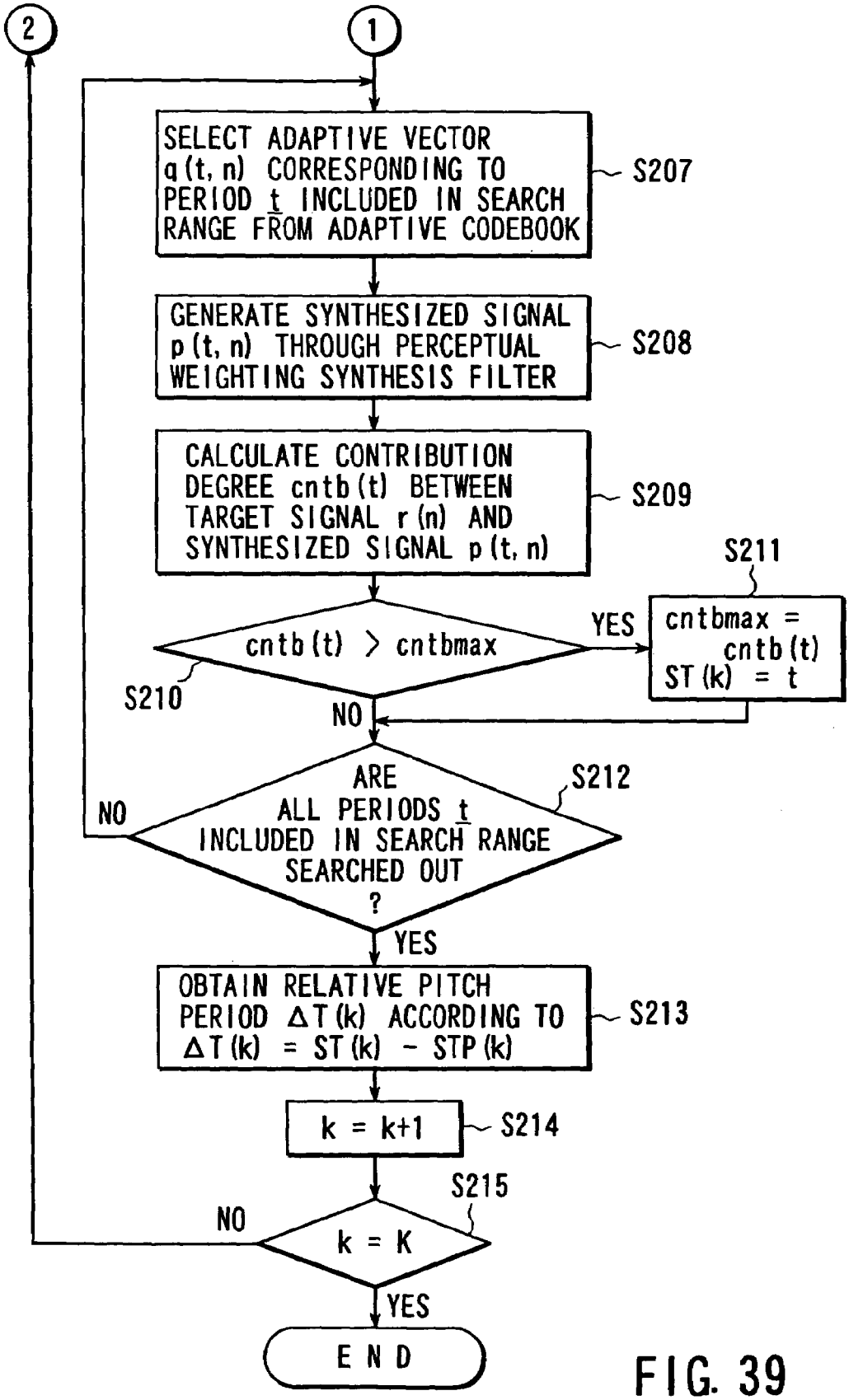
FIG. 39 is the remaining part of the flow chart for explaining the procedure for calculating a subframe pitch period in the embodiment shown in FIG. 38.

Still another embodiment of the present invention will be described with reference to the flow charts of FIGS. 38 and 39. This embodiment differs from the embodiment shown in FIG. 35 in that the method described with reference to FIG. 28 is used to calculate a predicted subframe pitch period.

According to this embodiment, as described above, since the accuracy of the predicted subframe pitch period STP(k) with respect to the actual pitch period increases, the search range for the subframe pitch periods ST(k) of subframes sf(k) can be reduced, and the number of bits and calculation amount which are required to express the relative pitch period ΔT(0) can be reduced. The processing in steps S201 and S204 to S215 in FIGS. 38 and 39 is the same as that in steps S101 and S104 to S115 in FIGS. 36 and 37, and hence a description thereof will be omitted.

This embodiment is characterized by the processing in steps S202 and S203. In step S202, the center of pitch period analysis is located on an advance reading portion to analyze a pitch period. In step S203, the predicted subframe pitch period STP(k) is calculated by using the pitch period Tr of the advance reading portion fr and the pitch period T(0) of the frame f(0) or by using the pitch period T(0) of the frame f(0) and the pitch period T(−1) of the previous frame (−1).

Still another embodiment of the present invention will be described with reference to the flow charts of FIGS. 40 and 41. This embodiment differs the embodiment described with reference to FIGS. 38 and 39 in that the method described with reference to FIG. 31 is applied to a predicted subframe pitch period calculator.

According to this embodiment, since the size of the advance reading portion can be reduced, the delay can be shortened. The processing in steps S301, S302, and S304 to S315 in FIGS. 40 and 41 is the same as that in steps S201, S202, and S204 to S215 in FIGS. 38 and 39, and hence a description thereof will be omitted.

This embodiment is characterized by the processing in step S303. In step S303, a predicted subframe pitch period STP(k) is calculated by using a pitch period Tr of an advance reading portion fr and a pitch period T(0) of a frame f(0).

Still another embodiment of the present invention will be described with reference to the flow charts of FIGS. 42 and 43. This embodiment differs from the embodiment described with reference to. FIGS. 20 and 21 in that the method described with reference to FIG. 32 is applied to a predicted subframe pitch period calculator.

With the use of the method of this embodiment, even when analysis of a pitch period T(0) of a frame f(0) fails, and the obtained pitch period greatly deviates from the actual pitch period, a predicted subframe pitch period STP(k) can be accurately obtained by performing interpolation between a pitch period Tr obtained in an advance reading portion fr and a pitch period T(−1) of a previous frame f(−1). A pitch period can therefore be efficiently expressed as in the case in which the pitch period T(0) of the frame f(0) are accurately obtained.

Figure 40:
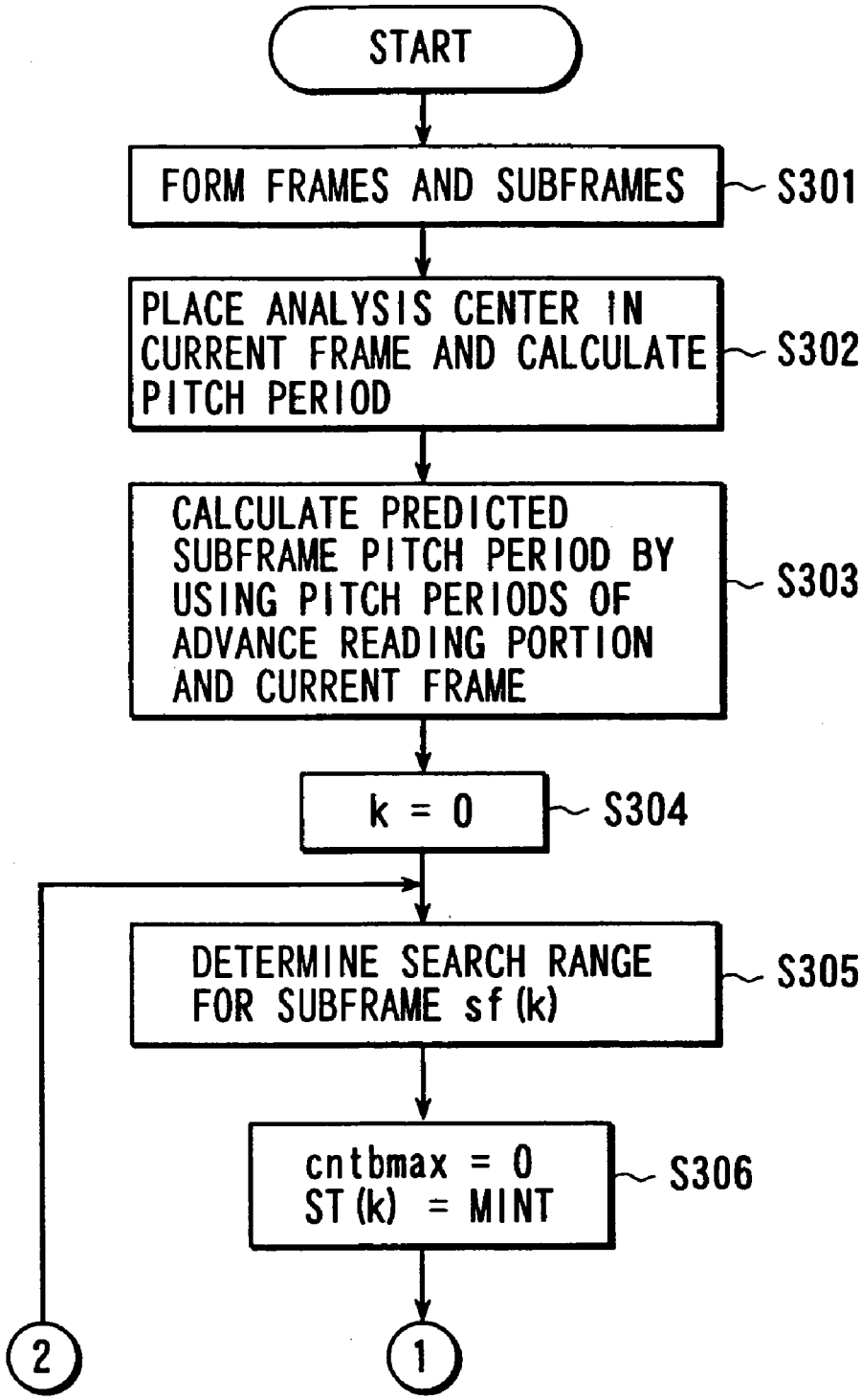
FIG. 40 is a part of a flow chart for explaining a procedure for calculating a subframe pitch period according to still another embodiment of the present invention.
Figure 41:
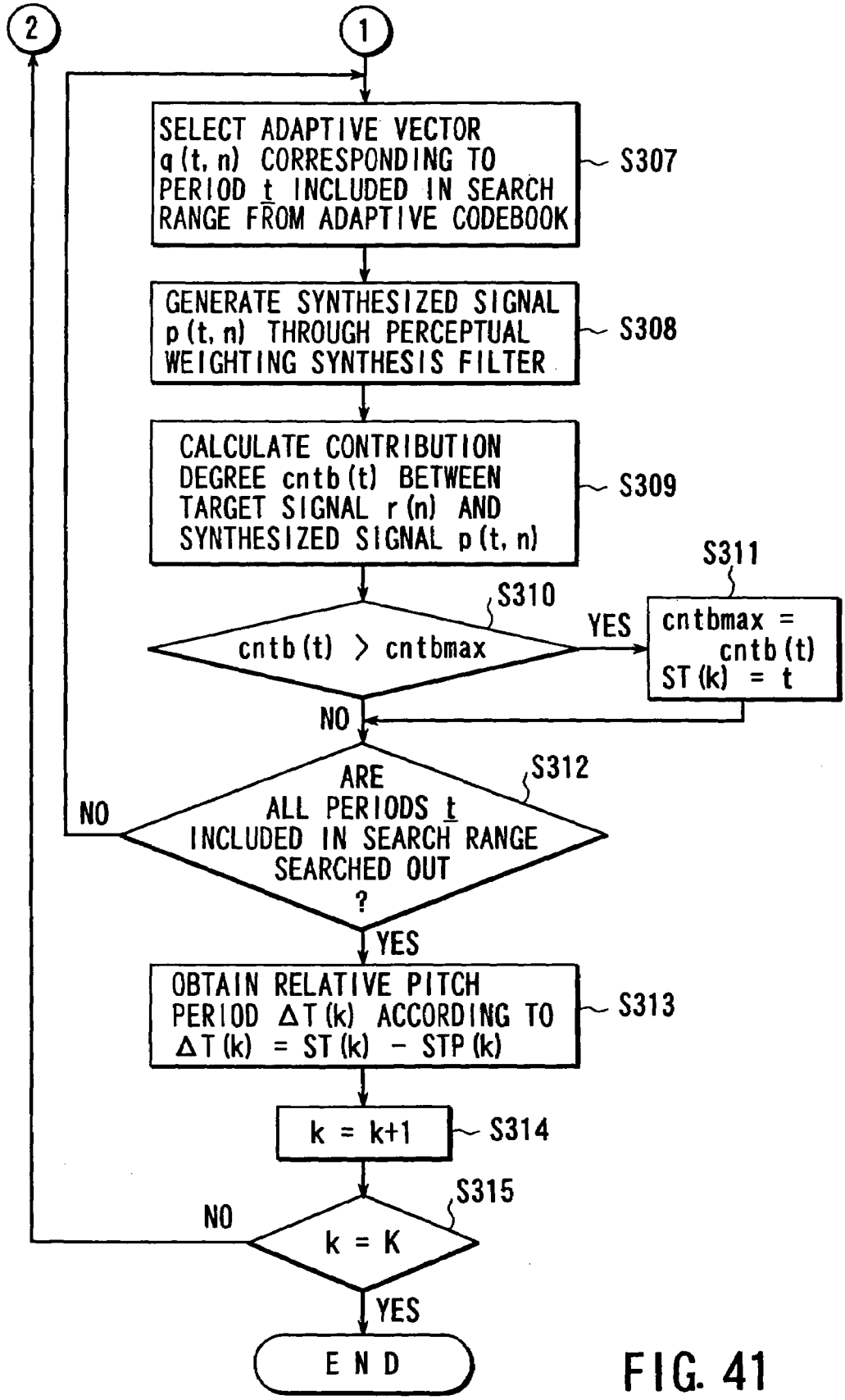
FIG. 41 is the remaining part of the flow chart for explaining the procedure for calculating a subframe pitch period in the embodiment shown in FIG. 40.
Figure 42:
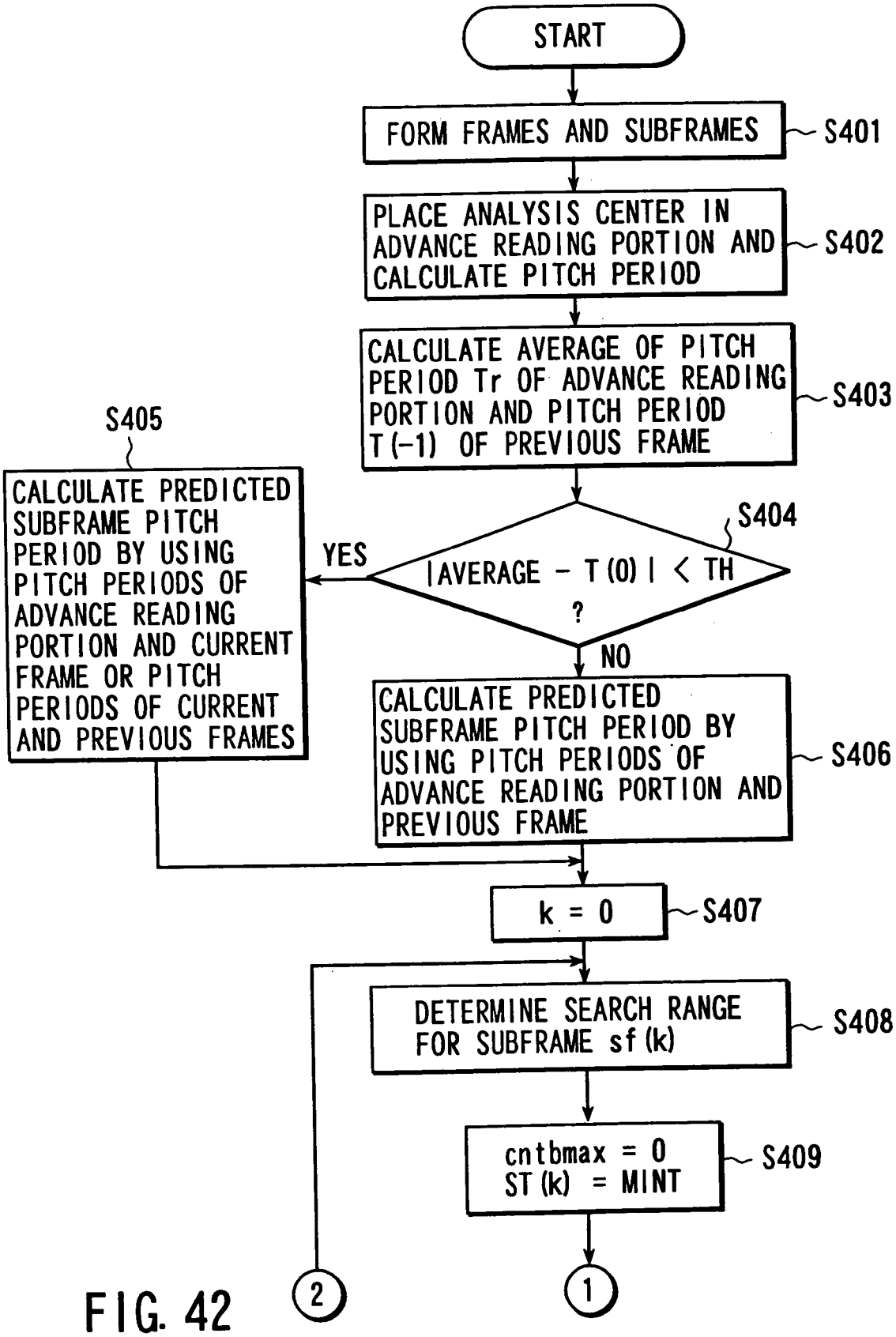
FIG. 42 is a part of a flow chart for explaining a procedure for calculating a subframe pitch period according to still another embodiment of the present invention.
Figure 43:
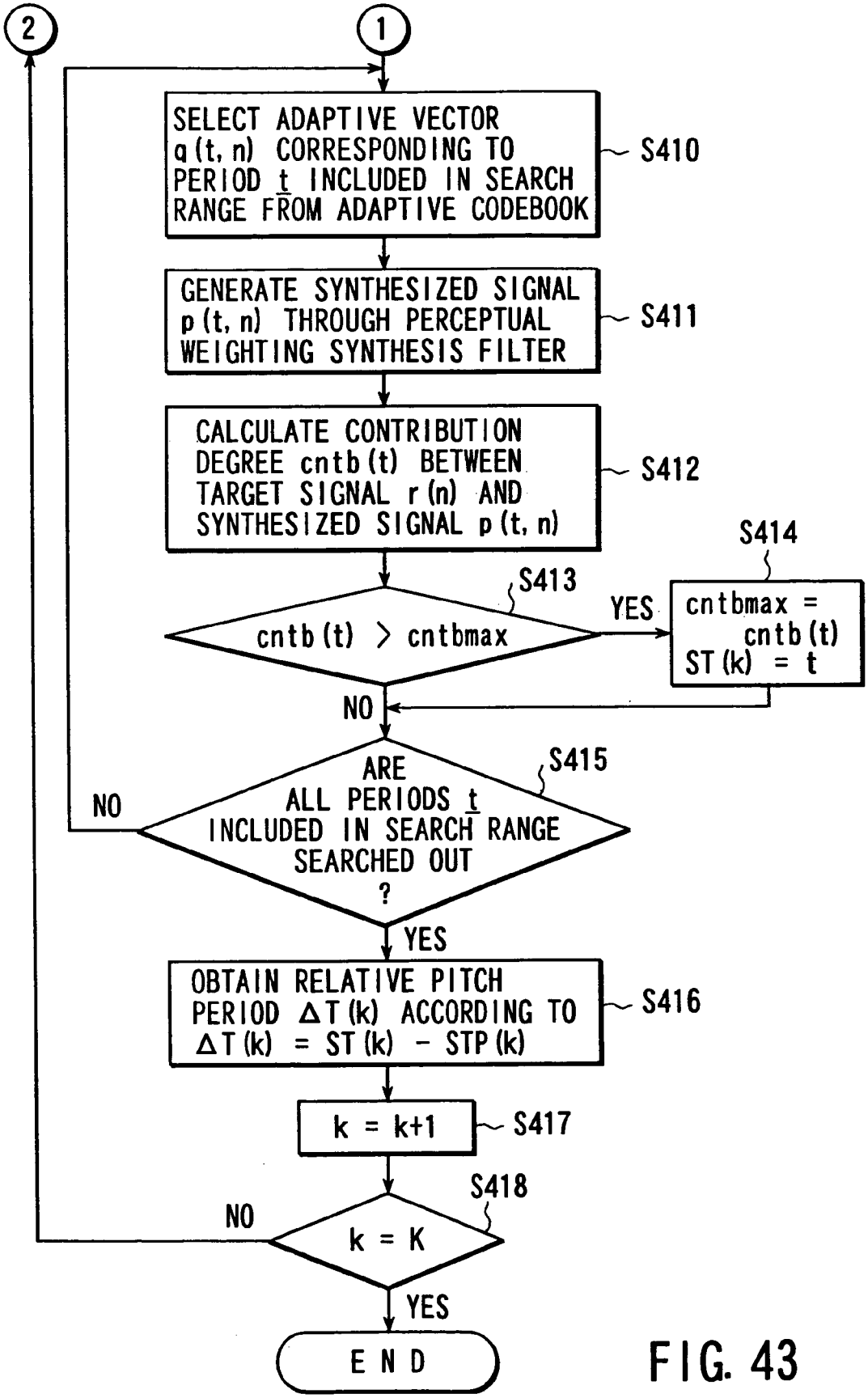
FIG. 43 is the remaining part of the flow chart for explaining the procedure for calculating a subframe pitch period in the embodiment shown in FIG. 42.

The processing in steps S401, S402, and S407 to S418 in FIGS. 42 and 43 is the same as that in steps S301, S302, and S304 to S315 in FIGS. 40 and 41, and the processing in steps S403 to S406 in FIGS. 42 and 43 is the same as that in steps S43 to S46 in FIG. 34. A description of these steps will therefore be omitted.

Figure 44:
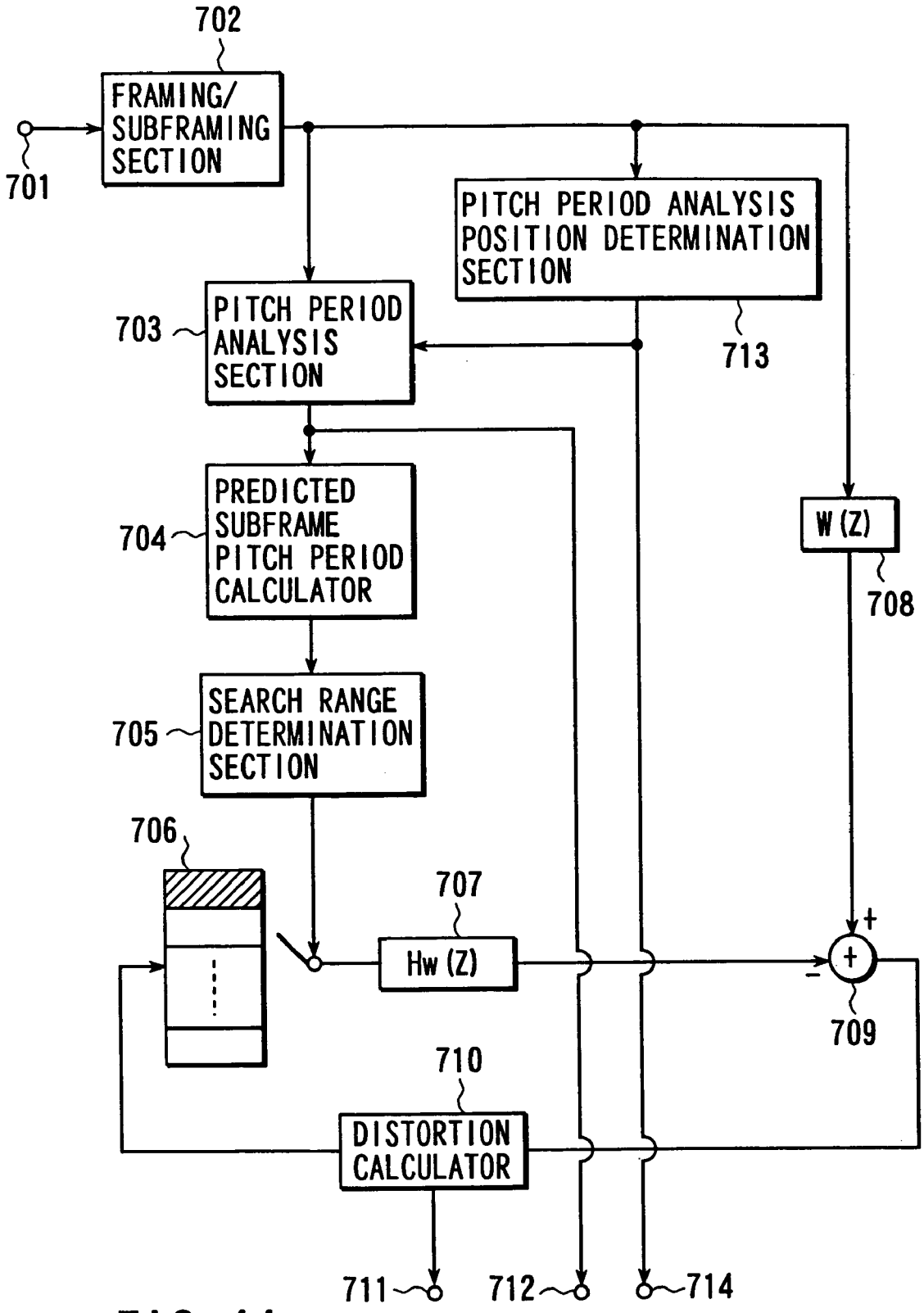
FIG. 44 is a block diagram for explaining a speech encoding method according to still another embodiment of the present invention.

Still another embodiment of the present invention will be described with reference to FIG. 44. An input terminal 701, a framing/subframing section 702, a pitch period analysis section 703, a subframe pitch period calculation section 704, a search range determination section 705, an adaptive codebook 706, a perceptual weighting synthesis filter 707, a perceptual weighting filter 708, a subtracter 709, a distortion calculation section 710, and output terminals 811 and 812 in FIG. 44 are identical to the elements denoted by reference numerals 601 to 612 in FIG. 35. A description of these components will therefore be omitted. This embodiment is characterized in that a pitch period analysis position in the pitch period analysis section 703 is determined by a pitch period analysis position determination section 713.

Figure 45:
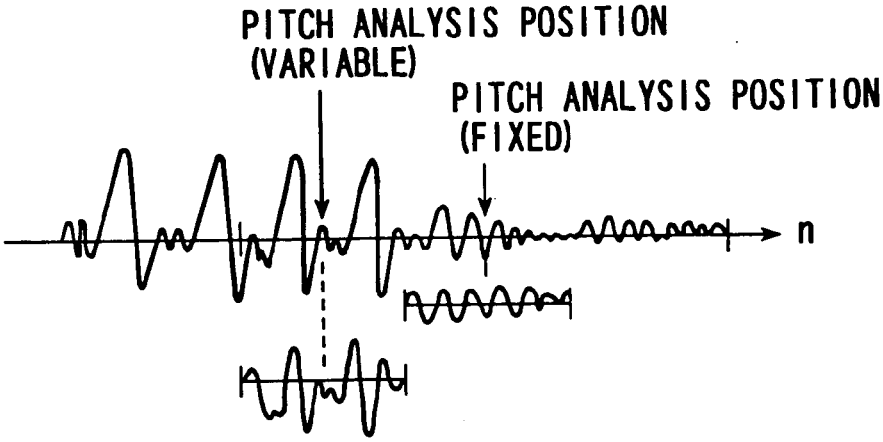
FIG. 45 is a timing chart for explaining the effect of the embodiment shown in FIG. 44.

The effect of this embodiment will be described with reference to FIG. 45. When the characteristics of an input speech signal change within a frame, as shown in FIG. 45, an accurate pitch period may not be obtained if the pitch period analysis position is fixed. In the case shown in FIG. 45, since no period component is included in a signal to be subjected to pitch analysis when the pitch period analysis position is fixed, an accurate pitch period cannot be obtained. If, however, the pitch analysis position can be made variable, since the pitch period analysis position can be set at a position where a waveform having a pitch period component appears, as shown in FIG. 45, an accurate pitch period can be obtained. In this case, however, additive information representing the pitch period analysis.position is required to generate predicted subframe pitch period STP(k) in the decoder.

Referring to FIG. 44, the pitch period analysis position determination section 713 determines a pitch period analysis position. This embodiment uses a method of using the short-term power of an input speech signal or the short-term power of a prediction error signal having passed through a low-pass filter, and setting a pitch period analysis position at a portion where the power is maximum. The information of this pitch period analysis position is sent to the pitch period analysis section 703, and at the same time, output from an output terminal 714. The pitch period analysis section 703 performs pitch period analysis in accordance with the information of the pitch period analysis position which is sent from the pitch period analysis position determination section 713.

Figure 46:
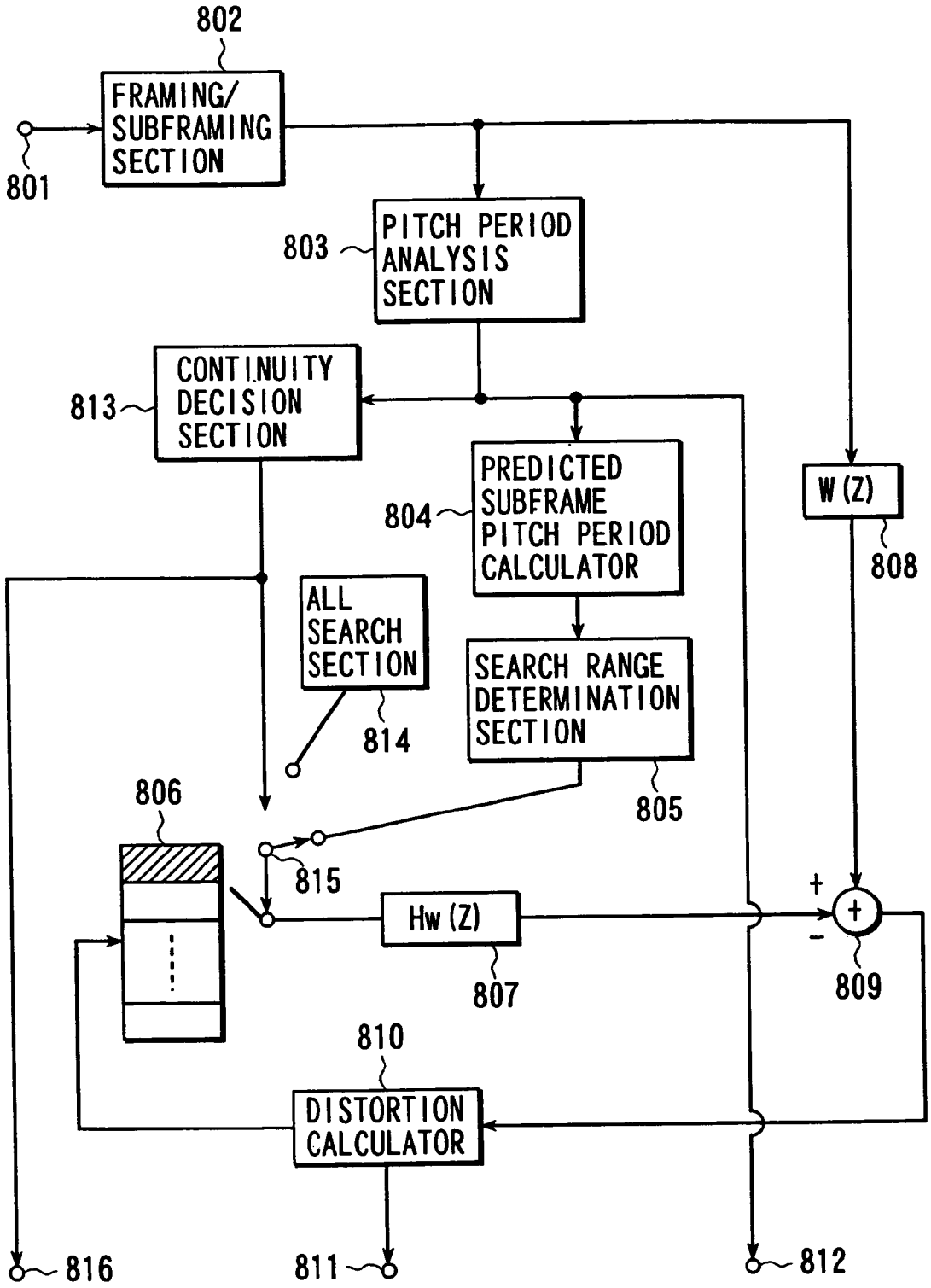
FIG. 46 is a block diagram for explaining a speech encoding method according to still another embodiment of the present invention.

Still another embodiment of the present invention will be described with reference to FIG. 46. An input terminal 801, a framing/subframing section 802, a pitch period analysis section 803, a predicted subframe pitch period calculation section 804, a search range determination section 805, an adaptive codebook 806, a perceptual weighting synthesis filter 807, a perceptual weighting filter 808, a subtracter 809, a distortion calculation section 810, and output terminals 811 and 812 in FIG. 46 are identical to the elements denoted by reference numerals 601 to 612 in FIG. 35. A description of these components will therefore be omitted.

This embodiment is characterized in that a continuity decision section 813 decides whether a change in pitch period obtained by the pitch period analysis section 803 is continuous, and a search range in the adaptive codebook 806 is determined in accordance with the decision result. More specifically, in this embodiment, if it is decided that a change in pitch period is continuous, a predicted subframe pitch period is obtained in the above manner, and a search range in the adaptive codebook 806 is determined by the search range determination section 805 on the basis of the predicted subframe pitch period. If it is determined that the change is not continuous, an all search section 814 searches for all the candidates in the adaptive codebook 806.

This embodiment has the following effects.

If the pitch period obtained by the pitch period analysis section 803 continuously changes, the method of interpolating pitch periods and searching only a portion near the obtained values can be effectively used. However, the pitch period of a speech signal does not always change stably, and may greatly change. Some portion of the speech signal, e.g., an unvoiced portion, may not have any pitch component. In such a case, if a search range is limited by forcibly performing interpolation on the assumption that the pitch period continuously changes, a serious deterioration in quality occurs. According to this embodiment, if the pitch period is not continuous, the search mode is switched to the mode of searching for all the candidates in the adaptive codebook 806 to solve the above problem.

In addition, the same effect can also be obtained by switching the search mode to the mode of searching for all candidates in accordance with the degree of periodicity of a pitch period T obtained by the pitch period analysis section 803. More specifically, if a variable representing the degree of pitch periodicity, e.g., $\rho(T)$ in equation (27), is equal to or smaller than a predetermined threshold, a switch 815 is switched to cause the all search section 814 to search for all the candidates, thereby preventing a deterioration in quality in a region having no pitch period.

The continuity decision section 813 decides the continuity of the pitch period on the basis of the pitch period obtained by the pitch period analysis section 803. In this embodiment, a pitch period T(0) obtained in a frame f(0) and a pitch period T(−1) obtained in a frame f(−1) are used. This method, however, can be applied to a case in which a pitch period Tr of an advance reading portion fr and the pitch period T(0) of the frame f(0) are used, the continuity of the pitch period Tr of the advance reading portion fr and the pitch period T(−1) of the frame f(−1) is used, or the continuity of the pitch period Tr of the advance reading portion fr, the pitch period T(0) of the fame f(0), and the pitch period T(−1) of the frame f(−1) is used. The continuity of pitch periods is decided according to equation (30):

$$|T(0)-T|<TH2 \tag{30}$$

If equation (30) is satisfied, it is decided that the pitch period continuously changes, and the switch 815 selects an output from the search range determination section 805, thereby searching only a limited search range of the adaptive codebook 806, as described above. If equation (30) is not satisfied, it is decided that the pitch period does not continuously change, the switch 815 selects the all search section 814 to search for all the candidates in the adaptive codebook 806. The decision result from the continuity decision section 813 is output from an output terminal 816. If the output from the continuity decision section 813 indicates that the pitch period does not continuously change, the pitch period obtained by the pitch period analysis section 803 need not be output from the output terminal 812.

Figure 47:
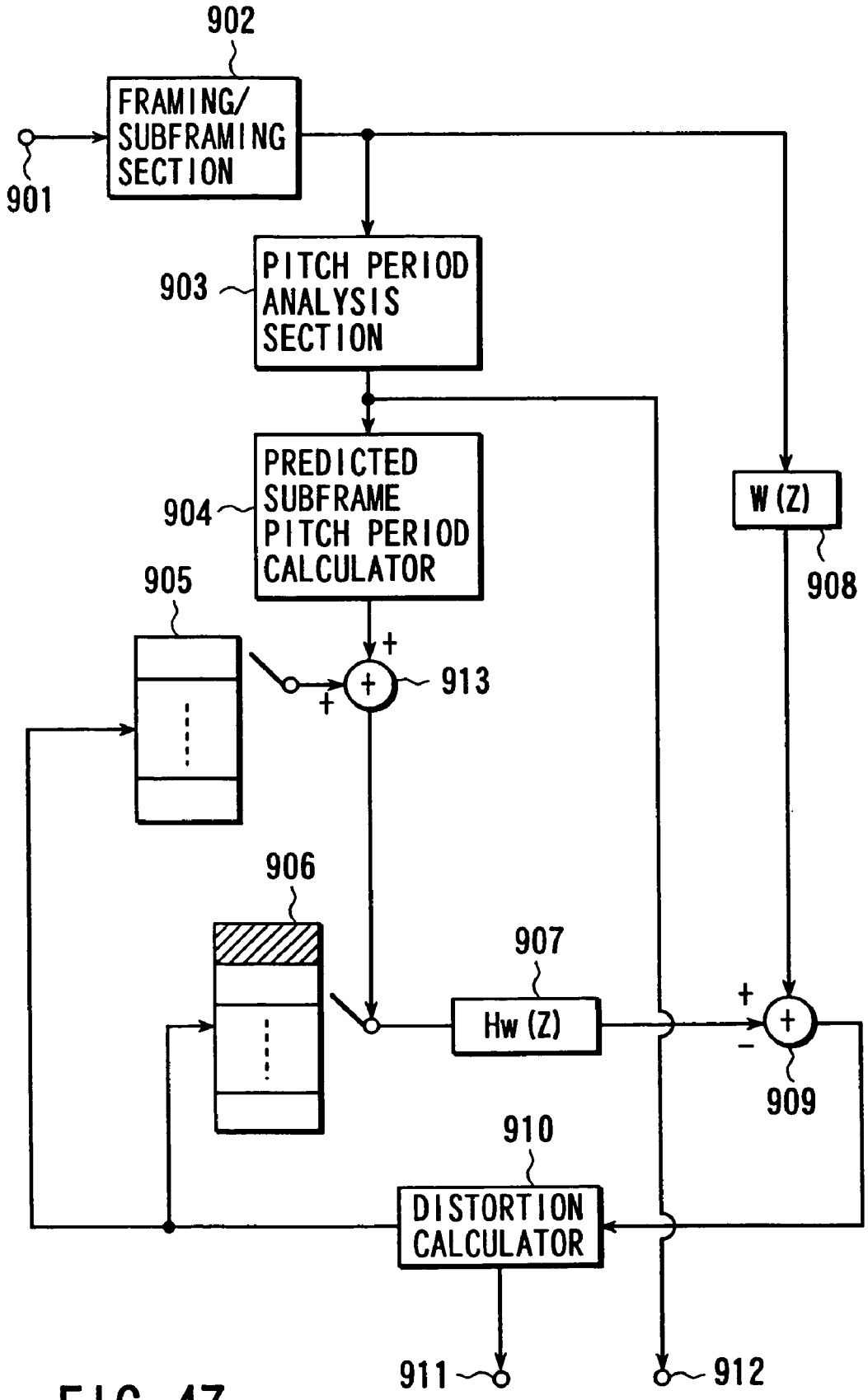
FIG. 47 is a block diagram for explaining a speech encoding method according to still another embodiment of the present invention.

Still another embodiment of the present invention will be described with reference to FIG. 47. An input terminal 901, a framing/subframing section 902, a pitch period analysis section 903, a predicted subframe pitch period calculation section 904, an adaptive codebook 906, a perceptual weighting synthesis filter 907, a perceptual weighting filter 908, a subtracter 909, a distortion calculation section 910, and output terminals 911 and 912 in FIG. 47 are identical to the elements denoted by reference numerals 601 to 604 and 606 to 612 in FIG. 35. A description of these elements will therefore be omitted.

This embodiment is characterized in that a relative pitch pattern codebook 905 constituted by a set of a plurality of relative pitch period patterns (relative pitch patterns) representing fluctuations in the subframe pitch periods of a plurality of subframes is used, and the relative pitch periods of a plurality of subframes are regarded as a vector, and one of relative pitch patterns in the relative pitch pattern codebook 905 which is most similar to this vector is selected.

This embodiment has the following effects.

Assume that relative pitch periods ΔT(k) are scalar-quantized in units of subframes. In this case, for example, if a search range NR=8, three bits are required to express each pitch period, as described above. That is, 3 bits×4 subframes=12 bits are required per frame to express the information of the relative pitch period ΔT(k).

In contrast to this, this embodiment has the relative pitch pattern codebook 905 having relative pitch period patterns with high frequencies of appearance as relative pitch patterns. Assume that one vector (four dimensions) is expressed by relative pitch periods ΔT(0) to ΔT(3) of four subframes sf(0) to sf(3), and the relative pitch pattern codebook 905 is constituted by 128 (7 bits) types of relative pitch patterns. In this case, the relative pitch periods ΔT(k) of four subframes can be expressed by 7 bits, which have been expressed by 12 bits. That is, a great reduction in the number of bits can be attained.

The relative pitch pattern codebook 905 has J types of representative relative pitch patterns pv(j) given in advance by:

$$pv(j) = \{v(j, k); k = 0 \text{ to } k-1\} \quad (0 \leqq j \leqq J-1) \tag{31}$$

An adder 913 adds a predicted subframe pitch period STP(k) and the jth relative pitch pattern pv(j) to obtain a set Tx(j) of K subframe pitch periods, as indicated by the following equation:

$$Tx(j)=STP(k)+v(j, k) \tag{32}$$

A search is then performed in the manner of a closed loop on the basis of the set Tx(j) obtained in this manner to search for a relative pitch pattern corresponding to the maximum contribution degree among the K subframes. In this case, the contents of an adaptive codebook 906 are updated in units of subframes. The number of subframes is not limited to K. A relative pitch period can be obtained with respect to two or more subframes, or K or less subframes. To reduce the calculation amount, relative pitch pattern candidates may be limited by a proper evaluation value (e.g., the numerator term of a contribution degree) that requires a small calculation amount, and the accurate contribution degrees of the remaining candidates may be obtained, thereby finally determining one relative pitch pattern.

Figure 48:
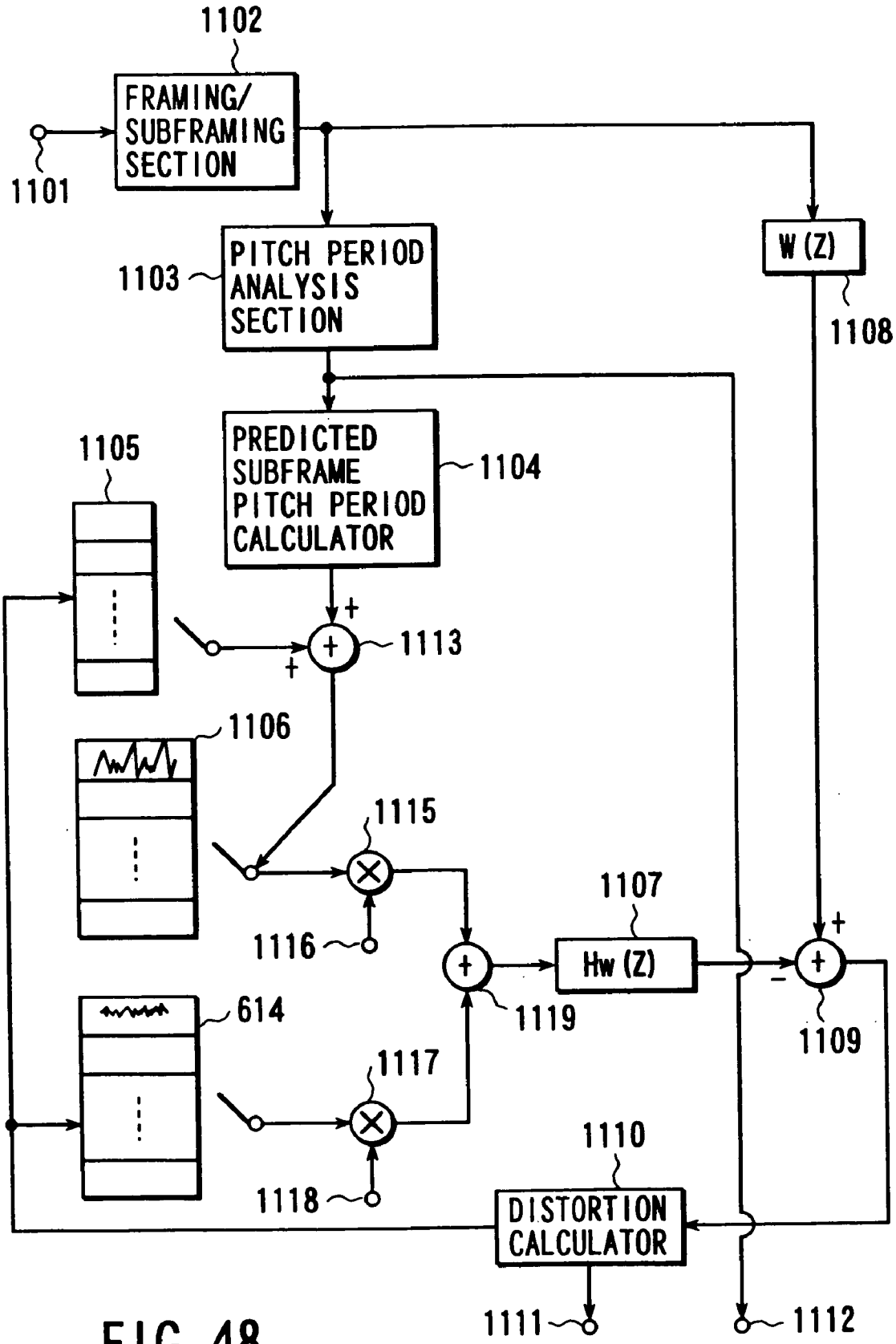
FIG. 48 is a block diagram for explaining a speech encoding method according to still another embodiment of the present invention.

Still another embodiment of the present invention will be described below with reference to FIG. 48. An input terminal 1101, a framing/subframing section 1102, a pitch period analysis section 1103, a predicted subframe pitch period calculation section 1104, a relative pitch pattern codebook 1105, an adaptive codebook 1106, a perceptual weighting synthesis filter 1107, a perceptual weighting filter 1108, a subtracter 1109, a distortion calculation section 1110, output terminals 1111 and 1112, and an adder 1113 in FIG. 48 are identical to the elements denoted by reference numerals 901 to 913 in FIG. 47. A description of these elements will therefore be omitted.

This embodiment is characterized in that a relative pitch pattern is determined in consideration of the influences of both the adaptive codebook 1106 and a stochastic codebook 1114. With this arrangement, a more accurate relative pitch pattern can be determined.

In this case, a gain to be multiplied by an adaptive vector by a multiplier 1115 is supplied from a terminal 1116. As this gain, an ideal gain gopt given by the following equation or a factor, in an adaptive vector gain codebook (not shown), which is nearest to the ideal gain gopt is used.

$$gopt = \frac{\sum_{n=0}^{NSF-1} r(n)p(t, n)}{\sum_{n=0}^{NSF-1} p(t, n)^2} \tag{33}$$

where r(n) is the target vector and p(t,n) is the signal obtained by filtering an adaptive codevector through the perceptual weighting synthesis filter 1107 at a pitch period t.

Similarly, a gain to be multiplied by a stochastic vector by a multiplier 1117 is supplied from a terminal 1118. As this gain, an ideal gain bopt given by the following equation or a factor, in a stochastic vector gain codebook (not shown), which is nearest to the ideal gain bopt is used.

$$bopt = \frac{\sum_{n=0}^{NSF-1} r(n)e(i, n)}{\sum_{n=0}^{NSF-1} e(i, n)^2} \tag{34}$$

where r(n) is the target vector and e(i,n) is the signal obtained by filtering a stochastic codevector with an index i through the perceptual weighting synthesis filter 1107.

When a relative pitch pattern exhibiting the maximum contribution degree among a plurality of subframes is determined, the index of the relative pitch pattern is output from the output terminal 1111. The information of the pitch period obtained by the pitch period analysis section 1103 is output from the output terminal 1112.

The contents of the adaptive codebook 1106 are updated in units of subframes. The number of subframes is not limited to K. A relative pitch period can be obtained with respect to two or more subframes, or K or less subframes. To reduce the calculation amount, relative pitch pattern candidates may be limited by a proper evaluation value (e.g., the numerator term of a contribution degree) that requires a small calculation amount, and the accurate contribution degrees of the remaining candidates may be obtained, thereby finally determining one relative pitch pattern.

Still another embodiment of the present invention will be described with reference to FIG. 49. In this embodiment, the present invention is applied to a CELP encoder (speech encoding apparatus). This embodiment has a typical arrangement constituted by a combination of several embodiments described above. However, the present invention is not limited to this. Various combinations of embodiments can be applied to the CELP scheme. Note that the CELP scheme is disclosed in M. R. Schrodeder and B. S. Atal, "Code-Excited Linear Prediction (CELP) High-Quality Speech at Very Low Bit Rates", Proc. ICASSP, 1985, pp. 937–939.

Figure 49:
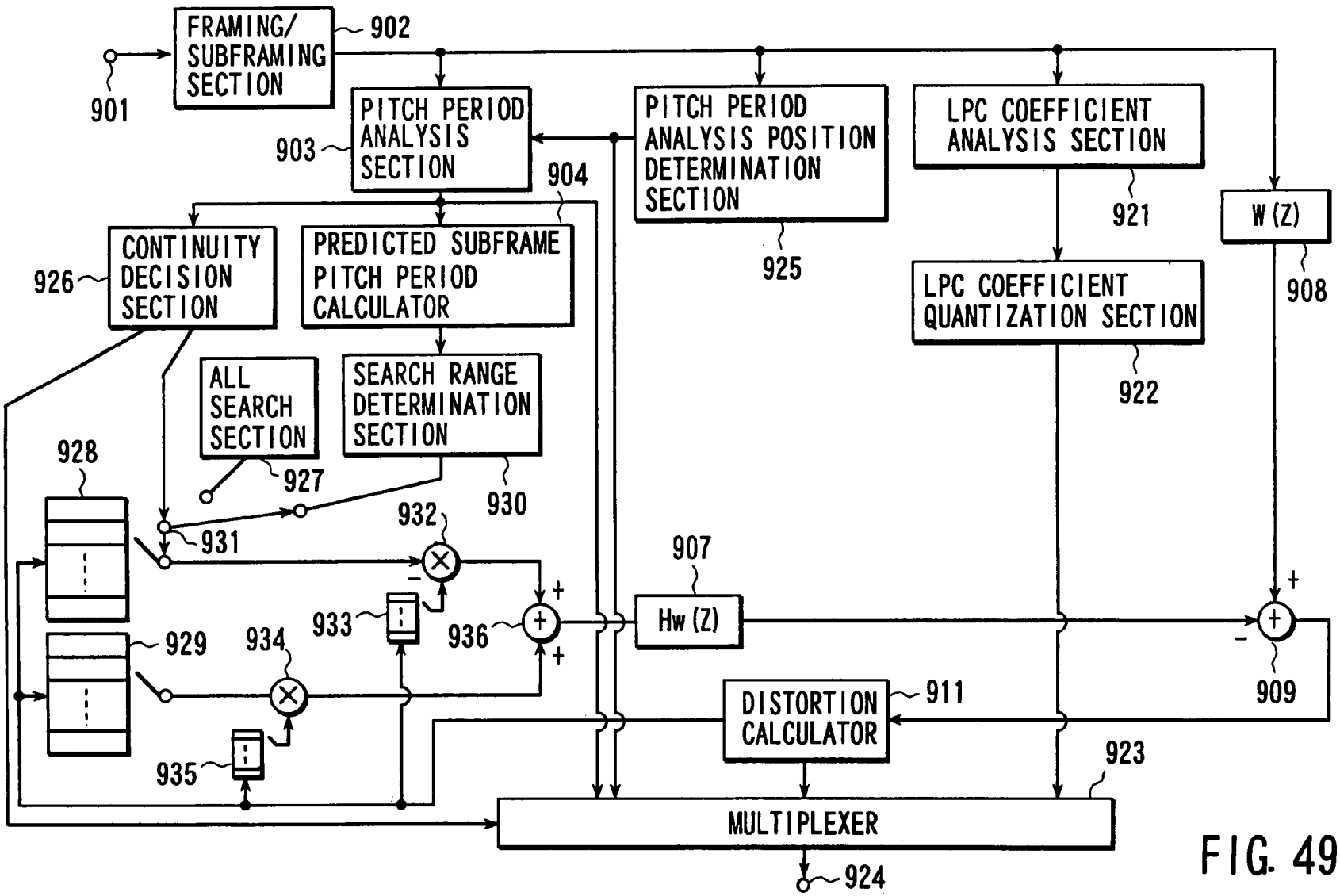
FIG. 49 is a block diagram showing a speech encoding apparatus of the CELP scheme to which a speech encoding method according to still another embodiment of the present invention is applied.

Referring to FIG. 49, a digital speech signal is input to a framing/subframing section 902 through an input terminal 901 to form frames and subframes. The framed/subframed speech signal is supplied to an LPC coefficient analysis section 921 to be subjected to LPC analysis so as to calculate an LPC coefficient. This LPC coefficient is used to determine transfer functions for a perceptual weighting filter 908 and a perceptual weighting synthesis filter 907.

The LPC coefficient obtained by the LPC coefficient analysis section 921 is quantized by an LPC coefficient quantization section 922. The index obtained by quantization is supplied to a multiplexer 923 to be multiplexed with other pieces of information (to be described later). The LPC coefficient decoded after quantization is used to determine a transfer function for the perceptual weighting synthesis filter 907.

The input speech signal is also supplied to a pitch period analysis position determination section 925. The pitch period analysis position determination section 925 obtains a predetermined number of short-term powers of the speech signal, and supplies an index indicating a region where the maximum short-term power is obtained to a pitch period analysis section 903 and the multiplexer 923. The pitch period analysis section 903 performs pitch period analysis around the analysis position determined by the pitch period analysis position determination section 925 by using the speech signal, a prediction error signal, a prediction error signal obtained through a low-pass filter, or the like.

The continuity between the pitch period obtained in the pitch period analysis section 903 and the pitch period obtained in the previous framing is determined by a continuity determination section 926. The decision result is supplied to the multiplexer 923. If the decision result indicates that the above pitch periods are continuous, the pitch period obtained by the pitch period analysis section 903 is supplied to the multiplexer 923. A predicted subframe pitch period calculator 904 obtains predicted pitch periods in units of subframes. A search range determination section 930 determines a pitch period search range in units of subframes on the basis of the predicted subframe pitch period. In this case, adaptive vectors of pitch periods included in the search range determined by the search range determination section 930 are selected as candidates.

If the decision result from the continuity determination section 926 indicates that the above pitch periods are not continuous, a switch 931 is switched to select an all search section 927 to select all adaptive vectors included in an adaptive codebook 928 as candidates. In this case, the pitch period obtained by the pitch period analysis section 903 and the output of the pitch period analysis position determination section 925 need not be supplied to the multiplexer 923.

A multiplier 932 multiplies the adaptive vector selected by the adaptive codebook 928 by the adaptive vector gain selected from a adaptive vector gain codebook 933. Similarly, a multiplier 934 multiplies the stochastic vector selected from a stochastic codebook 929 by the stochastic vector gain selected from a stochastic vector gain codebook 935. An adder 936 adds the signals respectively obtained from the multipliers 932 and 934 to generate a temporary excitation vector.

The temporary excitation vector generated in this manner is filtered by the perceptual weighting synthesis filter 907 to generate a synthesized vector. A subtracter 909 calculates the difference between the synthesized vector and the target vector obtained by filtering the speech signal through the perceptual weighting filter 908. A distortion calculator 911 then obtains a distortion on the basis of the resultant difference signal. A combination of an adaptive vector, an adaptive vector gain, a stochastic vector, and a stochastic vector gain which are obtained when this distortion is minimized is efficiently searched out.

Figure 50:
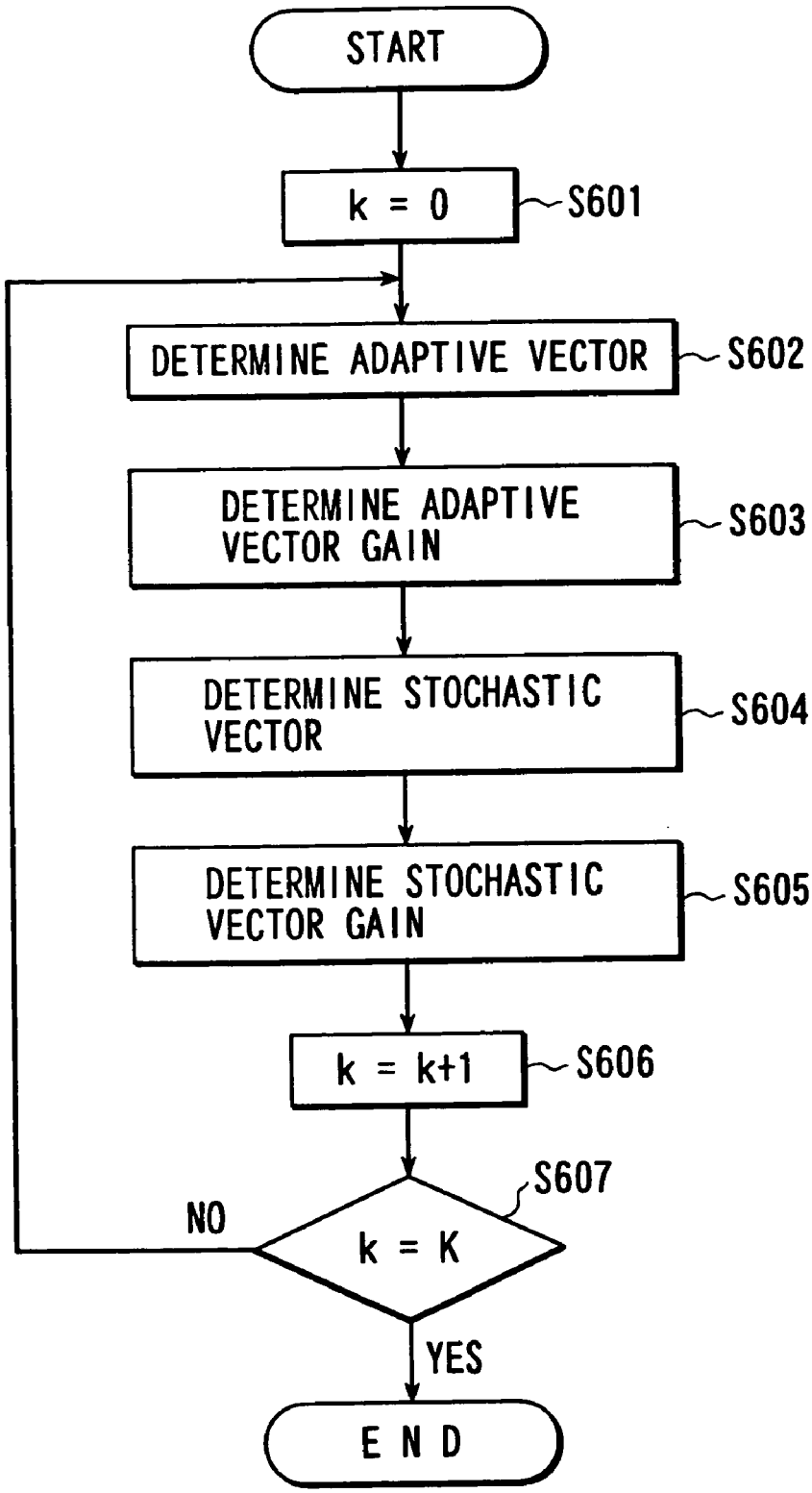
FIG. 50 is a flow chart for explaining a procedure for obtaining an adaptive gain, an adaptive vector gain, a stochastic vector, and a stochastic vector gain in the embodiment shown in FIG. 49.

For example, as indicated by the flow chart of FIG. 50, an adaptive vector, an adaptive vector gain, a stochastic vector, and a stochastic vector gain are serially obtained for each subframe in the order named. Alternatively, as indicated by the flow chart of FIG. 51, in an arrangement designed to simultaneously optimize an adaptive vector gain and a stochastic vector gain by vector quantization for each subframe, an adaptive gain, a stochastic vector, and a gain vector are obtained in the order named.

Referring to FIG. 50, after a counter k is set to 0 in step S601, an adaptive vector, an adaptive vector gain, a stochastic vector, and a stochastic vector gain are sequentially obtained in steps S602, S603, S604, and S605. The counter k is incremented by one in step S606. In step S607, it is checked whether the counter k coincides with K. If NO in step S607, the flow returns to step S602 to continue the processing. If YES in step S607, the processing is terminated.

Figure 51:
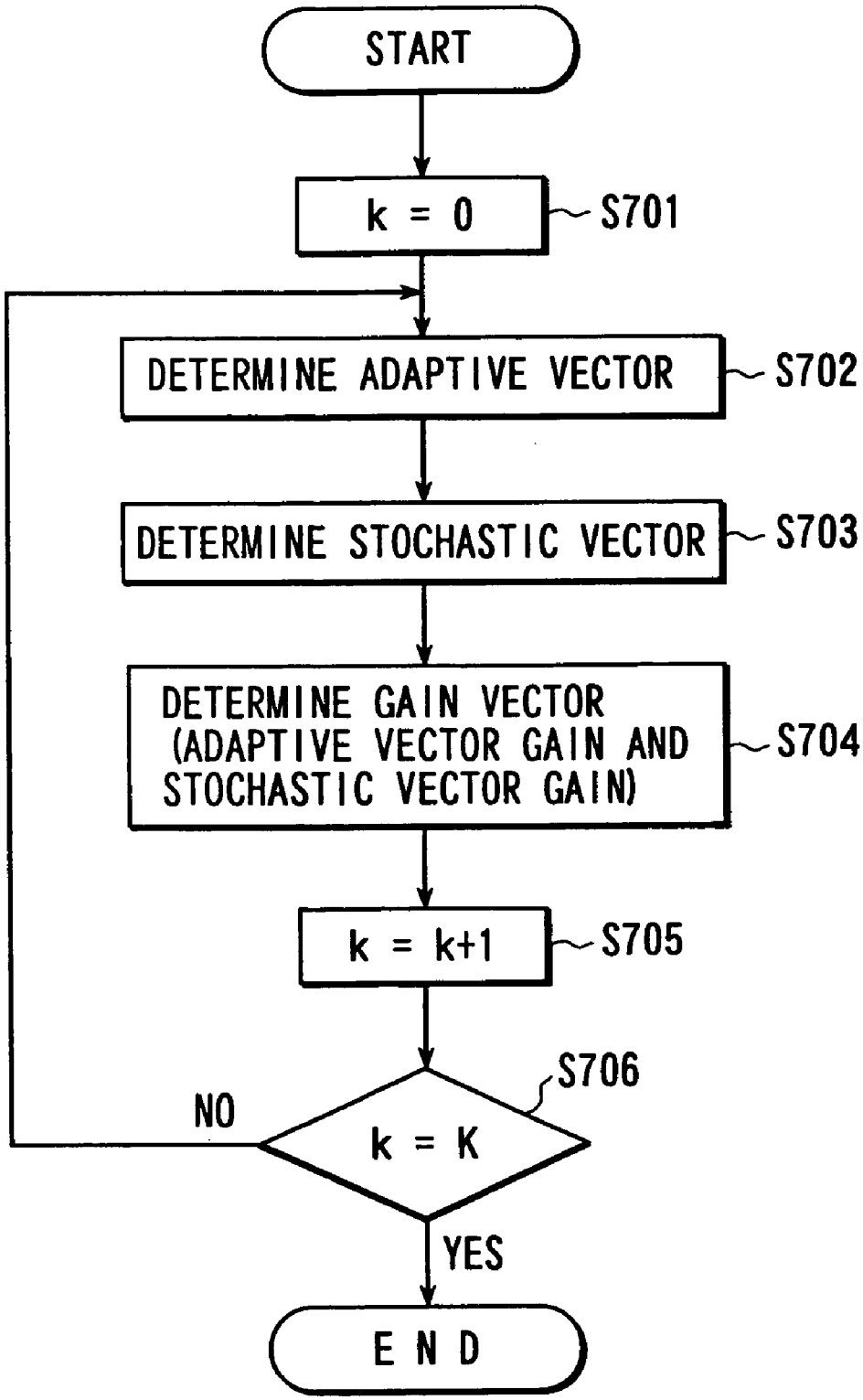
FIG. 51 is a flow chart for explaining a procedure for obtaining an adaptive vector, a stochastic vector, and a gain vector in the embodiment shown in FIG. 49.

Referring to FIG. 51, after the counter k is set to 0 in step S701, an adaptive vector, a stochastic vector, and a gain vector (an adaptive vector gain and a stochastic vector gain) are sequentially obtained in steps S702, S703, and S704. In step S705, the counter k is incremented by one. In step S706, it is checked whether the counter k coincides with K. If NO in step S706, the flow returns to step S702 to continue the processing. If YES in step S706, the processing is terminated.

Indexes representing an adaptive vector, an adaptive vector gain, a stochastic vector, and a stochastic vector gain which are obtained when the distortion is minimized in this manner are supplied to the multiplexer 923. If the continuity determination section 926 decides that the variation of the pitch periods is continuous, the index indicating the adaptive vector is expressed as a relative value with respect to a predicted subframe pitch period.

The multiplexer 923 multiplexes different data depending on the decision result obtained by the continuity determination section 926. More specifically, if the decision result obtained by the continuity determination section 926 indicates that a change in pitch period is continuous, the multiplexer 923 multiplexes the LPC coefficient index obtained by the LPC coefficient quantization section 922, the analysis position index obtained by the pitch period analysis position determination section 925, the decision information obtained by the continuity determination section 926, the pitch period information obtained by the pitch period analysis section 903, the relative value with respect to the predicted subframe pitch period of the adaptive vector, the adaptive vector gain index, the stochastic vector index, and the stochastic vector gain index, and outputs the resultant data as encoded data from an encoded data output terminal 924. If the decision result obtained by the continuity determination section 926 indicates that a change in pitch period is not continuous, the multiplexer 923 multiplexes the LPC coefficient index obtained by the LPC coefficient quantization section 922, the decision information obtained by the continuity determination section 926, the adaptive vector index, the adaptive vector gain index, the stochastic vector index, and stochastic vector gain index, and outputs the resultant data from the output terminal 924.

Figure 52:
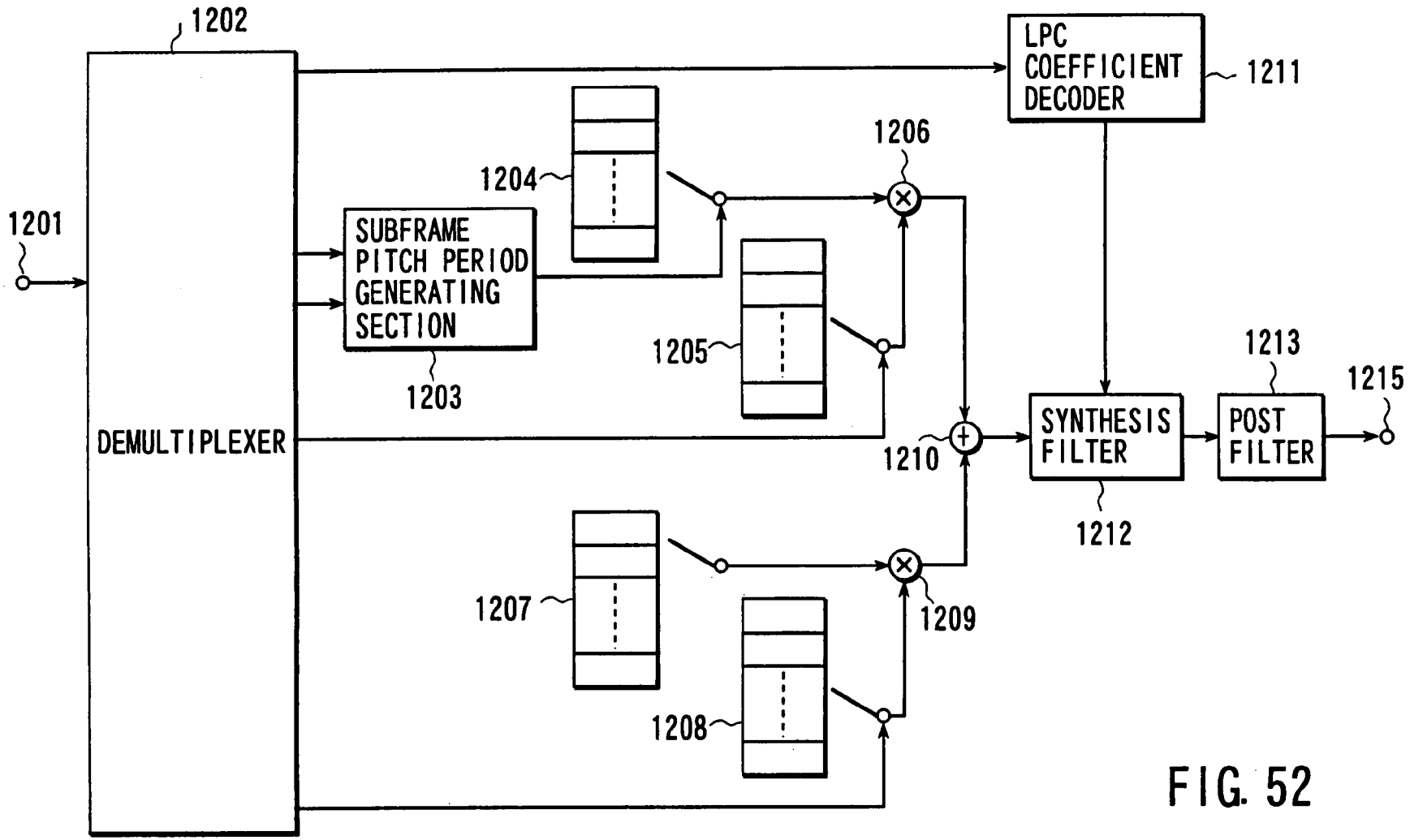
FIG. 52 is a block diagram showing a CELP speech decoding apparatus of the CELP scheme to which a speech decoding method according to still another embodiment of the present invention is applied.

Still another embodiment of the present invention will be described with reference to FIG. 52. In this embodiment, the present invention is applied to a CELP decoder (speech decoding apparatus). This embodiment is associated with a decoder section corresponding to the CELP encoder section constituted by a combination of several embodiments described above. However, the present invention is not limited to this. For example, the present invention can be applied to decoder sections corresponding to CELP encoder sections constituted by various combinations of embodiments described above.

Multiplexed encoded data is input through an input terminal 1201 and converted into indexes indicating various parameters by a demultiplexer 1202. An LPC coefficient decoder 1211 decodes an LPC coefficient on the basis of an LPC coefficient index, and supplies it to a synthesis filter 1212. A subframe pitch period generating section 1203 receives information associated with a pitch period, and generates the pitch period to be used for an adaptive codebook 1204. Generation of this pitch period will be described in detail later with reference to FIG. 53.

An adaptive vector is obtained from the adaptive codebook 1204 by using the generated pitch period as an index. A multiplier 1206 multiplies this adaptive vector by an adaptive vector gain obtained from an adaptive vector gain codebook 1205 using the adaptive vector gain index. Similarly, a multiplier 1209 multiplies a stochastic vector obtained from a stochastic codebook 1207 using the stochastic vector index by a stochastic vector gain obtained from a stochastic vector gain codebook 1208 using the stochastic vector gain index.

An adder 1210 adds these two signals obtained by the multiplications to generate an excitation signal. This excitation signal is supplied to the synthesis filter 1212 to generate a synthesized signal. This synthesized signal is supplied to a post filter 1213 to undergo perceptual improvements by formant emphasis, pitch emphasis, gain adjustment, and the like. The resultant signal is output from an output terminal 1215.

Figure 53:
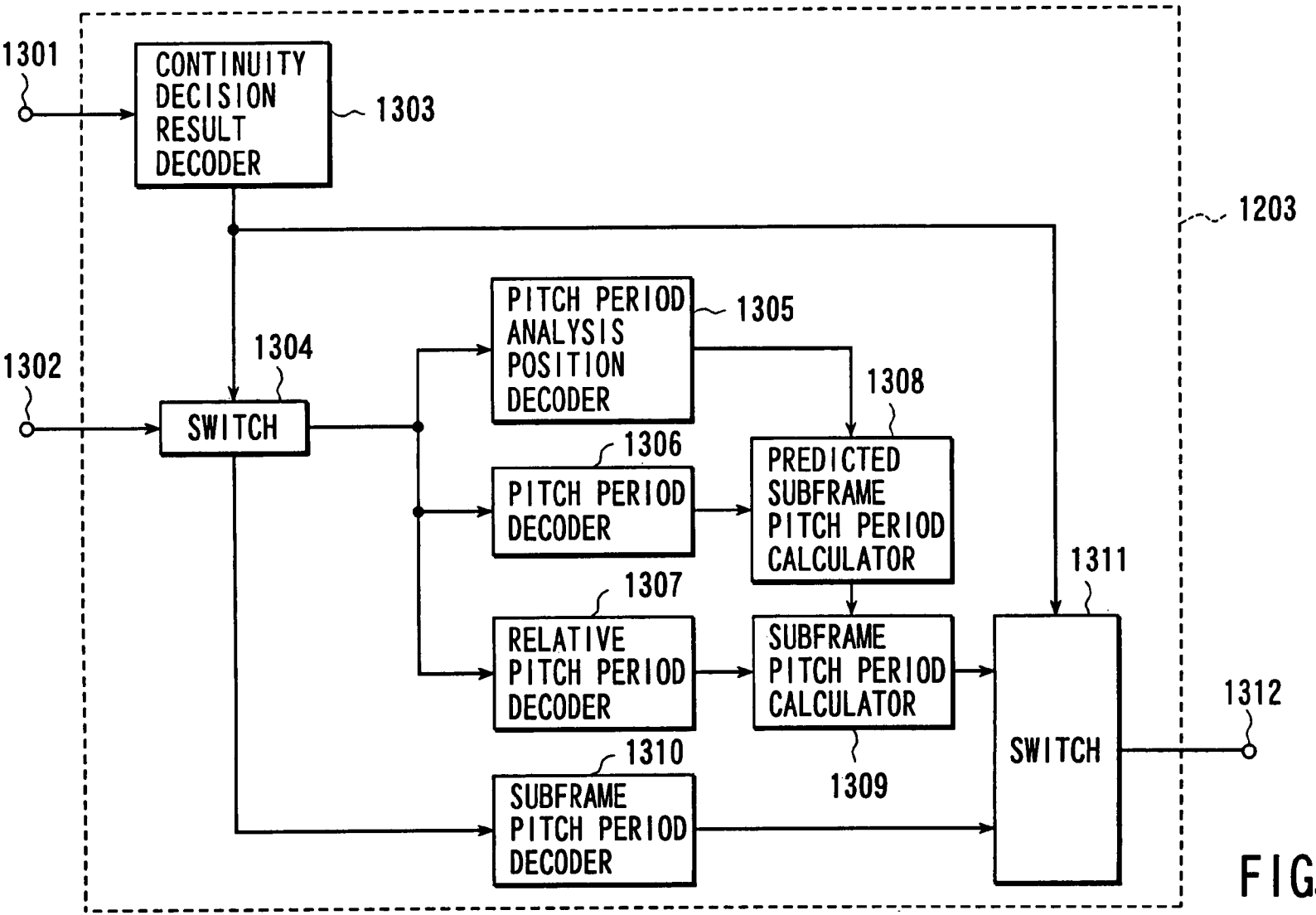
FIG. 53 is a block diagram showing the arrangement of a subframe pitch period generating section in the embodiment shown in FIG. 52.

The subframe pitch period generating section 1203 will be described next with reference to FIG. 53. When pitch period continuity decision information is input through an input output 1301, switches 1304 and 1311 are switched in accordance with this information. If the pitch period continuity decision information indicates "discontinuance", a pitch period index for each subframe is input through an input terminal 1302, and the subframe pitch period is decoded by a subframe pitch period decoder 1310 through the switch 1304. The subframe pitch period is then output from an output terminal 1312 through the switch 1311.

If the pitch period continuity decision information indicates "continuance", a pitch period analysis position index, a pitch period index, and a relative pitch period index are input through the input terminal 1302 and are respectively supplied to a pitch period analysis position decoder 1305, a pitch period decoder 1306, and a relative pitch period decoder 1307 through the switch 1304. A predicted subframe pitch period calculator 1308 then obtains a predicted subframe pitch period by using the pitch period analysis position and the pitch period which are obtained by the above operation. A subframe pitch period calculator 1309 calculates a subframe pitch period by using the predicted subframe pitch period and the relative pitch period, and outputs the subframe pitch period from the output terminal 1312 through the switch 1311.

Figure 54:
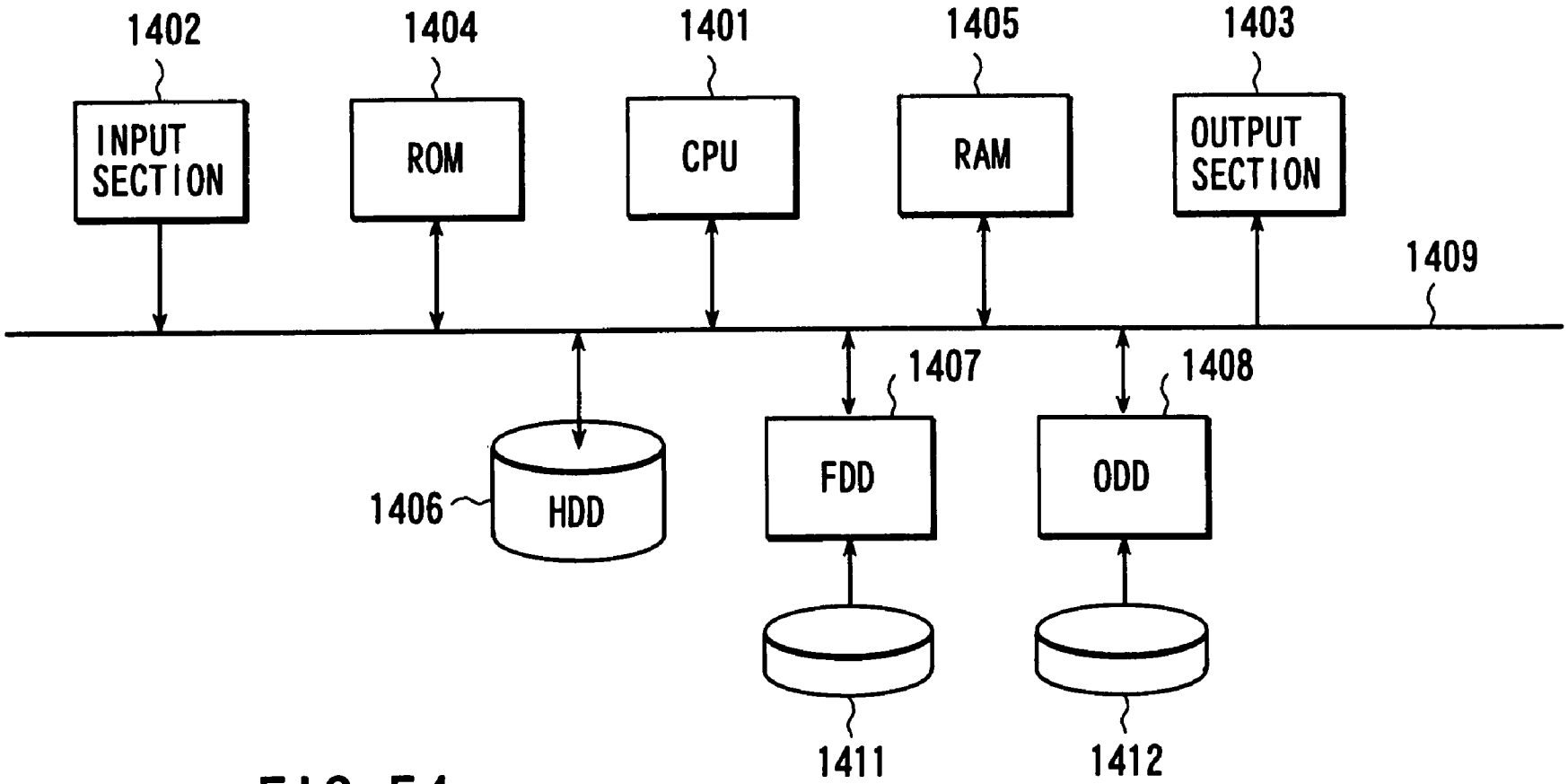
FIG. 54 is a block diagram showing a computer system for realizing the speech encoding/decoding method according to the present invention.

FIG. 54 shows the arrangement of a computer system for realizing the speech encoding/decoding method according to the present invention. For example, this computer system is a personal computer constituted by a CPU 1401 for controlling arithmetic processing, an input section 1402 such as a keyboard, a pointing device, or a microphone, an output section 1403 such as a display or a loudspeaker, a ROM 1404 and a RAM 1405 as a main memory, a hard disk unit 1406, a floppy disk unit 1407, and an optical disk unit 1408 as an external memory. These components are connected to each other through a bus 1409.

A program used to execute the speech encoding processing in the above embodiments described above and encoded data are stored in any one of the recording media: the hard disk unit 1406, the floppy disk unit 1407, and the optical disk unit 1408. The CPU 1401 performs speech encoding processing for an input speech signal input from the input section 1402 in accordance with this program, and also performs speech decoding processing for encoded data read out from the recording medium. The resultant data are then output from the output section 1403. With this processing, the speech encoding/decoding processing of the present invention can be performed by using a general personal computer.

The above speech encoding method can be variously modified and executed as follows:

(1) In the above embodiments, interpolation or extrapolation is used as a method of obtaining a predicted subframe pitch period. However, the present invention is not limited to this. For example, the prediction precision can be improved by increasing the number of pitch periods used for prediction or more sophisticated prediction can be performed by using a higher-order function or a spline function. With this prediction, the error between an actually measured subframe pitch and a predictive value is reduced, and a subframe pitch period can be expressed with a smaller information amount.

(2) When the pitch period obtained by the pitch period analysis section is to be quantized, prediction is performed on the basis of the pitch period obtained in the past, and the difference between the pitch period and the predictive value is quantized, thereby improving the quantization efficiency.

(3) When a search range is to be determined from a predicted subframe pitch period, the range may be set near a pitch period n (n is an integer) times or one-nth times the predicted subframe pitch period instead of being set near the predicted subframe pitch period.

(4) The above embodiments may be used to calculate a pitch period for a pitch filter as a constituent element of a perceptual weighting filter. Similarly, the above embodiments may be used to calculate a pitch period for a pitch filter as a constituent element of a post filter (not shown). In this case, since no additive information is required, the embodiments can be easily applied to a speech encoding apparatus.

(5) The speech encoding methods of the above embodiments may be switched in units of frames. In this case, additive information indicating the method of the specific embodiment used is newly required.

As has been described above, according to the speech encoding method of the present invention, the calculation amount required to search for a subframe pitch period can be reduced while the quality of a synthetic sound is maintained. In addition, the number of bits for expressing the information of a subframe pitch period can be effectively reduced.

According to the speech encoding method of the present invention, a predicted subframe pitch period of each subframe of the current frame is obtained by interpolation using the pitch periods of at least two of the current, feature, and previous frames. A subframe pitch period is determined by using this predicted subframe pitch period. With this processing, even if the pitch period varies within a frame, since a predicted subframe pitch period is predicted from a plurality of pitch periods, accurate prediction can be performed. As a result, the calculation amount required to obtain a subframe pitch period and the number of bits required to express the corresponding information can be reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

The invention claimed is:

1. A speech encoding method comprising the steps of:

dividing an input speech signal into frames each having a predetermined length;

obtaining a pitch period of a future frame with respect to a current frame to be encoded; and encoding the pitch period.

2. A speech encoding method comprising the steps of:

dividing an input speech signal into frames each having a predetermined length, and further dividing a speech signal of each frame into subframes;

obtaining a predictive pitch period of a subframe in a current frame by using pitch periods of at least two frames of the current frame to be encoded and past and future frames with respect to the current frame; and obtaining a pitch period of a subframe in the current frame by using the predicted pitch period.

3. A method according to claim 1, further comprising the step of encoding the pitch period of the subframe in the current frame.

4. A method according to claim 1, further comprising the step of preparing a pitch filter for suppressing or emphasizing a pitch period component of an input speech signal, and determining a transfer function for said pitch filter by using the pitch period of the subframe in the current frame.

5. A method according to claim 1, wherein the step of obtaining the pitch period of the frame comprises adaptively deciding a pitch period analysis position for each frame.

6. A method according to claim 1, further comprising the step of selecting a method of obtaining a pitch period of a subframe in the current frame in accordance with continuity of pitch periods.

7. A speech encoding apparatus comprising:

means for dividing an input speech signal into frames each having a predetermined length;

means for obtaining a pitch period of a future frame with respect to a current frame to be encoded; and means for encoding the pitch period obtained by said means for obtaining the pitch period.

8. A speech encoding apparatus comprising:

a divider section for dividing an input speech signal into frames each having a predetermined length, and further dividing a speech signal of each frame into subframes;

a predicted subframe pitch period calculation section for obtaining a predicted pitch period of a subframe in a current frame by using pitch periods of at least two frames of the current frame to be encoded and past and future frames with respect to the current frame; and a subframe pitch period calculation section for obtaining a pitch period of a subframe in the current frame by using the predicted pitch period.

9. A recording medium on which a program is recorded, said program being used to execute processing of dividing an input speech signal into frames each having a predetermined length, and obtaining a pitch period of a future frame with respect to a current frame to be encoded, and processing of encoding the pitch period.

10. A recording medium on which a program is recorded, said program being used to execute processing of dividing an input speech signal into frames each having a predetermined length, further dividing a speech signal of each frame into subframes, and obtaining a predicted pitch period of a subframe in a current frame by using pitch periods of at least two frames of the current frame to be encoded and past and future frames with respect to the current frame, and processing of obtaining a pitch period of a subframe in the current frame by using the predicted pitch period.

* * * * *

UNITED STATES PATENT AND TRADEMARK OFFICE

CERTIFICATE OF CORRECTION

PATENT NO. : 7,191,120 B2
APPLICATION NO. : 10/675947
DATED : March 13, 2007
INVENTOR(S) : Oshikiri et al.

It is certified that error appears in the above-identified patent and that said Letters Patent is hereby corrected as shown below:

On the title page, Item (62), the Related U.S. Application Data is incorrect. Item (62) should read:

-- Related U.S. Application Data

(62) Division of Application No. 09/726,562, filed on Dec. 1, 2000, now Pat. No. 6,704,702, which is a division Of application No. 09/012,792, filed on Jan. 23, 1998, Now Pat. No. 6,202,046 --

On the title page, Item (54), and column 1 is incorrect. Item (54) and column 1 should read:

-- (54) SPEECH ENCODING METHOD INCLUDING OBTAINING PITCH PERIOD, SPEECH ENCODING APPRATUS AND PROGRAM --

Signed and Sealed this

Fifth Day of June, 2007

JON W. DUDAS
*Director of the United States Patent and Trademark Office*